US007034788B2

(12) United States Patent
Someya et al.

(10) Patent No.: US 7,034,788 B2
(45) Date of Patent: Apr. 25, 2006

(54) IMAGE DATA PROCESSING DEVICE USED FOR IMPROVING RESPONSE SPEED OF LIQUID CRYSTAL DISPLAY PANEL

(75) Inventors: Jun Someya, Tokyo (JP); Noritaka Okuda, Tokyo (JP); Masaki Yamakawa, Tokyo (JP); Kyoichiro Oda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 461 days.

(21) Appl. No.: 10/460,222

(22) Filed: Jun. 13, 2003

(65) Prior Publication Data

US 2003/0231158 A1 Dec. 18, 2003

(30) Foreign Application Priority Data

| | | |
|---|---|---|
| Jun. 14, 2002 | (JP) | P2002-174325 |
| Sep. 4, 2002 | (JP) | P2002-258684 |
| Sep. 26, 2002 | (JP) | P2002-280954 |
| Dec. 17, 2002 | (JP) | P2002-365375 |

(51) Int. Cl.
*G09G 3/36* (2006.01)

(52) U.S. Cl. ..... 345/89; 345/690

(58) Field of Classification Search ..... 345/89, 345/94, 99, 690

See application file for complete search history.

(56) References Cited

U.S. PATENT DOCUMENTS

| | | | | |
|---|---|---|---|---|
| 5,111,195 | A * | 5/1992 | Fukuoka et al. | 345/204 |
| 5,465,102 | A * | 11/1995 | Usui et al. | 345/89 |
| 5,767,832 | A | 6/1998 | Koyama et al. | |
| 6,310,600 | B1 | 10/2001 | Koyama et al. | |
| 6,614,418 | B1 | 9/2003 | Koyama et al. | |
| 6,642,915 | B1 * | 11/2003 | Booth et al. | 345/90 |
| 6,825,824 | B1 * | 11/2004 | Lee | 345/89 |
| 6,943,763 | B1 * | 9/2005 | Shibata et al. | 345/89 |
| 2001/0038372 | A1 | 11/2001 | Lee | |
| 2002/0024481 | A1 * | 2/2002 | Kawabe et al. | 345/87 |
| 2002/0030652 | A1 | 3/2002 | Shibata et al. | |
| 2002/0033813 | A1 | 3/2002 | Matsumura et al. | |
| 2002/0050965 | A1 | 5/2002 | Oda et al. | |
| 2002/0140652 | A1 | 10/2002 | Suzuki et al. | |

FOREIGN PATENT DOCUMENTS

| | | |
|---|---|---|
| CN | 1351324 A | 5/2002 |
| JP | 10-0319221 B1 | 1/1995 |

(Continued)

*Primary Examiner*—Ricardo Osorio
(74) *Attorney, Agent, or Firm*—Birch Stewart Kolasch & Birch LLP

(57) ABSTRACT

A coding circuit codes present image data of a pixel which is received as raster data and a delay circuit stores a coded image data for one frame period and outputs one-frame preceding image data of the pixel in accordance with an input of the coded image data. First and second decoder circuits decode coded image data and one-frame preceding coded image data, respectively, a variation-amount calculation circuit calculates variation-amount data of both decoded image date, and an one-frame preceding image reproduction circuit reproduces one-frame preceding reproduced image data. An image date correction circuit generates corrected present image data on the basis of the present image data and the one-frame preceding reproduced image data.

16 Claims, 37 Drawing Sheets

FOREIGN PATENT DOCUMENTS

| | | | |
|---|---|---|---|
| JP | 07-121143 | A | 5/1995 |
| JP | 07-239463 | A | 9/1995 |
| JP | 08-294126 | | 11/1996 |
| JP | 09/081083 | A | 3/1997 |
| JP | 2616652 | B2 | 3/1997 |
| JP | 3041951 | B2 | 3/2000 |
| JP | 2000-322024 | A | 11/2000 |
| JP | 2001-265298 | A | 9/2001 |
| JP | 2002-091390 | A | 3/2002 |
| JP | 2002-189458 | A | 7/2002 |
| JP | 2002-297104 | A | 10/2002 |

* cited by examiner n FRAME

| | A | B | C | D |
|---|---|---|---|---|
| a | 52 | 152 | 52 | 52 |
| b | 52 | 152 | 52 | 52 |
| c | 48 | 148 | 48 | 48 |
| d | 48 | 148 | 48 | 48 |

FIG. 15A

La=100 Lb=100

| | | | |
|---|---|---|---|
| 0 | 1 | 0 | 0 |
| 0 | 1 | 0 | 0 |
| 0 | 1 | 0 | 0 |
| 0 | 1 | 0 | 0 |

FIG. 15B

| | A | B | C | D |
|---|---|---|---|---|
| a | 50 | 150 | 50 | 50 |
| b | 50 | 150 | 50 | 50 |
| c | 50 | 150 | 50 | 50 |
| d | 50 | 50 | 50 | 50 |

FIG. 15C

| | A | B | C | D |
|---|---|---|---|---|
| a | 0 | 0 | 0 | 0 |
| b | 0 | 0 | 0 | 0 |
| c | 0 | 0 | 0 | 0 |
| d | 0 | 0 | 0 | 0 |

FIG. 15G

| | A | B | C | D |
|---|---|---|---|---|
| a | 52 | 152 | 52 | 52 |
| b | 52 | 152 | 52 | 52 |
| c | 48 | 148 | 48 | 48 |
| d | 48 | 148 | 48 | 48 |

FIG. 15H n+1 FRAME

| | A | B | C | D |
|---|---|---|---|---|
| a | 52 | 152 | 52 | 52 |
| b | 52 | 152 | 52 | 52 |
| c | 48 | 148 | 48 | 48 |
| d | 48 | 148 | 48 | 48 |

FIG. 15D

La=100 Lb=100

| | | | |
|---|---|---|---|
| 0 | 1 | 0 | 0 |
| 0 | 1 | 0 | 0 |
| 0 | 1 | 0 | 0 |
| 0 | 1 | 0 | 0 |

FIG. 15E

| | A | B | C | D |
|---|---|---|---|---|
| a | 50 | 150 | 50 | 50 |
| b | 50 | 150 | 50 | 50 |
| c | 50 | 150 | 50 | 50 |
| d | 50 | 150 | 50 | 50 |

FIG. 15F n-1 FRAME

| | A | B | C | D |
|---|---|---|---|---|
| a | 52 | 152 | 52 | 52 |
| b | 52 | 152 | 52 | 52 |
| c | 48 | 148 | 48 | 48 |
| d | 48 | 148 | 48 | 48 |

FIG. 27A

La=100 Lb=100

| | | | |
|---|---|---|---|
| 0 | 1 | 0 | 0 |
| 0 | 1 | 0 | 0 |
| 0 | 1 | 0 | 0 |
| 0 | 1 | 0 | 0 |

FIG. 27B

| | A | B | C | D |
|---|---|---|---|---|
| a | 50 | 150 | 50 | 50 |
| b | 50 | 150 | 50 | 50 |
| c | 50 | 150 | 50 | 50 |
| d | 50 | 50 | 50 | 50 |

FIG. 27C

| | A | B | C | D |
|---|---|---|---|---|
| a | 0 | 0 | 0 | 0 |
| b | 0 | 0 | 0 | 0 |
| c | 0 | 0 | 0 | 0 |
| d | 0 | 0 | 0 | 0 |

FIG. 27G

| | A | B | C | D |
|---|---|---|---|---|
| a | 52 | 152 | 52 | 52 |
| b | 52 | 152 | 52 | 52 |
| c | 48 | 148 | 48 | 48 |
| d | 48 | 148 | 48 | 48 |

FIG. 27H n FRAME

| | A | B | C | D |
|---|---|---|---|---|
| a | 52 | 152 | 52 | 52 |
| b | 52 | 152 | 52 | 52 |
| c | 48 | 148 | 48 | 48 |
| d | 48 | 148 | 48 | 48 |

FIG. 27D

La=100 Lb=100

| | | | |
|---|---|---|---|
| 0 | 1 | 0 | 0 |
| 0 | 1 | 0 | 0 |
| 0 | 1 | 0 | 0 |
| 0 | 1 | 0 | 0 |

FIG. 27E

| | A | B | C | D |
|---|---|---|---|---|
| a | 50 | 150 | 50 | 50 |
| b | 50 | 150 | 50 | 50 |
| c | 50 | 150 | 50 | 50 |
| d | 50 | 150 | 50 | 50 |

FIG. 27F

FIG. 37A
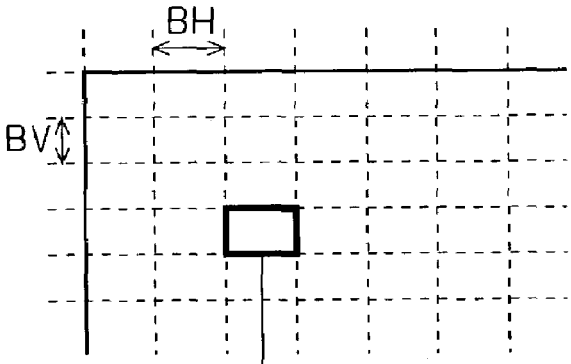
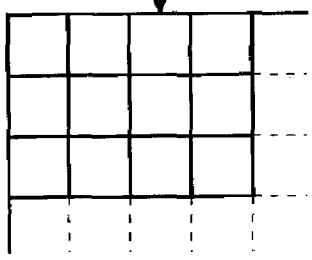
FIG. 37B
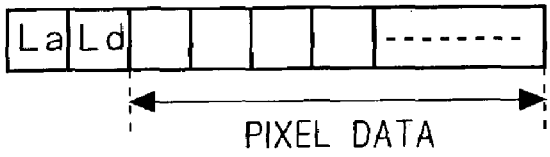
FIG. 37C

FIG. 38A

| | | | |
|---|---|---|---|
| 50 | 200 | 100 | 150 |
| 50 | 100 | 200 | 150 |
| 150 | 100 | 10 | 100 |
| 150 | 240 | 50 | 200 |

FIG. 38B

| | | | |
|---|---|---|---|
| 00 | 11 | 01 | 10 |
| 00 | 01 | 11 | 10 |
| 10 | 01 | 00 | 01 |
| 10 | 11 | 00 | 11 |

QL=4
BH=4
BV=4
Ld=170
La=125

FIG. 38C

| | | | |
|---|---|---|---|
| 40 | 210 | 99 | 151 |
| 40 | 99 | 210 | 151 |
| 151 | 99 | 40 | 99 |
| 151 | 210 | 40 | 210 |

FIG. 43A

| | | | | | | | |
|---|---|---|---|---|---|---|---|
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |

8×64
=512

BH=4
BV=4
La=8
Ld=8
QL=4

FIG. 43B

| | | | |
|---|---|---|---|
| 8 | | 8 | |
| 2 | 2 | 2 | 2 |
| 2 | 2 | 2 | 2 |
| 2 | 2 | 2 | 2 |
| 2 | 2 | 2 | 2 |

×4

8+8+(2×16)
=48

48×4=192

FIG. 43C

| | | | | | | | |
|---|---|---|---|---|---|---|---|
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |
| 8 | 8 | 8 | 8 | 8 | 8 | 8 | 8 |

×2

(C)

8×64
=512

FIG. 43D

| | | | |
|---|---|---|---|
| 8 | 8 | 8 | 8 |
| 8 | 8 | 8 | 8 |
| 8 | 8 | 8 | 8 |
| 8 | 8 | 8 | 8 |

×2

(D)

BH=4
BV=4
La=8
Ld=8
QL=2

FIG. 43E

| | | | |
|---|---|---|---|
| 8 | | 8 | |
| 1 | 1 | 1 | 1 |
| 1 | 1 | 1 | 1 |
| 1 | 1 | 1 | 1 |
| 1 | 1 | 1 | 1 |

×2

(E)

8+8+(1×16)
=32

32×2=64 n FRAME

| | A | B | C | D |
|---|---|---|---|---|
| a | 50 | 150 | 50 | 50 |
| b | 50 | 150 | 50 | 50 |
| c | 50 | 150 | 50 | 50 |
| d | 50 | 150 | 50 | 50 |

FIG. 46A

| | A | B | C | D |
|---|---|---|---|---|
| a | 50 | — | 50 | — |
| b | — | — | — | — |
| c | 50 | — | 50 | — |
| d | — | — | — | — |

FIG. 46B

| | A | B | C | D |
|---|---|---|---|---|
| a | 50 | 50 | 50 | 50 |
| b | 50 | 50 | 50 | 50 |
| c | 50 | 50 | 50 | 50 |
| d | 50 | 50 | 50 | 50 |

FIG. 46C n+1 FRAME

| | A | B | C | D |
|---|---|---|---|---|
| a | 50 | 150 | 50 | 50 |
| b | 50 | 150 | 50 | 50 |
| c | 50 | 150 | 50 | 50 |
| d | 50 | 150 | 50 | 50 |

FIG. 46D

IMAGE DATA PROCESSING DEVICE USED FOR IMPROVING RESPONSE SPEED OF LIQUID CRYSTAL DISPLAY PANEL

BACKGROUND OF THE INVENTION

1. Field of the Invention

The present invention relates to a liquid crystal display comprising (1) a liquid crystal display panel (hereinafter, referred to also as "LCD panel") which comprises a backlight, a liquid crystal (liquid crystal panel) and its driver and (2) an image data processing device for generating corrected image data from raster data inputted from the outside, which is used to determine a voltage to be applied to the liquid crystal of the LCD panel, and more particularly to a technique for processing image data for the LCD panel to optimize a response speed of the liquid crystal (which corresponds to the amount of change in transmittance of the liquid crystal per unit time) in accordance with a change in luminance of a moving image to be inputted.

2. Description of the Background Art

Since transmittance of a liquid crystal varies depending on a cumulative response effect, an LCD panel involves a problem that it can not appropriately respond to an inputted moving image with luminance variation which is relatively faster in speed than a response of the liquid crystal. In order to solve this problem, proposed is a method for improving the response speed of the liquid crystal in which a driving voltage of the liquid crystal at the time of change in luminance of the inputted moving image is intentionally made larger than a normal driving voltage.

An exemplary liquid crystal display device which is made capable of controlling its response speed by a liquid crystal driving operation through the above method so that the response speed of the liquid crystal should increase in accordance with change in luminance of the inputted moving image is disclosed in detail in Japanese Patent No. 2616652 (referred to as a "first prior art"). Specifically, the liquid crystal display device disclosed in the first prior art comprises an A/D converter circuit for sequentially A/D converting raster image data which give pixels in each of motion screens, an image memory (frame memory) for holding the image data for one frame of the inputted motion screen, a comparator circuit for comparing present image data of a pixel with one-frame preceding image data of the pixel to output a luminance change signal, a driving circuit for liquid crystal panel and a liquid crystal panel.

Next, an operation of the above liquid crystal display device will be discussed. The A/D converter circuit samples the raster image data of analog format with a sampling clock having a predetermined frequency, converts the sampled raster image data into image data of digital format and outputs the converted image data to the image memory and the comparator circuit. The image memory reads one-frame preceding image data which is stored in advance at an address corresponding to the pixel in response to the input of the image data of each pixel to output the one-frame preceding image data to the comparator circuit and overwrites the inputted present image data at the above address. Thus, the image memory serves as a delay circuit for delaying the present image data of each inputted pixel by a period corresponding to one frame. The comparator circuit compares the present image data outputted from the A/D converter circuit with the one-frame preceding image data outputted from the image memory to output a luminance change signal which gives a luminance change of the image between the present image data and the one-frame preceding image data, together with the present image data, to the driving circuit. The driving circuit applies a driving voltage higher than a normal liquid crystal driving voltage to the liquid crystal panel with respect to the pixel whose luminance value increases, on the basis of the luminance change signal, thereby to drive the display pixel on the panel. On the other hand, the driving circuit applies a driving voltage lower than the normal driving voltage to the liquid crystal panel with respect to the pixel whose luminance value decreases, on the basis of the luminance change signal, thereby to drive the display pixel on the panel.

In the liquid crystal display device disclosed in the first prior art, however, when the number of pixels of the liquid crystal panel becomes larger, since the number of image data for one frame to be written in the image memory accordingly increases, the memory capacity required as the image memory inevitably becomes larger.

Then, from the viewpoint of reduction in capacity of the image memory, a liquid crystal display device disclosed in Japanese Patent No. 3041951 (referred to as a "second prior art") proposes a skipping operation method where one address of the image memory is allocated to four pixels. Specifically, in the second prior art, alternate ones of the pixel data arranged in matrix are skipped in each of the horizontal and vertical directions and each of the remaining image data is stored in the image memory, and in read operation from the image memory, for the three adjacent skipped pixels, the same image data as the image data of the corresponding stored pixel is read out three times, allocating the skipped pixel image data, to reduce the memory capacity of the image memory. For example, when the image data of a pixel at coordinates (a, A) is stored at address 0 in the image memory, the image data at the address 0 is read and allocated to the three skipped pixels at coordinates (a, B), (b, A) and (b, B).

When the method proposed in Japanese Patent No. 3041951 is used, however, the following problem is caused, instead. This problem will be shown in FIGS. 46A to 46D (non prior arts).

FIG. 46A shows image data in an n-th frame, FIG. 46B shows the image data obtained after the skipping operation for the image in the n-th frame shown in FIG. 46A, FIG. 46C shows the image data obtained after interpolation by the above read operation of the skipped pixel data, and FIG. 46D shows the image data in an (n+1)-th frame posterior to the n-th frame by one frame. As shown in FIGS. 46A and 46D, the image in the n-th frame and that in the (n+1)-th frame are equal to each other.

When the skipping operation is performed, as shown in FIG. 46C, the pixel data at (A, a) is read out as the pixel data at (B, a) and (B, b) and the pixel data at (A, c) is read out as the pixel data at (B, c) and (B, d). Specifically, the pixel data which actually has a luminance value of 150 is read out as the pixel data which has a luminance value of 50. Therefore, though there is no change between the image in the present frame and the one-frame preceding image, the respective display pixels corresponding to the addresses (B, a), (B, b), (B, c) and (B, d) in the n-th frame are driven by a driving voltage higher than a normal driving voltage.

Thus, when the skipping operation is performed, a correct control of the voltage is not made at a portion where the pixel data is skipped and as a result, deterioration in image quality occurs due to an unnecessary voltage which is applied.

As discussed above, in these prior-art patent inventions, even if there is a change (difference) in luminance value between the present frame and the one-preceding frame, it is possible to improve the response speed of the liquid crystal by setting the liquid crystal driving voltage larger than a normal driving voltage.

The former prior-art patent invention (the first prior art), however, has a problem of causing an increase in capacity of the image memory which has a delay function, and the latter prior-art patent invention (the second prior art) has a problem that deterioration in image quality is caused by reduction in memory capacity, and therefore both prior arts have their respective merits and demerits.

SUMMARY OF THE INVENTION

It is a primary object of the present invention to provide a image data processing technique to accurately control a response speed of a liquid crystal by appropriately controlling a voltage to be applied to the liquid crystal in accordance with at least variation of a luminance value of an inputted motion screen with time while reducing a memory capacity without deterioration in image quality due to a skipping operation.

In this point, in the above-discussed prior-art patented invention (the first and second prior arts), consideration is given only to a relation between the amount of change in luminance value of the inputted motion screen and the response speed of the liquid crystal, and no consideration nor study is made on a relation between the temperature of the liquid crystal panel and its neighborhood temperature and the response speed of the liquid crystal. This makes it impossible to provide a liquid crystal display device which is more suitable for practical use.

The present invention is intended to solve also such a problem as above, and it is a secondary object of the present invention to provide an image data processing technique to accurately control the response speed of the liquid crystal by appropriately controlling the voltage to be applied to the liquid crystal in accordance with variation of a luminance value of the inputted motion screen with time and variation in ambient temperature of the liquid crystal display panel while reducing a memory capacity without deterioration in image quality due to the skipping operation.

The present invention is intended for an image data processing circuit for correcting an image data representing a gray-scale level of an image to be displayed by a liquid crystal element. In the image data processing circuit, a voltage applied to the liquid crystal element is determined based on the image data. According to the present invention, the image data processing circuit includes a coding circuit, a first decoding circuit, a delay circuit, a second decoding circuit, a detecting circuit, an image reproducing circuit and a data correcting circuit. The coding circuit outputs a coded-image data which is produced by coding the image data of a present frame. The first decoding circuit decodes the coded-image data, thereby producing a first decoded-image data corresponding to the present frame. The delay circuit delays the coded-image data by one frame period. The second decoding circuit decodes the coded-image data which is delayed by one frame period, thereby producing a second decoded-image data corresponding to a previous frame. The detecting circuit detects a deference between the first decoded-image data and the second decoded-image data. The image reproducing circuit produces a previous-frame-image data on the basis of the image data of the present frame and the difference between the first decoded-image data and the second decoded-image data. The data correcting circuit corrects the image data of the present frame in accordance with the difference of the gray-scale level between the present frame and the previous frame obtained from the previous-frame-image data and the image data of the present frame.

In the image data processing device of the present invention, since the amount of correction of image data is so controlled as to increase the response speed of the liquid crystal in accordance with variation of image data with time, it is possible to appropriately control the response speed of the liquid crystal.

Additionally, in the image data processing device of the present invention, since the image data is once compressed, the amount of change in luminance value is calculated on the basis of the first decoded image and the second decoded image, an one-frame preceding image is reproduced on the basis of the calculated variation-amount data and the present image data and the luminance value of a present image is corrected on the basis of the present image and reproduced one-frame preceding image when the change of image data with time is detected, it is possible to remarkably reduce a storage capacity in the delay circuit for outputting the image preceding the present image by one frame and suppress deterioration in image quality.

These and other objects, features, aspects and advantages of the present invention will become more apparent from the following detailed description of the present invention when taken in conjunction with the accompanying drawings.

BRIEF DESCRIPTION OF THE DRAWINGS

FIGS. 15A to 15H are views showing whether there is an effect of possible error due to coding and decoding operations on one-frame preceding reproduced image data or not;

FIGS. 27A to 27H are views showing whether there is an effect of possible error due to coding and decoding operations on one-frame preceding reproduced image data or not in the liquid crystal display device in accordance with the third preferred embodiment;

FIGS. 37A to 37C are views showing a compressive coding operation in accordance with the fourth preferred embodiment;

FIGS. 38A to 38C are views showing the compressive coding operation in accordance with the fourth preferred embodiment;

FIGS. 43A to 43E are views showing the skipping operation in accordance with the second variation of the fourth preferred embodiment;

FIGS. 46A to 46D are views showing a problem of the skipping operation in the prior document;

DESCRIPTION OF THE PREFERRED EMBODIMENTS

Viewpoints of the First and Second Preferred Embodiments

Even if a voltage to be applied to each display pixel of a liquid crystal panel is optimized in accordance with a change in luminance value of image data of each pixel in an inputted motion screen at a certain temperature (e.g., room temperature), when an ambient temperature of the panel including at least a liquid crystal panel is higher than the above certain temperature, a voltage higher than an appropriate voltage is applied to the liquid crystal and this consequently causes deterioration in image quality. Specifically, when the ambient temperature is higher than the room temperature, the response speed of the liquid crystal at this time becomes higher than that at the room temperature and a time required for the transmittance of the liquid crystal to change from a certain value to a target value becomes relatively shorter. Therefore, when a corrected voltage is equal to that at the room temperature, an excessive correction occurs. Specifically, the transmittance at a point in time when a time period corresponding to one frame period passes is larger than the target value, and therefore a portion in a display screen which changes to be brighter becomes excessively brighter and conversely a portion in the display screen which changes to be darker becomes excessively darker. On the other hand, when the ambient temperature is lower than the above certain temperature, an insufficient correction occurs.

The first and second preferred embodiments of the present invention, paying attention to a relation between such a change in ambient temperature and the response speed of the liquid crystal, based on this point of view, controls the response speed of the liquid crystal to be an optimum value in accordance with the change in luminance value of the image data in the inputted motion screen with time (increases the response speed of the liquid crystal in accordance with the above change in luminance value with time).

The first and second preferred embodiments will be discussed below with reference to figures.

The First Preferred Embodiment

Figure 1:
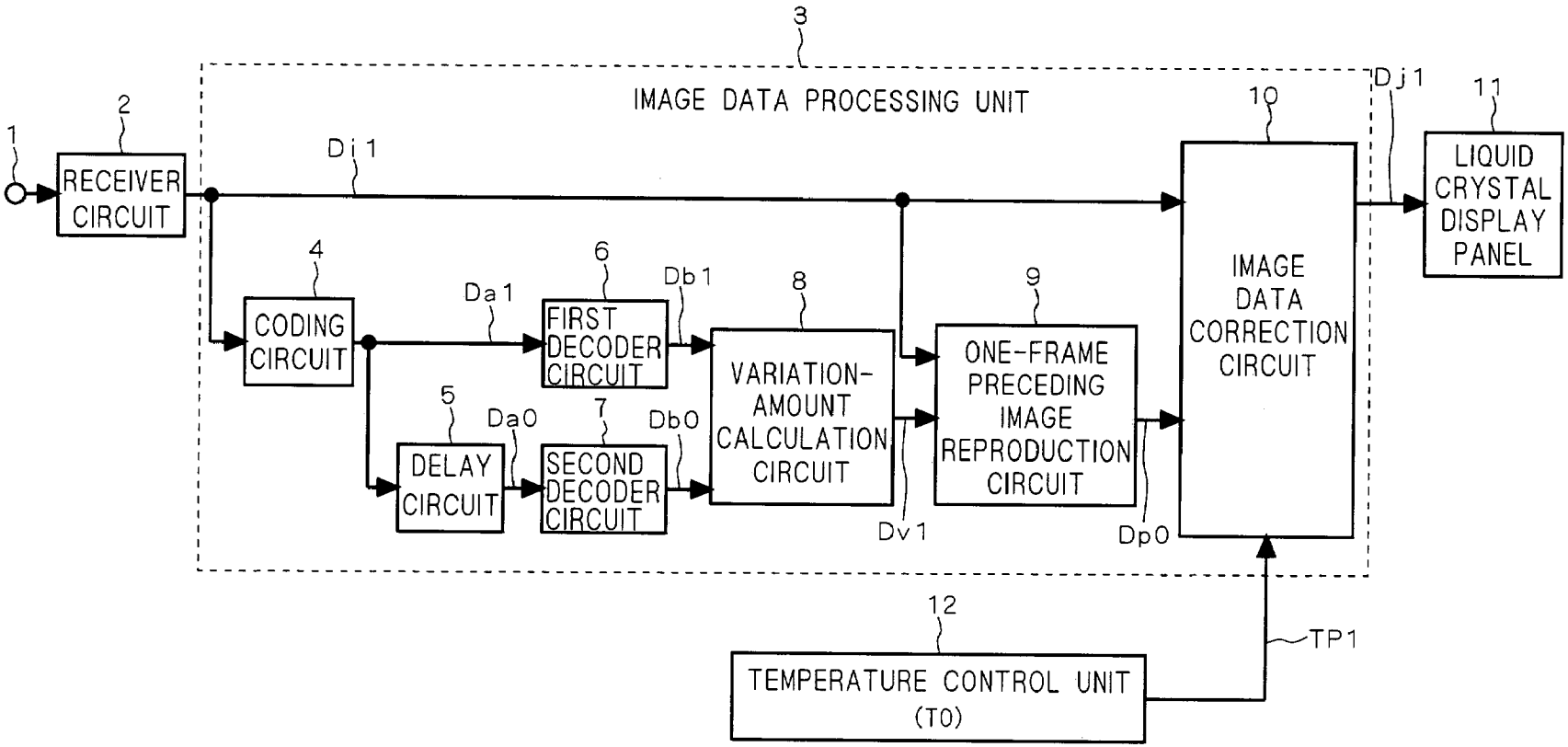
FIG. 1 is a block diagram showing an exemplary constitution of a liquid crystal display device in accordance with a first preferred embodiment.

FIG. 1 is a block diagram showing a liquid crystal display device in accordance with the first preferred embodiment. The liquid crystal display device broadly comprises an image data processing device which is an essential part of the liquid crystal display device and a liquid crystal display panel 11 connected to the image data processing device. The image data processing device comprises a receiver circuit 2, an image data processing unit 3 and a temperature control unit 12. On the other hand, the liquid crystal display panel 11 consists of a liquid crystal panel including a liquid crystal, its driving electrode and the like, a backlight, a driving circuit and the like. The liquid crystal display panel 11 receives corrected image data (referred to also as "corrected present image data") Dj1 representing luminance or density of an image, generates a voltage corresponding to the received corrected image data Dj1 and applies the voltage to the liquid crystal, to perform a display operation.

Herein, the image data processing device is a unit for generating the corrected image data Dj1 which determines a voltage to be applied to the liquid crystal from image data of the inputted moving image, and its function will be schematically described below. Specifically, the image data processing device (I) generates at least two candidates of the corrected image data under different temperatures, which can apply such a voltage as to increase the response speed of the liquid crystal in accordance with a change in luminance value of the image data with time, and (II) determines one out of at least two candidates of corrected image data as optimum corrected image data, which can give the optimum response speed under the ambient temperature in accordance with a measurement result of the ambient temperature of the liquid crystal.

Constituent elements of the image data processing device which performs the above function will be described below.

First, the receiver circuit 2 has an input terminal 1 for sequentially receiving image data (raster data) which give respective pixels of a screen (motion screen) (hereinafter, this screen will be referred to as "present image") to be displayed on the liquid crystal display panel 11 and an output end for sequentially outputting the received image data as present image data Di1.

Next, the image data processing unit 3 which is a main body consists of a coding circuit 4, a delay circuit 5, a first decoder circuit 6, a second decoder circuit 7, a variation-amount calculation circuit 8, a one-frame preceding image reproduction circuit 9 and an image date correction circuit 10, and generates corrected present image data Dj1 corresponding to the present image data Di1.

First, the coding circuit 4 has an input end connected to the output end of the receiver circuit 2 and an output end, and codes the inputted present image data Di1 to output coded image data Da1 from its output end. Herein, this coding operation for the present image data Di1 in the coding circuit 4 is performed by using block truncation coding (BTC) such as FBTC and GBTC. Alternatively, the coding operation can be also performed by using any still picture coding system, e.g., two-dimensional discrete cosine transform coding such as JPEG, predictive coding such as JPEG-LS or wavelet transform such as JPEG2000. Each of these still picture coding methods is available even if it is an irreversible coding system in which uncoded image data and decoded image data do not completely coincide with each other.

The first decoder circuit 6 has an input end connected to the output end of the coding circuit 4 and an output end, and decodes the received coded image data Da1 to output first decoded image data Db1 corresponding to the present image data Di1 from its output end.

The delay circuit 5 has an input end connected to the output end of the coding circuit 4 and an output end connected to the second decoder circuit 7 described later, and delays the coded image data Da1 received by its input end by one frame period of the motion screen received by the terminal 1 to output coded image data Da1 which is delayed as delay coded image data Da0 from its output end. Therefore, the delay circuit 5 outputs coded image data preceding the coded image data Da1 by the one frame period as delay coded image data Da0 in accordance with a receiving timing of the coded image data Da1.

Herein, "one frame period" refers to "a time period from the time when data of a certain pixel is received and a voltage corresponding to the data is applied to a liquid crystal portion forming a display pixel corresponding to the certain pixel to the time when data of a pixel at the same position in the next frame is received and a voltage corresponding to the data is applied to the above liquid crystal portion".

The delay circuit 5 having such a delay function consists of, e.g., (1) one memory (e.g., RAM) (not shown) having both read and write functions of data and (2) a timing circuit (not shown) for generating a read/write command signal (address signal) which specifies an address of the above memory in synchronization with a synchronizing signal (not shown) of the above motion screen received by the input terminal 1 (one memory construction). In this constitution case, the delay circuit 5 (i) reads coded image data of a point in time prior to the point in time when the coded image data Da1 is received by one frame period from at an object address where the one-frame preceding coded image data is stored among addresses (data storage region) of (1) the above memory and outputs the read data as the delay coded image data Da0 in accordance with the receiving timing of the present coded image data Da1, and (ii) immediately after that, writes the present coded image data Da1 into the above object address. Through such an operation, the delay circuit 5 performs the delay function on the present coded image data Da1. In the image data processing unit 3, since the number of data to be written into the memory are equal to the number of data read from the memory and moreover the image data are sequentially read out in the order from the image data stored in a memory region corresponding to the pixel on the uppermost-left position of one screen, as shown in the above example, one memory can perform read of already-stored image data and write of new image data.

Further, as an other exemplary constitution of the delay circuit 5, a construction using two memories which are simultaneously addressed by the above timing circuit (two-memory construction) is available. Specifically, the delay circuit 5 writes the present coded image data Da1 into one of the memories in accordance with the receiving timing of the present coded image data Da1 and at the same time, reads the above one-frame preceding coded image data which was already written one frame period ago from the other of the memories, to output the read data as the delay coded image data Da0.

As discussed above, the delay circuit 5 outputs the delay coded image data Da0 which is obtained by coding the image data preceding the present image data Di1 by the one frame period through an operation of delaying the coded image data Da1 by a time period corresponding to the one frame.

Thus, since the delay circuit 5 stores the coded image data Da1 which is once compressed into the memory which is a constituent thereof, instead of storing the present image data Di1 directly into the memory, it is possible to easily achieve reduction in memory capacity of the delay circuit 5. Moreover, as the coding ratio (data compression ratio) of the present image data Di1 becomes higher, it is possible to remarkably reduce the memory capacity of the memory which is a constituent of the delay circuit 5. This point is an advantage which the earlier-discussed two prior-art patent inventions do not have.

The second decoder circuit 7 has an input end connected to the output end of the delay circuit 5 and an output end, and decodes the delay coded image data Da0 outputted from the delay circuit 5. Specifically, the second decoder circuit 7 receives, by its input end, the coded image data Da0 of the one-frame preceding image data which was already outputted from the receiver circuit 2 as the present image data Di1 at a point in time prior to the output of the present image data Di1 from the receiver circuit 2 by the one frame period, and decodes the received coded image data Da0 to output second decoded image data Db0 corresponding to the above one-frame preceding image data from its output end.

The variation-amount calculation circuit 8 has input ends connected to the output end of the first decoder circuit 6 and the output end of the second decoder circuit 7 and an output end, and calculates the amount of change in luminance value between the present image data Di1 and the above one-frame preceding image data on the basis of the first decoded image data Db1 and the second decoded image data Db0, to output calculated variation-amount data Dv1 from its output end. As an example, the variation-amount calculation circuit 8 is formed of a subtractor circuit and subtracts the first decoded image data Db1 corresponding to the present image from the second decoded image data Db0 corresponding to an image preceding the present image by one frame to obtain the variation-amount data Dv1 for each pixel.

The one-frame preceding image reproduction circuit 9 has input ends connected to the output end of the receiver circuit 2 and the output end of the variation-amount calculation circuit 8 and an output end, and reproduces one-frame preceding image data Dp0 on the basis of the present image data Di1 and the variation-amount data Dv1, to output the obtained one-frame preceding reproduced image data Dp0 from its output end. Specifically, the one-frame preceding image reproduction circuit 9 is formed of an adder circuit and adds the variation-amount data Dv1 to the present image data Di1 to reproduce the one-frame preceding reproduced image data Dp0 which corresponds to data preceding the present image data Di1 by one frame.

The image date correction circuit 10 is an essential part of the image data processing unit 3, and its interconnection and function will be clear in connection with the temperature control unit 12 described below. Then, prior to detailed discussion on the image date correction circuit 10, a constitution of the temperature control unit 12 will be discussed.

The temperature control unit 12 has at least one data of reference temperature (T0) and an output end for outputting a control signal TP1. Then, the temperature control unit 12 compares the temperature data of the liquid crystal display panel 11 or its neighborhood atmosphere (the temperature data is defined as "ambient temperature data") with at least one reference temperature data and outputs the control signal TP1 from its output end on the basis of the comparison result. As an example, the temperature control unit 12 consists of (1) a temperature sensor for measuring the above ambient temperature data (the temperature sensor may be an external part provided separately from the temperature control unit 12) and (2) a comparator having a first input end connected to an output end of the temperature sensor and a second input end to which a level giving the data of reference temperature (T0) is applied, and outputs the control signal TP1 as a first level (for example, "1" level) when the ambient temperature (T) is not higher than the reference temperature (T0) and outputs the control signal T1 as a second level (for example, "0" level) when the ambient temperature (T) is higher than the reference temperature (T0).

Herein, a note on the above ambient temperature will be presented. Specifically, though a place where the temperature measurement is made should be ideally the liquid crystal itself, since such a temperature measurement is actually impossible, instead, a surface temperature of the liquid crystal panel or a temperature in neighborhood atmosphere of the liquid crystal panel is used. Further, since the liquid crystal panel is provided in the LCD panel 11, the "ambient temperature" is eventually defined as "temperature in either the liquid crystal display panel 11 or its neighborhood atmosphere".

Next, based on the above constitution and function of the temperature control unit 12, constitution and function of the image date correction circuit 10 will be discussed. Specifically, the image date correction circuit 10 has input ends connected to the output end of the receiver circuit 2, the output end of the one-frame preceding image reproduction circuit 9 and the output end of the temperature control unit 12 and an output end connected to the liquid crystal display panel 11. The image date correction circuit 10 (1) detects whether a first luminance value indicated by the present image data Di1 and a second luminance value indicated by the one-frame preceding reproduced image data Dp1 are different from each other or not, and (2) corrects the first luminance value on the basis of the present image data Di1, the one-frame preceding reproduced image data Dp1 and the control signal TP1 and outputs the corrected present image data Dj1 which gives a corrected luminance value from its output end when the first and second luminance values are different from each other. On the other hand, when the first and second luminance values are equal to each other, the image date correction circuit 10 (3) outputs the present image data Di1 as the corrected present image data Dj1 without correction from its output end. In this case, the corrected present image data Dj1 is determined so that the transmittance of the liquid crystal achieved by a liquid crystal application voltage which is generated by the liquid crystal display panel 11 on the basis of the corrected present image data Dj1 should reach a first transmittance which corresponds to the first luminance value at the point in time when the one frame period passes from reception of the present image data Di1.

Discussing again, the image date correction circuit 10 performs a control operation on the basis of the control signal TP1 outputted from the temperature control unit 12 so that the amount of correction of the correction candidate image data should be appropriate in the ambient temperature. For example, since the response speed of the liquid crystal varies with temperature, the image date correction circuit 10 controls the response speed of the liquid crystal to be an appropriate value by setting the amount of correction to be relatively small when the temperature is relatively high and setting the amount of correction to be relatively large when the temperature is relatively low.

Finally, the LCD panel 11 performs a display operation by applying a voltage which is generated on the basis of the corrected present image data Dj1 to the liquid crystal.

Figure 2:
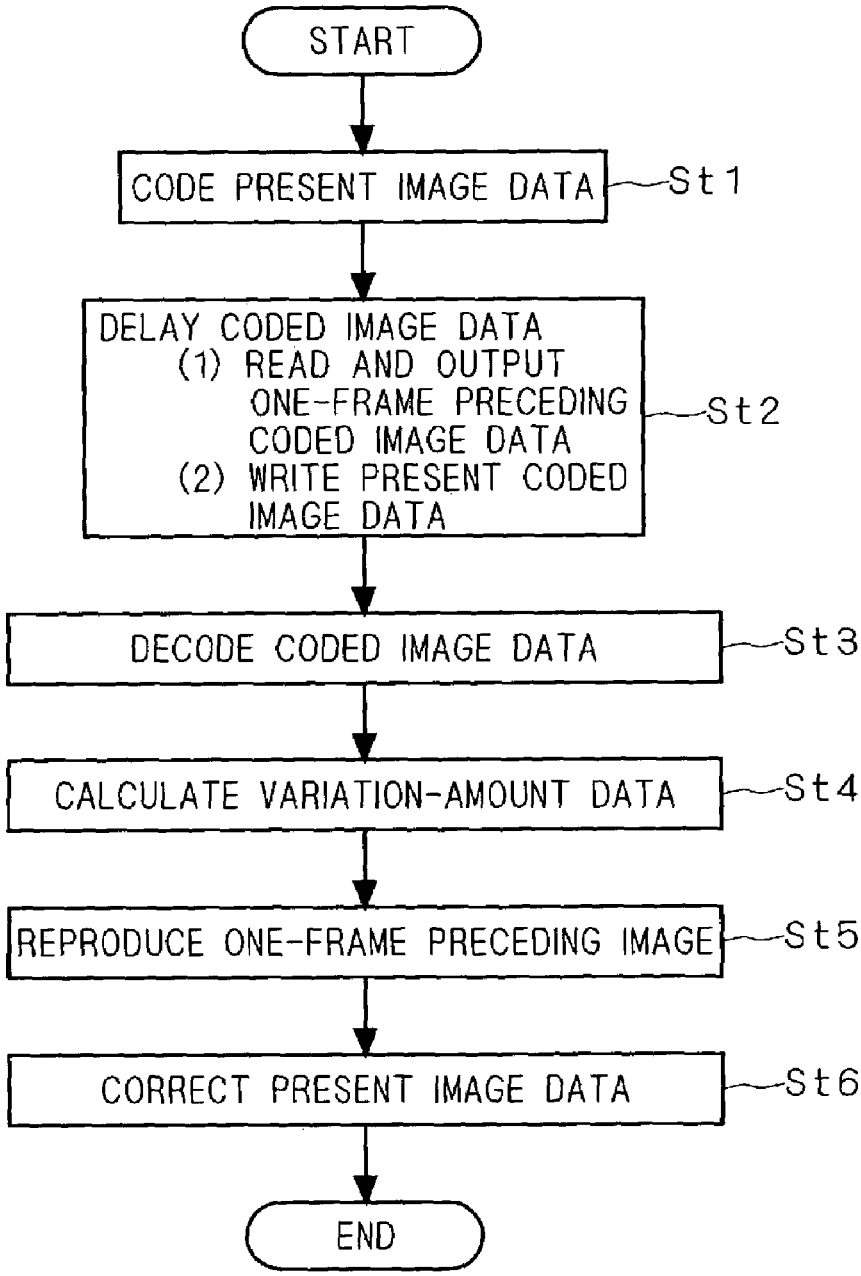
FIG. 2 is a flowchart showing an operation in an image data processing circuit in accordance with the first preferred embodiment.

FIG. 2 is a flowchart for organizing a series of operations in the image data processing device of FIG. 1 discussed above. The operation flow of FIG. 2 schematically shows process steps required to correct the present image data on a certain pixel in one motion screen into the corrected present image data, and all the other pixels are sequentially corrected through the same steps.

First, in a present image data coding step (St1), the present image data Di1 on a certain pixel in one screen is coded by the coding circuit 4 to generate the coded image data Da1.

Next, in a coded image data delaying step (St2), the present coded image data Da1 is delayed by a period which corresponds to one frame by the delay circuit 5. Therefore, at the present time, the delay circuit 5 outputs the coded image data Da0 obtained by coding the image data preceding the present image data Di1 by one frame. In this step, more specifically, the coded image data Da0 obtained by coding the image data preceding the present image data Di1 by one frame is read out from a predetermined address of the memory (or one of the memories) in the delay circuit 5 and the present coded image data Da1 is overwritten (or written concurrently with being read) into the predetermined address (or a corresponding address) of the above memory (or the other memory) as future coded image data Da0 of a point in time posterior to the present time by one frame.

Further, in a coded image data decoding step (St3), these coded image data Da1 and Da0 are decoded in synchronization with each other by the first decoder circuit 6 and the second decoder circuit 7 to generate decoded image date Db1 and Db0.

Next, in a variation-amount data calculating step (St4), the variation-amount data Dv1 is generated by the variation-amount calculation circuit 8.

Subsequently, in an one-frame preceding image reproducing step (St5), the one-frame preceding reproduced image data Dp0 is generated by the one-frame preceding image reproduction circuit 9.

Further, in a present image data correcting step (St6), the corrected present image data Dj1 corresponding to the present image data Di1 is generated by the operation of the image date correction circuit 10.

Then, the operations of the above steps St1 to St6 are performed on the present image data Di1 frame by frame.

Next, more specific constitution and function of the image date correction circuit 10 which is an essential part of the first preferred embodiment will be discussed.

The image date correction circuit 10 generally consists of (A) "at least two look-up table holding circuits" each having input ends connected to the output end of the receiver circuit 2 and the output end of the one-frame preceding image reproduction circuit 9 and an output end and (B) a "correction-amount control circuit" having input ends connected to the output ends of at least two look-up table holding circuits and the output end of the temperature control unit 12 and an output end connected to the liquid crystal display panel 11.

Then, (B) the correction-amount control circuit selects one of at least two the correction candidate present image data outputted from above at least two look-up table holding circuits on the basis of the control signal TP1 and outputs the selected correction candidate present image data as the corrected present image data Dj1 from its output end.

On the other hand, (A-1) a "first look-up table holding circuit" which is one of above at least two look-up table holding circuits holds a "first look-up table" under a first temperature (T1). The first look-up table has $2^n \times 2^n$ first corrected image data giving first candidate values each of which is obtained in advance for each combination of the first luminance value of the present image data Di1 which is an n-bit signal and the second luminance value of the one-frame preceding reproduced image data Dp1 which is also an n-bit signal so that the transmittance of the liquid crystal should reach the first transmittance which corresponds to the first luminance value within the one frame period under the temperature of the liquid crystal display panel 11 or its neighborhood atmosphere is the first temperature (T1). Then, the first look-up table holding circuit outputs first corrected image data having a first candidate value corresponding to the combination of the first luminance value of the present image data Di1 and the second luminance value of the one-frame preceding reproduced image data Dp1 out of the $2^n \times 2^n$ first corrected image data in the first look-up table as first correction candidate present image data which is one of above at least two correction candidate present image data.

Further, (A-2) a "second look-up table holding circuit" which is the other of above at least two look-up table holding circuits holds a "second look-up table" under a second temperature (T2) which is different from a first temperature (T1). The second look-up table has $2^n \times 2^n$ second corrected image data giving second candidate values each of which is obtained in advance for each combination of the first luminance value of the present image data Di1 and the second luminance value of the one-frame preceding reproduced image data Dp1 so that the transmittance of the liquid crystal should reach the first transmittance within the one frame period under the temperature of the liquid crystal display panel 11 or its neighborhood atmosphere is the second temperature (T2). Then, the second look-up table holding circuit outputs second corrected image data having a second candidate value corresponding to the combination of the first luminance value of the present image data Di1 and the second luminance value of the one-frame preceding reproduced image data Dp1 out of the $2^n \times 2^n$ second corrected image data in the second look-up table as second correction candidate present image data which is the other of above at least two correction candidate present image data.

Next, discussion will be made on the constitution and function of the image date correction circuit 10, within the above general constitution, in a case where the temperature control unit 12 has one data of reference temperature (T0) and the image date correction circuit 10 has two look-up table holding circuits. Further, it is assumed, for convenience of discussion, that n bits should be 8 bits. Naturally, an n-bit signal is not limited to an 8-bit signal but is a signal that takes any integer not less than two. In other words, the n-bit signal has only to be a signal having the number of bits which substantially allows generation of correction data through the image data operation.

Figure 3:
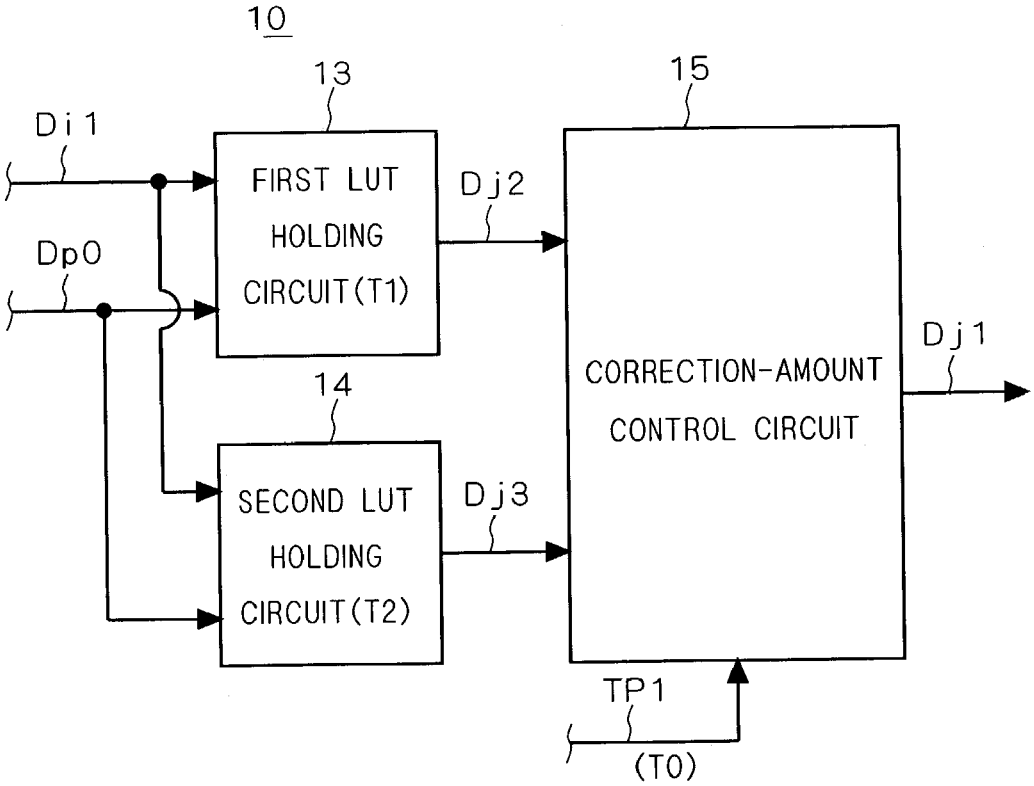
FIG. 3 is a block diagram showing an exemplary constitution of an image date correction circuit in accordance with the first preferred embodiment.

FIG. 3 is a block diagram showing an exemplary internal constitution of the image date correction circuit 10. As shown in FIG. 3, the image date correction circuit 10 consists of (1) first and second look-up table (hereinafter, referred to simply as "LUT") holding circuits 13 and 14 each having input ends connected to the output end of the receiver circuit 2 and the output end of the one-frame preceding image reproduction circuit 9 and (2) a correction-amount control circuit 15 having input ends connected to the output ends of the first and second LUT holding circuits 13 and 14. Among these circuits, the correction-amount control circuit 15 selects one of first correction candidate present image data Dj2 outputted from the first LUT holding circuit 13 and second correction candidate present image data Dj3 outputted from the second LUT holding circuit 14 in accordance with the command of the control signal TP1 and outputs the selected data as selected correction candidate present image data, i.e., corrected present image data Dj1. Therefore, the correction-amount control circuit 15 has the constitution and function as a selector.

Figure 4:
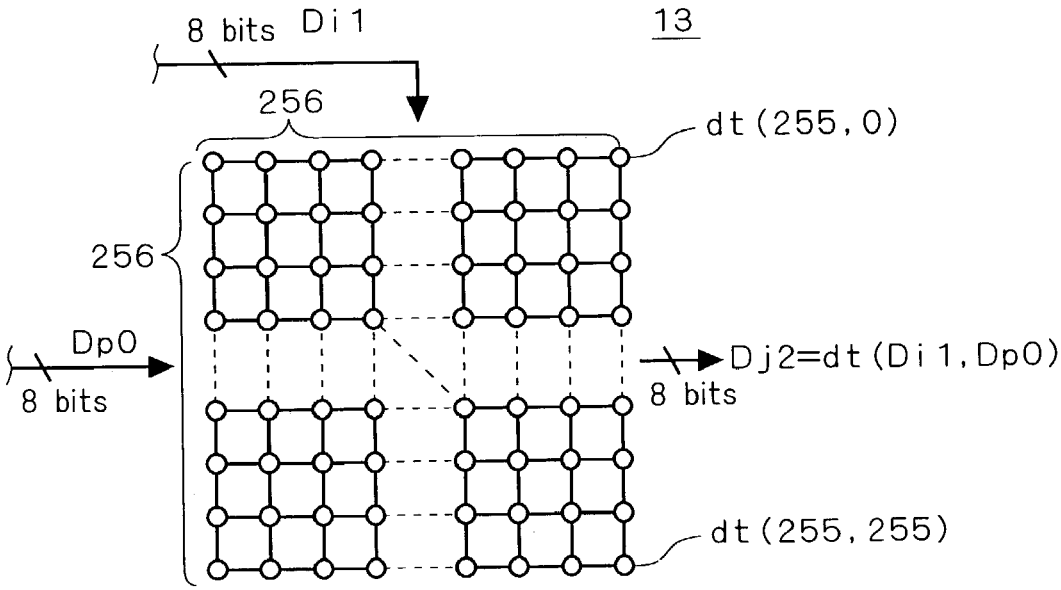
FIG. 4 is a view schematically showing the format of data held in an LUT holding circuit in accordance with the first preferred embodiment.

On the other hand, the first LUT holding circuit 13 holds or stores LUT data under a temperature not higher than the reference temperature (T0), i.e., the first temperature (T1) as a first LUT. For example, the first LUT holding circuit 13 is formed of a storage device such as a memory or a disk. The first LUT is a matrix table having 256×256 first candidate value data (first corrected image data) each of which is obtained in advance for each combination of the first luminance value indicated by the present image data Di1 which is an 8-bit signal and the second luminance value indicated by the one-frame preceding reproduced image data Dp1 which is also an 8-bit signal so that the transmittance of the liquid crystal should reach the first transmittance within the one frame period under the temperature of the liquid crystal display panel 11 or its neighborhood atmosphere is the first temperature (T1). FIG. 4 is a view schematically showing a constitution of the above first LUT having 256×256 first corrected image data. As shown in FIG. 4, the present image data Di1 and the one-frame preceding reproduced image data Dp0 are each an 8-bit image data, taking a value within a range from "0" to "255". Further, the first LUT has 256×256 first candidate value data which are two-dimensionally arranged. As a result, the first LUT holding circuit 13 outputs the first corrected image data dt (Di1, Dp0) having a first candidate value corresponding to a combination of the first luminance value of the present image data Di1 (a first input signal) and the second luminance value of the one-frame preceding reproduced image data Dp0 (a second input signal) (in other words, the first candidate value stored in a storage region (address) specified by the above combination) as the first correction candidate present image data Dj2. When the first luminance value and the second luminance value are equal to each other, in other words, when there is no change in luminance of a pixel in one screen, the first corrected image data dt (Di1, Dp0) outputted from the first LUT holding circuit 13 is data which gives the first luminance value (=the second luminance value) of the present image data Di1. In other words, the first LUT holding circuit 13 does not correct the luminance value of the present image data Di1 in this case.

Further, the second LUT holding circuit 14 holds or stores LUT data under a temperature higher than the reference temperature (T0), i.e., the second temperature (T2) as a second LUT. For example, the second LUT holding circuit 14 is formed of a storage device such as a memory or a disk. The second LUT is a matrix table having 256×256 second candidate value data (second corrected image data) each of which is obtained in advance for each combination of the first luminance value indicated by the present image data Di1 which is an 8-bit signal and the second luminance value indicated by the one-frame preceding reproduced image data Dp1 which is also an 8-bit signal so that the transmittance of the liquid crystal should reach the first transmittance within the one frame period under the temperature of the liquid crystal display panel 11 or its neighborhood atmosphere is the second temperature (T2). A construction of the above second LUT having 256×256 second corrected image data is basically the same as shown in FIG. 4. Therefore, the second LUT holding circuit 14 outputs the second corrected image data dt (Di1, Dp0) having a second candidate value corresponding to a combination of the first luminance value of the present image data Di1 (the first input signal) and the second luminance value of the one-frame preceding reproduced image data Dp0 (the second input signal) (in other words, the second candidate value stored in a storage region (address) specified by the above combination) as the second correction candidate present image data Dj3. When the first luminance value and the second luminance value are equal to each other under the second temperature (T2), in other words, when there is no change in luminance of a pixel in one screen, the second corrected image data dt (Di1, Dp0) outputted from the second LUT holding circuit 14 is data which gives the first luminance value (=the second luminance value) of the present image data Di1 under the second temperature (T2). In other words, the second LUT holding circuit 14 does not correct the luminance value of the present image data Di1 in this case.

As discussed above, the first correction candidate present image data Dj2 and the second correction candidate present image data Dj3 outputted from the first LUT holding circuit 13 and the second LUT holding circuit 14, respectively, are each candidate data of the corrected present image data Dj1 which is determined so that a portion of the liquid crystal which corresponds to a display pixel of the pixel in the inputted screen should have the transmittance (the first transmittance) corresponding to the first luminance value of the present image data Di1 within the one frame period on the basis of the first luminance value indicated by the present image data Di1 and the second luminance value indicated by the one-frame preceding reproduced image data Dp0 under the corresponding certain temperature.

Further, the correction-amount control circuit 15 of FIG. 3 selects one correction candidate data out of both candidate data Dj2 and Dj3 of the corrected present image data Dj1 on the basis of the control signal TP1 outputted from the temperature control unit 12 as the corrected present image data which is judged to be optimum under the present ambient temperature and outputs the selected corrected present image data Dj1. For example, when the temperature control unit 12 detects that the detected ambient temperature (T) is not higher than the reference temperature (T0) of the temperature control unit 12, the temperature control unit 12 outputs the control signal TP1 of the first level (for example, "1") which gives a command of selecting the first correction candidate present image data Dj2 and the correction-amount control circuit 15 selects the first correction candidate present image data Dj2 as the corrected present image data Dj1 which is optimized under the ambient temperature (T) in response to the input of the control signal TP1. On the other hand, when the temperature control unit 12 detects that the detected ambient temperature (T) is higher than the reference temperature (T0) of the temperature control unit 12, the temperature control unit 12 outputs the control signal TP1 of the second level (for example, "0") which gives a command of selecting the second correction candidate present image data Dj3 and the correction-amount control circuit 15 selects the second correction candidate present image data Dj3 as the corrected present image data Dj1 which is optimized under the ambient temperature (T) in response to the input of the control signal TP1.

When the first luminance value and the second luminance value are equal to each other, whether the correction-amount control circuit 15 selects the first correction candidate present image data Dj2 or the second correction candidate present image data Dj3, the luminance value of the selected corrected present image data Dj1 is equal to the first luminance value of the present image data Di1. Therefore, when there is no change between the luminance value indicated by the pixel data in a screen of the motion screen and the luminance value indicated by the corresponding pixel data in the next screen, whatever the ambient temperature (T) is, the image date correction circuit 10 never corrects the present image data Di1.

Next, discussion will be made on a method of obtaining or determining the corrected image data that give $2^n \times 2^n$ candidate values in the LUTs in the first LUT holding circuit 13 and the second LUT holding circuit 14 each shown in FIG. 3, with reference to aftermentioned figures. Since methods of determining the first candidate value and the second candidate value are basically the same, except that the ambient temperatures in the respective cases are different, a method of determining the first corrected present image data Dj2 that gives the first candidate value will be discussed below as a typical case, for convenience of discussion.

Figure 5:
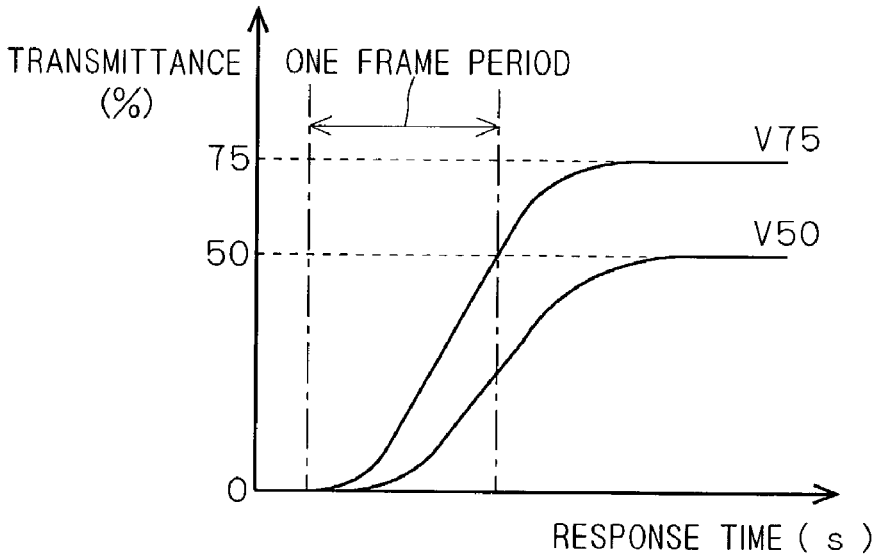
FIG. 5 is a graph showing an example of response speed of a liquid crystal in a case where there is a change in luminance of image data.

A case where the luminance (the first luminance) of the present image data Di1 is represented by information of 8 bits (0 to 255) will be discussed. In this case, when the present image data Di1=127, the transmittance of the liquid crystal for this luminance value is 50%. It is assumed that an applied voltage to achieve this transmittance of 50% is a voltage V50. When the present image data Di1=191, the transmittance of the liquid crystal for this luminance value is 75%, and it is assumed that an applied voltage to achieve this transmittance of 75% is a voltage V75. FIG. 5 is a graph showing a response speed of a liquid crystal in a case where the above voltages V50 and V75 are applied to the liquid crystal whose transmittance is 0%. As shown in FIG. 5, in both cases of the voltages V50 and V75, it takes a response time longer than the one frame period to increase the transmittance of the liquid crystal up to the predetermined transmittances (50% and 75%). Therefore, when the luminance value of the image data of a certain pixel in the inputted motion screen changes after the one frame period passes (with time), it is possible to improve the response speed of the liquid crystal by applying such a voltage as to change "the transmittance of a liquid crystal portion which forms a display pixel corresponding to the certain pixel at a point in time when the one frame period passes" into "a desired transmittance corresponding to the first luminance value indicated by the present image data Di1" to the liquid crystal portion.

Now, a case where the luminance value of the present image data Di1 changes from "0" to "127" will be discussed. In this case, as shown in FIG. 5, the transmittance of the liquid crystal at the point in time when the one frame period passes does not reach 50% when the voltage V50 is applied to the liquid crystal but the transmittance of the liquid crystal at the point in time when the one frame period passes reaches 50% when the voltage V75 is applied to the liquid crystal. Therefore, when a target transmittance is 50%, it is possible to change the transmittance of the liquid crystal to the desired transmittance within the one frame period by setting the voltage to be applied to the liquid crystal to be the voltage V75 in accordance with a change in luminance value. In other words, when the present image data Di1 changes from "0" to "127", such a voltage as to change the transmittance of the liquid crystal to the desired transmittance at the point in time when the one frame period passes from reception of the present image data Di1 by outputting the corrected present image data Dj2 of 191, which is obtained by correcting the present image data Di1, to the liquid crystal display panel 11.

Figure 6:
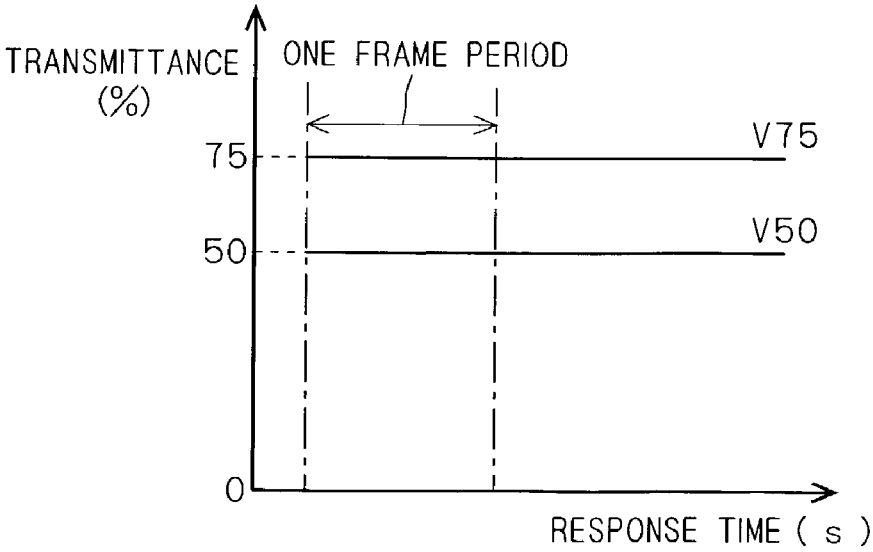
FIG. 6 is a graph showing an example of response speed of the liquid crystal in a case where there is no change in luminance of image data.

When the luminance value indicated by data of one pixel in a certain screen does not change after the next one frame period passes, since a liquid crystal portion which forms a display pixel corresponding to the pixel already has a transmittance which can achieve the luminance value, the response speed of the liquid crystal does not change and the amount of correction is zero. This point is shown in a graph of FIG. 6 showing the response speed.

Figure 7:
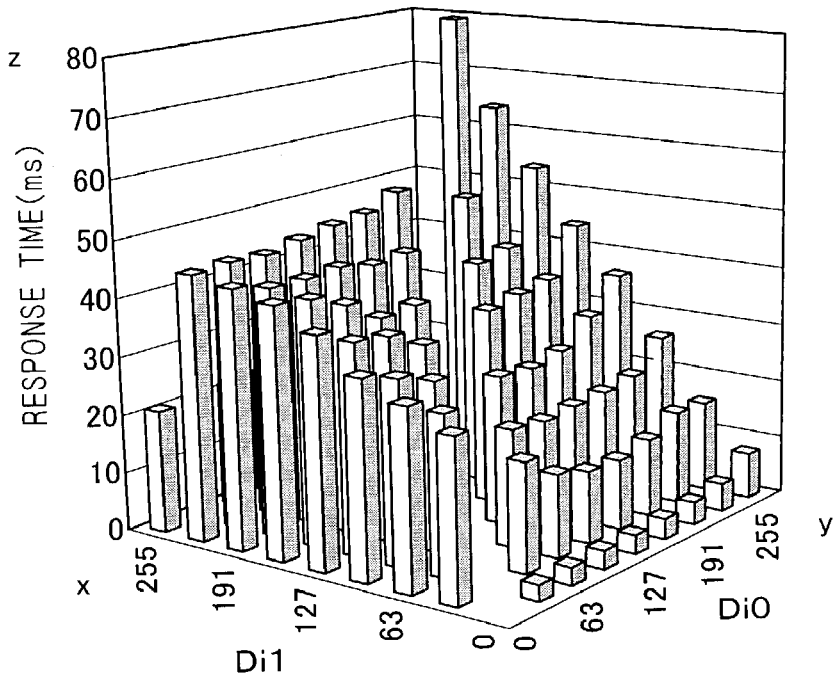
FIG. 7 is a view showing an example of response speed of the liquid crystal.

FIG. 7 is a view showing an example of response speed of the liquid crystal. In FIG. 7, the x axis indicates the value of the present image data Di1 (the luminance value of the present image), the y axis indicates the value of image data preceding the present image data Di1 by one frame (the luminance value of the one-frame preceding image) and the z axis indicates the response time required to change the transmittance of the liquid crystal from that corresponding to the one-frame preceding luminance value to that corresponding to the luminance value of the present image data Di1. When a luminance value of an image is represented by 8 bits, since there are 256×256 combinations of the luminance values of the present image and the luminance values of the one-frame preceding images, the response speed of the liquid crystal may have 256×256 values. FIG. 7, for convenience of illustration, simply shows 8×8 response speeds corresponding to the combinations of luminance values.

Figure 8:
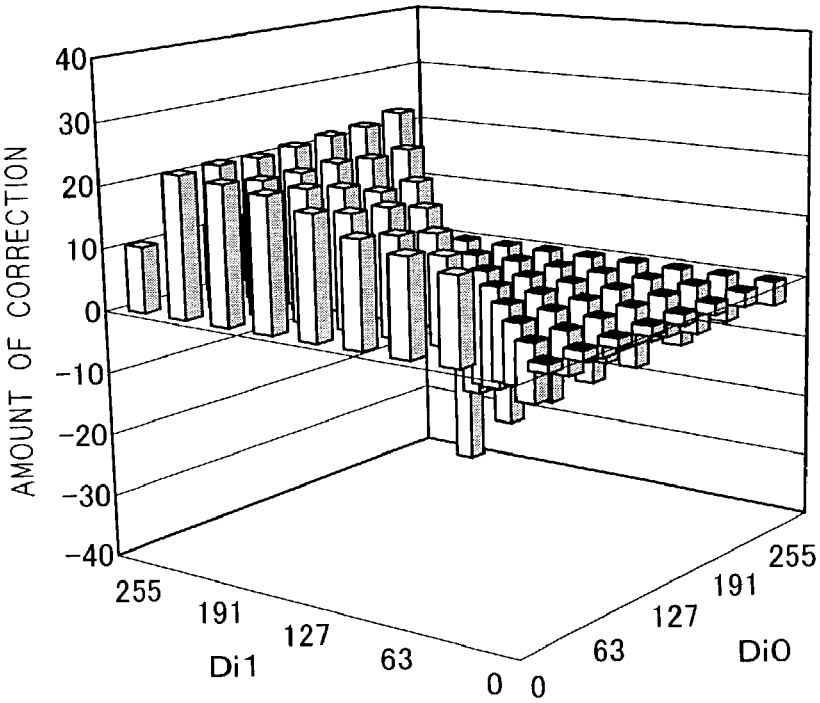
FIG. 8 is a view showing an example of amount of correction.

FIG. 8 is a view showing the amount of correction (the amount of luminance correction: 8-bit value) for the present image data Di1 required to change the transmittance of the liquid crystal to the transmittance corresponding to the luminance value of the present image data Di1 at a point in time when the one frame period passes. When the luminance value of the present image data Di1 is represented by 8 bits, there are 256×256 amounts of correction correspondingly to the combinations of the luminance value of the present image and the luminance value of the one-frame preceding image. FIG. 8 also simply shows 8×8 amounts of correction, for convenience of illustration.

Figure 9:
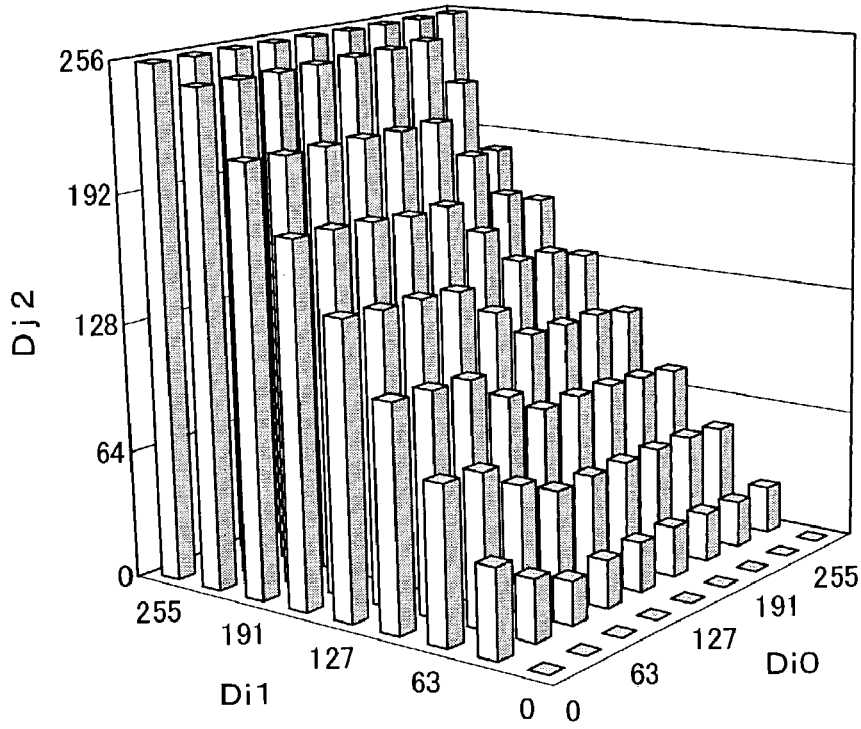
FIG. 9 is a view showing an example of correction candidate present image data.

As shown in FIG. 7, since the response speed of the liquid crystal varies by the combination of the luminance value of the present image and the luminance value of the one-frame preceding image and depends on a material of the liquid crystal, a shape of the driving electrode and the like, it is impossible to obtain the amount of correction for the image data which is required to increase the response speed of the liquid crystal in accordance with variation in luminance value, by using a simple equation. Though it is difficult to determine such an equation, however, it is possible to make corrected image data as shown in FIG. 9. Specifically, the corrected image data Dj2 of FIG. 9 can be obtained by adding 256×256 amounts of correction shown in FIG. 8 to the present image, data Di1 correspondingly to the respective luminance values of the one-frame preceding image data Di0. Then, the corrected image data Dj2 of FIG. 9 which are obtained by sequentially performing the above addition using data of FIG. 8 which are actually obtained under a certain temperature (the first temperature T1) with respect to a liquid crystal used in the liquid crystal display panel 11 of FIG. 1 are stored in the first LUT holding circuit 13 of FIG. 3 as 256×256 first candidate value data. At this time, the first corrected image data Dj2 are so determined as not to exceed a displayable range of luminance value in the liquid crystal display panel 11.

Thus, since the first LUT data are made by using the correction-amount data which are actually obtained under a certain temperature (the first temperature T1), it is possible to construct the first LUT holding circuit 13 having the first corrected image data Dj2 which respond to the use conditions such as the material of the liquid crystal and the shape of the driving electrode, and further possible to control the response speed in accordance with the characteristics of the liquid crystal.

Further, in FIG. 8, the amounts of correction are so determined as to become relatively large with respect to the tone change where the response speed of the liquid crystal is relatively low. Specifically, the response speed of the liquid crystal generally differs by the tone, and for example, the response speed of the liquid crystal is relatively high with respect to the tone change from white to black and it is relatively low with respect to the tone change from dark gray to bright gray. Therefore, the amounts of correction are so determined as to be relatively small with respect to the tone change where the response speed of the liquid crystal is relatively high and as to be relatively large with respect to the tone change where the response speed of the liquid crystal is relatively low. In particular, the response speed in a tone change from intermediate intensity of luminance (gray) to high intensity of luminance (white) is low. Therefore, in determining the amount of correction of FIG. 8, the response speed of the liquid crystal can be effectively improved by setting the amount of change in tone corresponding to the difference between the one-frame preceding reproduced image data Dp0 representing intermediate intensity of luminance and the present image data Di1 representing high intensity of luminance to be larger in a positive direction (in the case of tone change from gray to white) or in a negative direction (in the case of tone change from white to gray), and accordingly an appropriate and reliable improvement in response speed is possible even in a case of luminance change (tone change) where the response speed of the liquid crystal becomes especially low.

Further, since the response characteristics of the liquid crystal vary with temperature of the liquid crystal, as discussed above, such correction data as to effectively improve the response speed of the liquid crystal under the second temperature (T2 (>T1)), which is different from the case of the first LUT, is written in the second LUT holding circuit 14 of FIG. 3 as the second LUT data.

Figure 10:
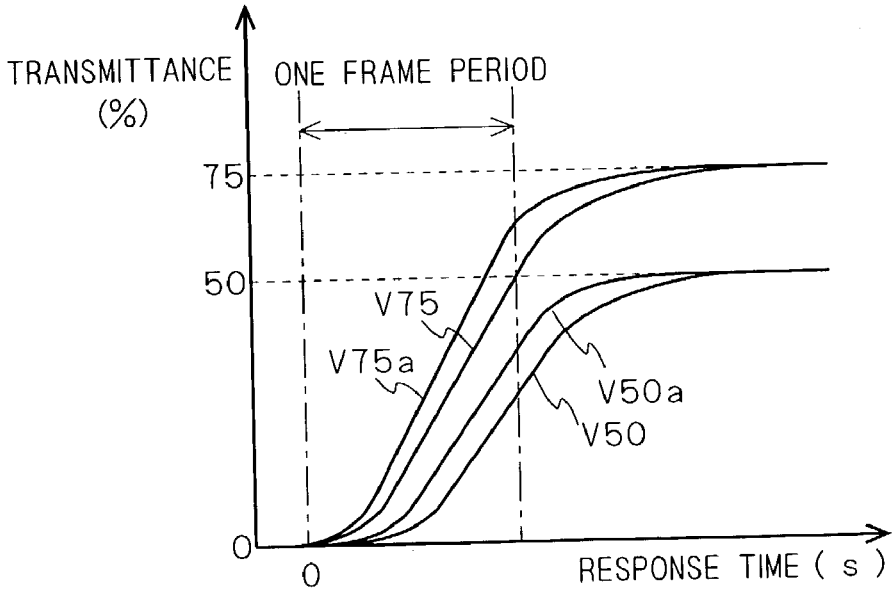
FIG. 10 is a graph showing an example of response speed of the liquid crystal in a case where there is a change in luminance of image data.
Figure 11:
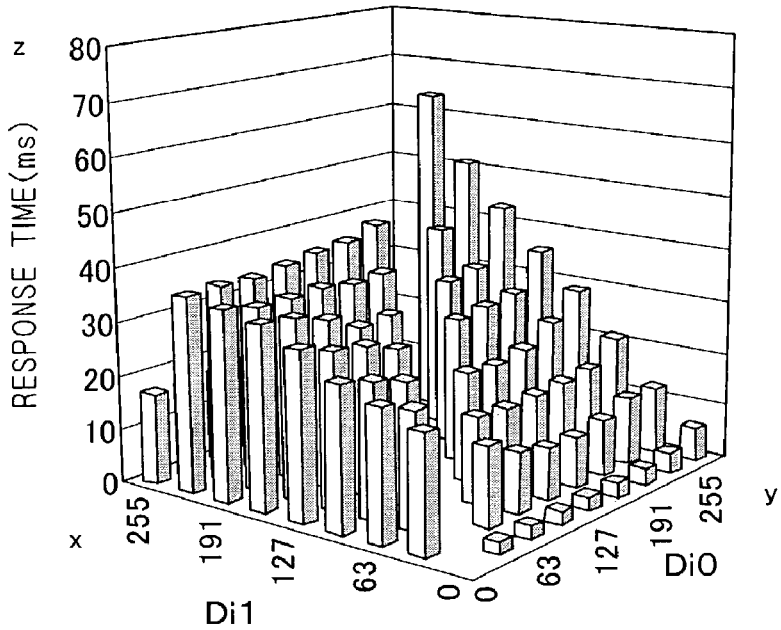
FIG. 11 is a view showing an example of response speed of the liquid crystal.
Figure 12:
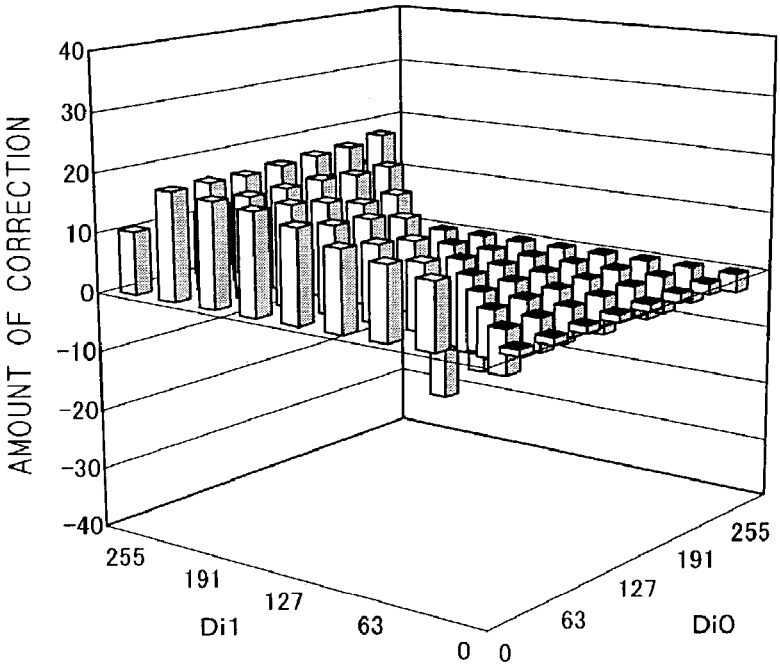
FIG. 12 is a view showing an example of amount of correction.
Figure 13:
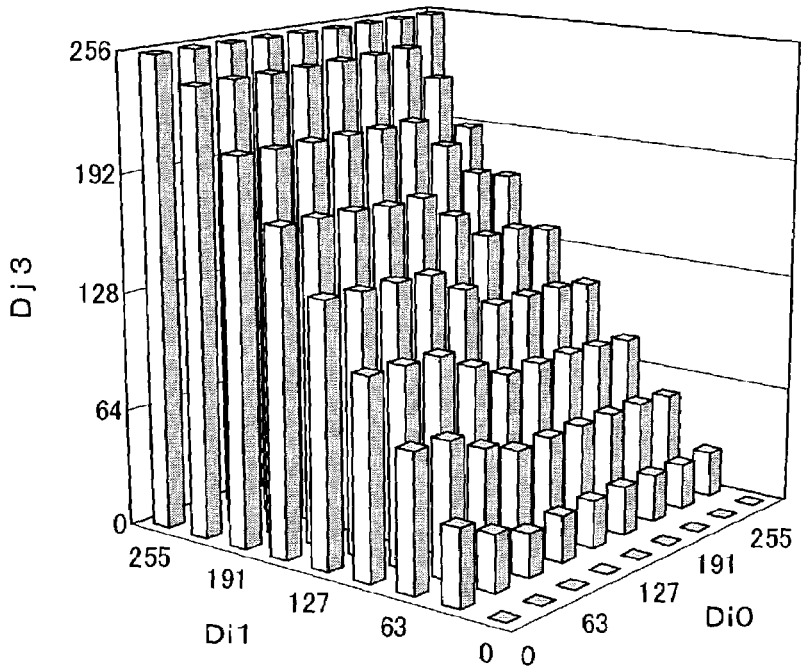
FIG. 13 is a view showing an example of correction candidate present image data.

FIGS. 10 to 13 are views showing examples of response speed, amount of correction and corrected image data under the second temperature (T2) different from the first temperature (T1) under which the response speed, the amount of correction and the corrected image data of the liquid crystal are shown in FIGS. 5, 7, 8 and 9. In FIG. 10, the voltages V50 and V75 correspond to the voltages V50 and V75 of FIG. 5, which are shown for reference. As shown in FIG. 10, since the response speed of the liquid crystal under the second temperature (T2) which is higher than the first temperature (T1) becomes higher than that under the first temperature (T1), the applied voltage required to achieve the target transmittance 50% at the point in time when the one frame period passes is set to be a value smaller than a voltage V75*a* and larger than a voltage V50*a*. Since conditions other than the ambient temperature in FIGS. 10 to 13 are the same as those in FIGS. 5, 7, 8 and 9, detailed discussion thereof is omitted.

Figure 14A:
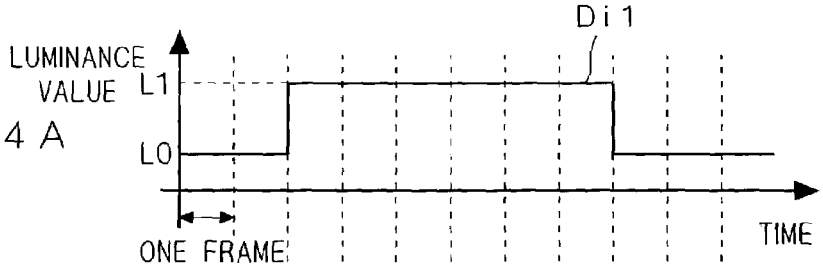
FIGS. 14A to 14C are timing charts schematically showing a relation among present image data, corrected present image data and display luminance.
Figure 14B:
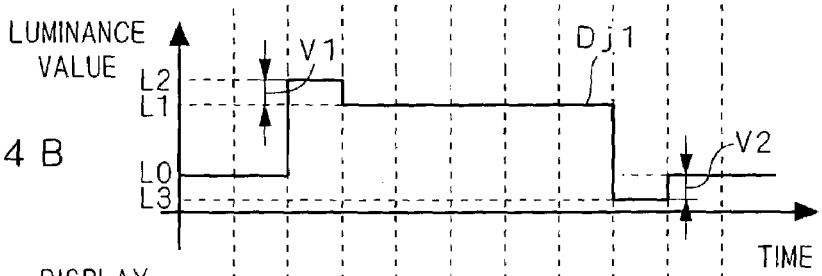
Figure 14C:
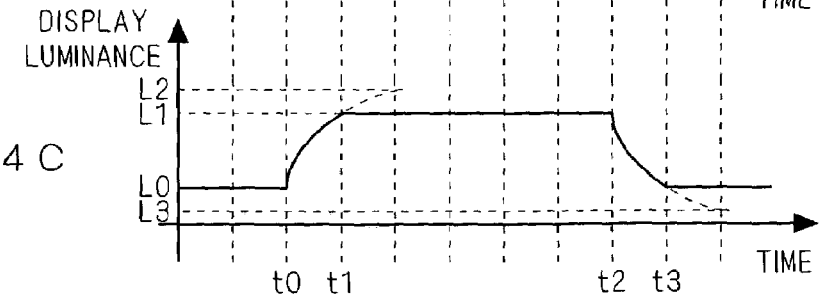

FIGS. 14A, 14B and 14C are timing charts showing a main point of an image data processing method in accordance with the first preferred embodiment. Specifically, FIG. 14A shows the present image data Di1 whose luminance value changes from L0 to a brighter value L1 at the time t0 and after that, does not change immediately before the time t2. FIG. 14B shows the luminance value of the corrected present image data Dj1. FIG. 14C shows variation in display luminance in a case where a voltage based on the corrected present image data Dj1 is applied to the liquid crystal.

The luminance value of the corrected present image data Dj1 changes from the value L0 to a still brighter value L2 (>L1) at the time t0 and decreases to the value L1 at the time t1 when the one frame period passes. Through this setting of the corrected present image data Dj1, the response speed of the liquid crystal becomes higher than that in the case where a voltage which corresponds to the present image data Di1 is applied to the liquid crystal only within the one frame period from the time t0 to the time t1 and the transmittance of the liquid crystal reliably reaches a value to surely achieve the display luminance L1 at the time t1. Then, since it is not necessary to increase the response speed of the liquid crystal within a period from the time t1 to the time t2, the luminance value of the corrected present image data Dj1 keeps the level of L1 during that period. Also in a case where the luminance value of the present image data Di1 returns to the value L0 at the time t2, since it is necessary to achieve a still higher response speed, the luminance value of the corrected present image data Dj1 changes from the value L1 to a value L3 darker than the value L0 and after that, keeps the level of L3 during the one frame period until the time t3. Through this operation, the display luminance surely reaches the value L0 at the time t3 when the one frame period passes.

The change in display luminance indicated by a broken line of FIG. 14C is that in a case where the present image data Di1 is continuously corrected by the amounts of correction V1 and V2 also after the time t1 and after the time t3, respectively.

Next, discussion will be made on an effect of error which occurs in the coding and decoding operations by the image data processing unit 3 of FIG. 1 on the corrected image data Dj1.

FIG. 15D is a view schematically showing values of the present image data Di1 representing the present image and FIG. 15A is a view schematically showing values of the image data Di0 representing an image preceding the present image by one frame. As shown in FIGS. 15D and 15A, there is no change between the respective present image data Di1 and the corresponding one-frame preceding image data Di0.

On the other hand, FIGS. 15E and 15B are views schematically showing coded image data corresponding to the present image data Di1 of FIG. 15D and the one-frame preceding image data Di0 of FIG. 15A, respectively. FIGS. 15E and 15B each show coded image data obtained by FBTC, where typical values (La, Lb) are represented as 8-bit data and 1-bit data is allocated to each pixel.

FIGS. 15F and 15C show the first decoded image data Db1 and the second decoded image data Db0 which are obtained by decoding the coded image data of FIGS. 15E and 15B, respectively.

FIG. 15G shows values of the variation-amount data Dv1 generated on the basis of the decoded image date Db1 and Db0 of FIGS. 15F and 15C, and FIG. 15H shows values of the reproduced one-frame preceding image data Dp0 outputted from the one-frame preceding image reproduction circuit 9 of FIG. 1 to the image data correction circuit 10.

As shown in FIGS. 15D, 15F, 15A and 15C, there are errors in these decoded image date Db1 and Db0 which are caused by the coding and decoding operations. By generating the variation-amount data Dv1 on the basis of these decoded image date Db1 and Db0 shown in FIGS. 15F and 15C, however, the values of the variation-amount data Dv1 are all zero as shown in FIG. 15G. Therefore, as shown in FIG. 15H, the one-frame preceding reproduced image data Dp0 can become data which is obtained by faithfully reproducing the one-frame preceding image data Di0 of FIG. 15A without any effect of the error caused by the coding and decoding operations. Thus, it is understood that the one-frame preceding reproduced image data which is finally obtained is not affected by the error due to the coding and decoding operations.

On the other hand, since the present image data Di1 inputted to the image date correction circuit 10 of FIG. 1 is not coded, the image date correction circuit 10 can output the accurate corrected image data Dj1 to the liquid crystal display panel 11 on the basis of the present image data Di1 and the one-frame preceding reproduced image data Dp0 which is accurately reproduced without any effect of the error.

While the above discussion is made on the case where the image date correction circuit 10 has two LUT holding circuits 13 and 14 shown in FIG. 3, it is clear that the image date correction circuit 10 is not limited to the above-discussed constitution. Specifically, there may be a case where three or more LUT holding circuits are provided in the image date correction circuit 10 and the correction-amount control circuit 15 appropriately switches among these LUT holding circuits in accordance with the level of the control signal TP1 which gives the result of comparison between the ambient temperature and the reference temperature. In this case, it is possible to more accurately and appropriately control the amount of correction for the image data under the respective ambient temperatures as the number of LUT holding circuits and reference temperatures increase. Such variations will be discussed below.

Figure 16:
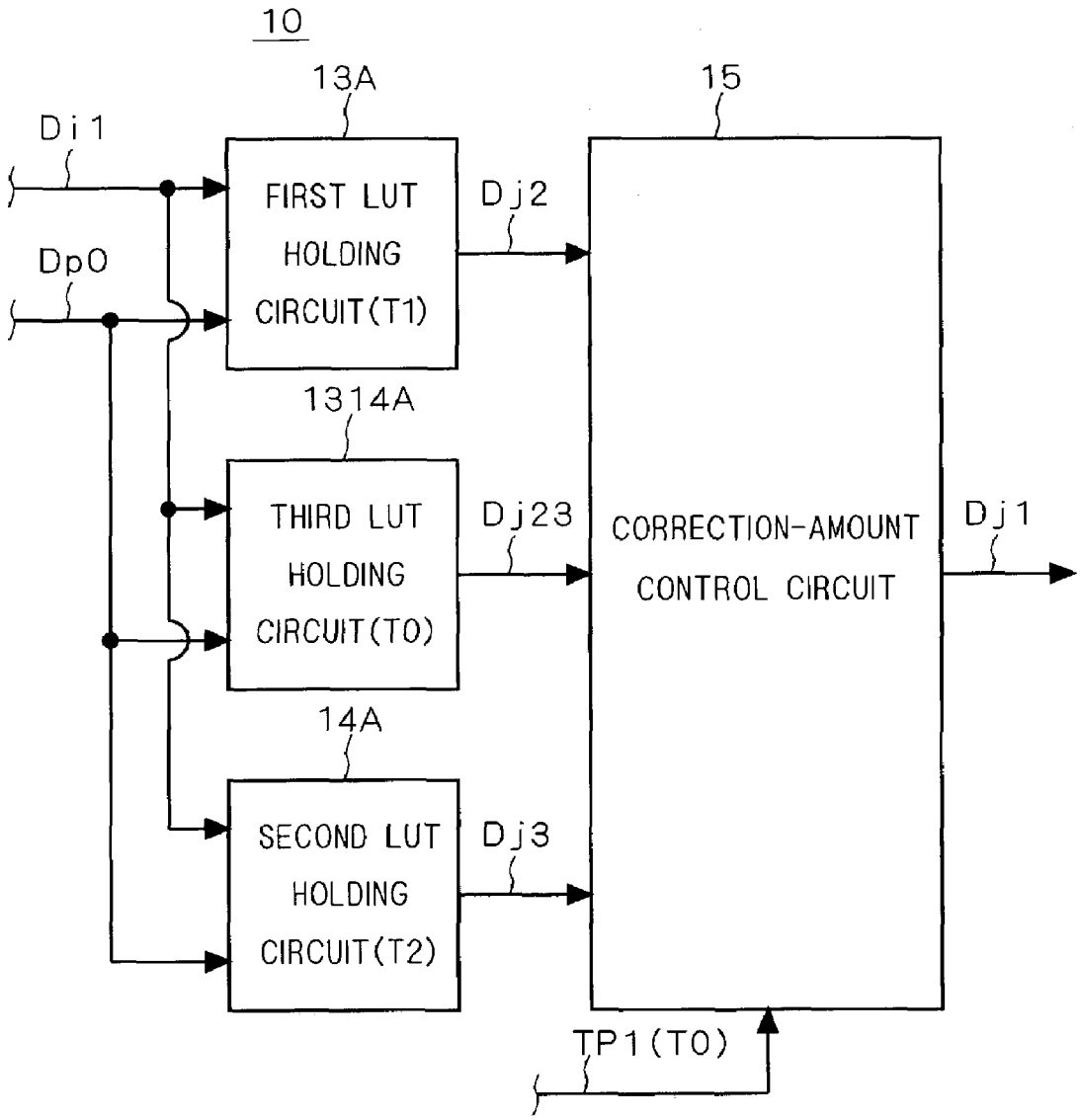
FIG. 16 is a block diagram showing another exemplary constitution of the image date correction circuit in accordance with the first preferred embodiment.

FIG. 16 is a block diagram showing another constitution of the image date correction circuit 10 in a case where the temperature control unit 12 has one data of reference temperature (T0) and three LUT holding circuits 13A, 1314A and 14A are provided. Among these constituent elements, the first LUT holding circuit 13A and the second LUT holding circuit 14A correspond to the first LUT holding circuit 13 and the second LUT holding circuit 14 of FIG. 3, respectively and the third LUT holding circuit 1314A holds the third LUT consisting of 256×256 third candidate value data under an ambient temperature equal to the reference temperature (T0) of the temperature control unit 12 in its storage portion. The correction-amount control circuit 15 (A) selects the first correction candidate present image data Dj2 when the control signal TP1 has a level indicating T<T0, (B) selects third correction candidate present image data Dj23 when the control signal TP1 has a level indicating T=T0 and (C) selects the second correction candidate present image data Dj3 when the control signal TP1 has a level indicating T>T0.

Figure 17:
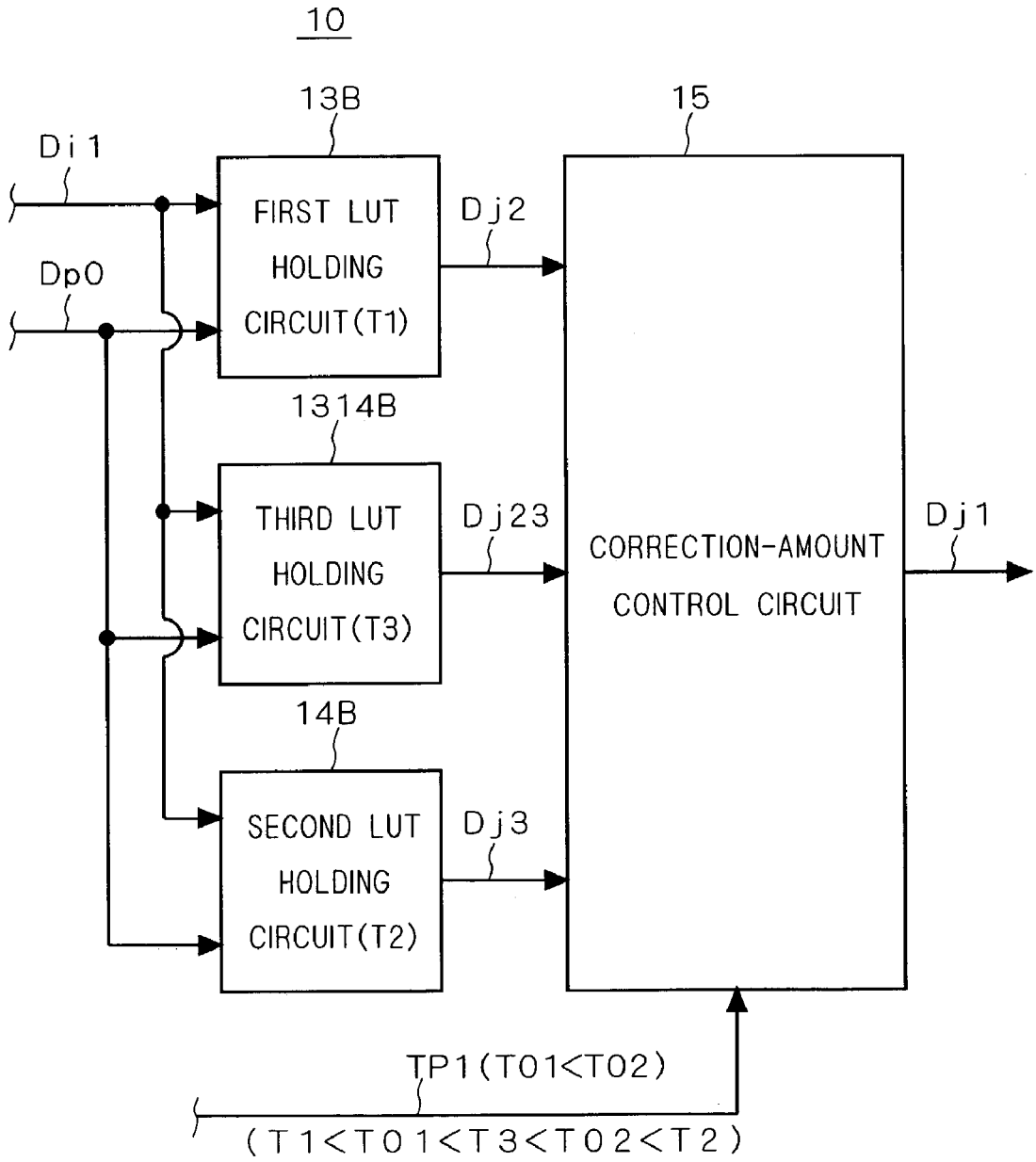
FIG. 17 is a block diagram showing still another exemplary constitution of the image date correction circuit in accordance with the first preferred embodiment.

Next, FIG. 17 is a block diagram showing still another constitution of the image date correction circuit 10 in a case where the temperature control unit 12 has two data of reference temperatures (T01, T02 (>T01)) and three LUT holding circuits 13B, 1314B and 14B are provided. Among these constituent elements, the first LUT holding circuit 13B and the second LUT holding circuit 14B correspond to the first LUT holding circuit 13 and the second LUT holding circuit 14 of FIG. 3, respectively, and a relation of temperatures T1<T01<T3<T02<T2 is true. Further, the third LUT holding circuit 1314B holds the third LUT consisting of 256×256 third candidate value data under a third temperature higher than the first reference temperature (T01) of the temperature control unit 12 and lower than the second reference temperature (T02) in its storage portion. The correction-amount control circuit 15 (A) selects the first correction candidate present image data Dj2 when the control signal TP1 has a level indicating T<T01, (B) selects the third correction candidate present image data Dj23 when the control signal TP1 has a level indicating T01<T<T02 and (C) selects the second correction candidate present image data Dj3 when the control signal TP1 has a level indicating T>T02. Thus, as the number of reference temperatures and the number of LUT holding circuits each become larger than those of FIG. 3, it is possible to further accurately correct the present image data Di1.

The first preferred embodiment produces the following effects.

(I) Since the present image data Di1 is coded by the coding circuit 4 to compress the amount of data and then the compressed present image data is stored in the memory of the delay circuit 5 during the one frame period, it is possible to remarkably reduce the memory capacity required to delay the present image data Di1 by the one frame period. Moreover, since the present image data Di1 is coded and decoded without skipping the pixel information thereof, it is possible to generate the correction candidate present image data of accurate values under a certain ambient temperature.

Since the LUT holding circuits in the image date correction circuit 10 generate the respective correction candidate present image data under the respective ambient temperatures on the basis of the present image data Di1 and the one-frame preceding reproduced image data Dp0, the correction candidate present image data is not affected by the error which is caused by the coding and decoding operations.

(III) Since the image date correction circuit 10 selects the optimum correction candidate present image data out of a plurality of correction candidate present image data as the corrected present image data Dj1 in accordance with the command of the control signal TP1 which gives information on the ambient temperature in generating the corrected present image data Dj1, it is possible to accurately correct the present image data Di1 and always accurately control the response speed of the liquid crystal even if the ambient temperature changes.

The Second Preferred Embodiment

The second preferred embodiment proposes a variation of the image date correction circuit 10 of the first preferred embodiment shown in FIG. 1 and there is no change in other constituent elements of the liquid crystal display device of FIG. 1. Therefore, also in the following discussion of the second preferred embodiment, the circuit constitution of FIG. 1 is used.

The characteristic feature of the second preferred embodiment lies in the following points. Specifically, in the second preferred embodiment, the temperature control unit 12 has one data of reference temperature T0 and the image date correction circuit (1) has an LUT holding circuit which has input ends connected to the output end of the receiver circuit 2 and the output end of the one-frame preceding image reproduction circuit 9 and an output end and further holds LUT data under a predetermined temperature T1 equal to the above reference temperature T0, (2) calculates the correction-amount data through subtraction using the corrected image data outputted from the LUT holding circuit and the present image data Di1, (3) generates new correction-amount data by correcting the above correction-amount data in accordance with the command of the control signal TP1 and (4) generates the corrected present image data Dj1 through addition using the present image data Di1 and the new correction-amount data. The characteristic feature will be discussed in detail with reference to figures.

Figure 18:
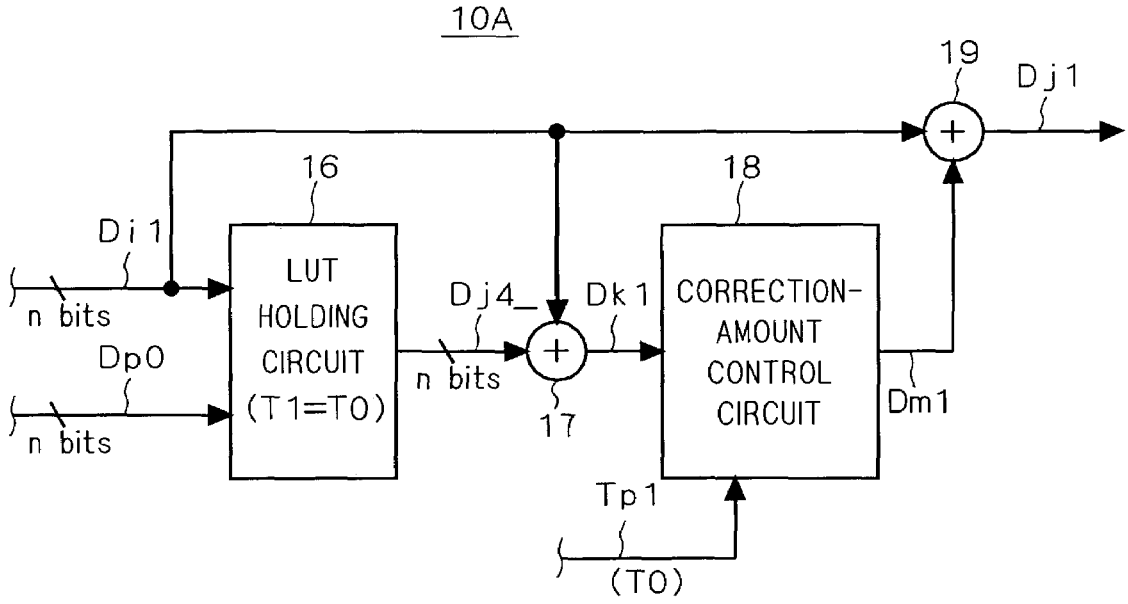
FIG. 18 is a block diagram showing an exemplary constitution of an image date correction circuit in accordance with a second preferred embodiment.

FIG. 18 is a block diagram showing an exemplary constitution of an image date correction circuit 10A in accordance with the second preferred embodiment. An LUT holding circuit 16 holds an LUT under the reference temperature T0 (=T1). The LUT has "$2^n \times 2^n$" corrected image data giving candidate values each of which is obtained in advance for each combination of the first luminance value of the present image data Di1 which is an n-bit signal and the second luminance value of the one-frame preceding reproduced image data Dp0 which is also an n-bit signal so that the transmittance of the liquid crystal should become the first transmittance which corresponds to the first luminance value of the present image data Di1 within the one frame period under the temperature (ambient temperature) of the liquid crystal display panel 11 or its neighborhood atmosphere is the reference temperature T0". Data on a right-downward diagonal of this LUT, that is, the candidate value data in a case where the first luminance value and the second luminance value are equal to each other and there is no luminance change is the first luminance value (in other words, no correction). A method of obtaining the LUT data is the same as discussed in the first preferred embodiment.

A subtractor circuit 17 has a first input end connected to the output end of the receiver circuit 2, a second input end connected to the output end of the LUT holding circuit 16 and an output end.

A correction-amount control circuit 18 has a first input end connected to the output end of the subtractor circuit 17, a second input end connected to the output end of the temperature control unit 12 and an output end.

Further, a adder circuit 19 has a first input end connected to the output end of the receiver circuit 2, a second input end connected to the output end of the correction-amount control circuit 18 and an output end connected to the liquid crystal display panel 11.

Next, a present image data correction function of the image date correction circuit 10A will be discussed. Since operations of constituent elements other than the image date correction circuit 10A are the same as those of corresponding elements in the first preferred embodiment, discussion thereof is omitted.

The LUT holding circuit 16 stores $2^n \times 2^n$ candidate value data or corrected image data under the temperature T1 (=T0) which is determined in advance in its storage region as LUT data. Then the LUT holding circuit 16 outputs corrected image data (n-bit signal) having a candidate value corresponding to the combination of the first luminance value of the inputted present image data Di1 and the second luminance value of the inputted one-frame preceding reproduced image data Dp0 (in other words, which is stored at an address specified by the combination) out of the $2^n \times 2^n$ corrected image data in the LUT as the correction candidate present image data Dj4.

After that, the subtractor circuit 17 subtracts the present image data Di1 from the correction candidate present image data Dj4 outputted from the LUT holding circuit 16 to determine and output the correction-amount data Dk1 with respect to the present image data Di1.

Next, the correction-amount control circuit 18 (A) outputs output data Dk1 from the subtractor circuit 17 when the output data Dk1 from the subtractor circuit 17 indicate zero, and (B) generates correction-amount data Dm1 which corresponds to the difference between the corrected luminance value and the first luminance value on the basis of the output data from the subtractor circuit 17 and the control signal TP1 and outputs the correction-amount data Dm1 from its output end when the output data from the subtractor circuit 17 is not zero.

More specific discussion on the above function (B) is as follows. The correction-amount control circuit 18 so corrects (controls) the correction-amount data Dk1 as to be an appropriate value on the basis of the control signal TP1 outputted from the temperature control unit 12 and generates and outputs the new correction-amount data Dm1. A correction method for this case is as follows.

(B-1) The first control: when the detected ambient temperature T is higher than the above reference temperature T0 (=T1), the temperature control unit 12 outputs the control signal TP1 having a first level indicating this condition to the correction-amount control circuit 18, and the correction-amount control circuit 18 so controls the value of the correction-amount data Dk1 as to become smaller in accordance with the command of the control signal TP1. As a correction method for this case, the new correction-amount data Dm1 may be generated by utilizing the equation with a positive constant $\alpha$, $Dm1=Dk1-\alpha$, or the new correction-amount data Dm1 may be generated by utilizing the equation, $Dm1=Dk1+\alpha\times(T0-T)$.

(B-2) The second control: when the ambient temperature T is lower than the above reference temperature T0 (=T1), the temperature control unit 12 outputs the control signal TP1 having a second level indicating this condition to the correction-amount control circuit 18, and the correction-amount control circuit 18 so controls the value of the correction-amount data Dk1 as to become larger in accordance with the command of the control signal TP1. As a correction method for this case, the new correction-amount data Dm1 may be generated by utilizing the equation with the positive constant $\alpha$, $Dm1=Dk1+\alpha$, or the new correction-amount data Dm1 may be generated by utilizing the equation, $Dm1=Dk1+\alpha\times(T0-T)$.

Naturally, the correction-amount control circuit 18 may generate and output the new correction-amount data Dm1 through either the first control (B-1) in the case of high ambient temperature or the second control (B-2) in the case of low ambient temperature.

(B-3) The third control: when the ambient temperature T is equal to the above reference temperature T0 (=T1) (e.g., room temperature), the temperature control unit 12 outputs the control signal TP1 having a third level indicating this condition to the correction-amount control circuit 18, and the correction-amount control circuit 18 outputs the value of the inputted correction-amount data Dk1 as the new correction-amount data Dm1 in accordance with the command of the control signal TP1. In other words, in this case, the correction-amount control circuit 18 does not correct the correction-amount data Dk1.

Finally, the adder circuit 19 adds the new correction-amount data Dm1 to the present image data Di1 to output the data obtained by this addition to the liquid crystal display panel 11 as the corrected present image data Dj1.

The second preferred embodiment also produces the same effect as discussed in the effect (III) in the first preferred embodiment.

The First Variation of the Second Preferred Embodiment

The first variation of the second preferred embodiment has a characteristic feature in change of the LUT holding circuit 16 of the second preferred embodiment, and there is no change in other constituent elements of FIG. 18. The characteristic feature of the present variation will be discussed in detail with reference to figures.

Figure 19:
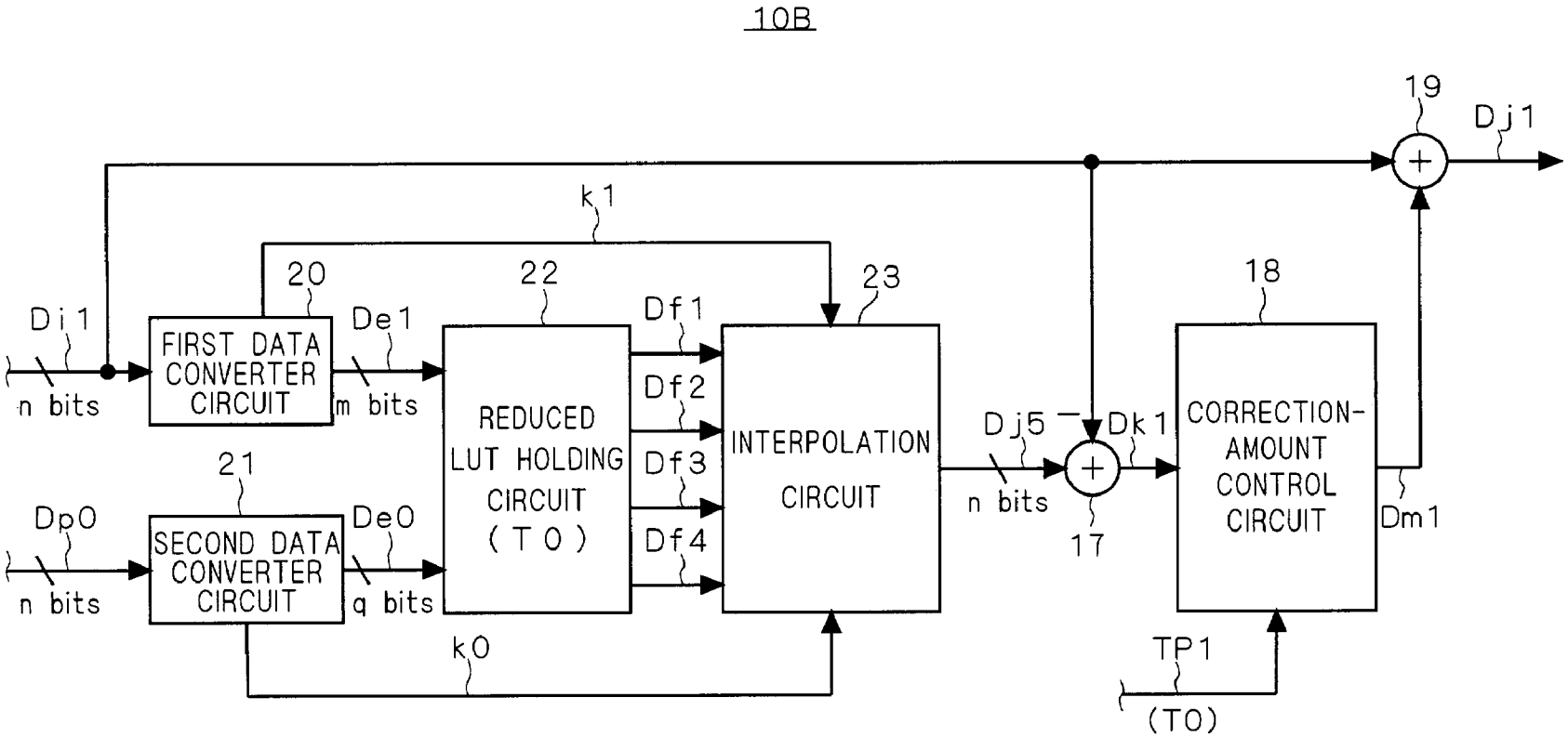
FIG. 19 is a block diagram showing an exemplary constitution of an image date correction circuit in accordance with a first variation of the second preferred embodiment.

FIG. 19 is a block diagram showing an exemplary constitution of an image date correction circuit 10B in accordance with the first variation of the second preferred embodiment. Constituent elements in FIG. 19 identical to those of FIG. 18 are represented by the same reference signs. In FIG. 19, a first data converter circuit 20 reduces the number n of bits of the inputted present image data Di1 to m (m<n) through a quantizing operation such as linear quantization or non-linear quantization. Similarly, a second data converter circuit 21 reduces the number n of bits of the inputted one-frame preceding reproduced image data Dp0 to q (q<n) through a quantizing operation such as linear quantization or non-linear quantization. A reduced LUT holding circuit 22 holds reduced LUT data under the reference temperature T0 which is determined in advance in accordance with the same method as the determining method of the first preferred embodiment in its storage portion. This reduced LUT consists of $(2^m+1)\times(2^q+1)$ corrected image data which give candidate values. Each of the candidate values is obtained for each combination of a luminance value of the reduced present image data De1 which is an m-bit signal and a luminance value of the reduced one-frame preceding reproduced image data De0 which is a q-bit signal so that the transmittance of the liquid crystal should become the first transmittance corresponding to the first luminance value of the present image data Di1 within the one frame period under a condition that the temperature (ambient temperature) T of the liquid crystal display panel 11 or its neighborhood atmosphere is the reference temperature T0. Also in this case, when the luminance value of the reduced present image data De1 and the luminance value of the reduced one-frame preceding reproduced image data De0 are equal to each other, no correction is needed, and the candidate value data on a right-downward diagonal of the reduced LUT are equal to the luminance value of the reduced present image data De1. Then, the reduced LUT holding circuit 22 outputs the candidate value data corresponding to the combination of the luminance values of these data De1 and De0 and three adjacent candidate value data which are adjacent to the above candidate value data in accordance with the inputted data De1 and De0. An interpolation circuit 23 performs an interpolating operation on the inputted four reduced corrected image data on the basis of two interpolation coefficients to generate n-bit correction candidate present image data Dj5 corresponding to the data Dj4 of FIG. 18. An operation of the image date correction circuit 10B of FIG. 19 will be discussed below on a case where n=8 and m=q=3, for convenience of discussion.

The first data converter circuit 20 and the second data converter circuit 21 reduce the respective numbers of quantized bits of the present image data Di1 and the one-frame preceding reproduced image data Dp0, from 8 bits to 3 bits, and generate and output the reduced present image data De1 and the reduced one-frame preceding reproduced image data De0, respectively. At the same time, the first data converter circuit 20 and the second data converter circuit 21 calculate a first interpolation coefficient ko and a second interpolation coefficient k1, respectively, and output signals which give these interpolation coefficients to the interpolation circuit 23.

The reduced LUT holding circuit 22 outputs four corrected image data Df1 to Df4 in accordance with input timing of the 3-bit present image data De1 and the 3-bit one-frame preceding reproduced image data De0.

The interpolation circuit 23 generates and outputs the 8-bit correction candidate present image data Dj5 which is interpolated on the basis of the corrected image data Df1 to Df4 and the interpolation coefficients k0 and k1.

Figure 20:
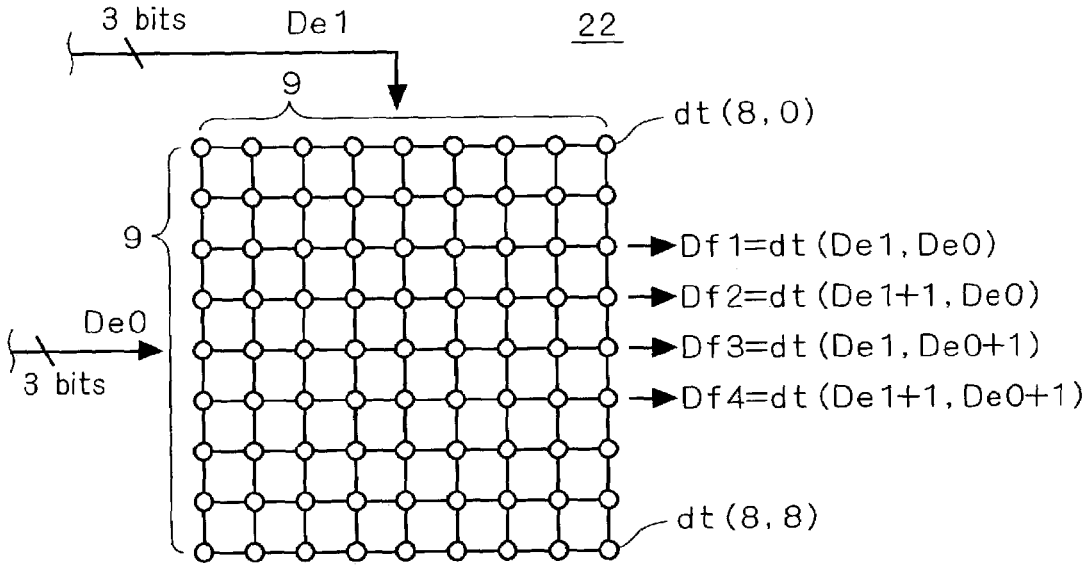
FIG. 20 is a view schematically showing the format of data held in a reduced LUT holding circuit.

FIG. 20 is a view schematically showing a construction of an LUT in the reduced LUT holding circuit 22 of FIG. 19. In this case, the present image data De1 after conversion in number of bits and the one-frame preceding reproduced image data De0 after conversion in number of bits are each 3 bits, taking a value in a range from 0 to 7. As shown in FIG. 20, the reduced LUT consists of 9×9 candidate value data which are two-dimensionally arranged, and the reduced LUT holding circuit 22 outputs the corrected image data dt (De1, De0) stored at an address corresponding to the luminance value of the 3-bit present image data De1 and the luminance value of the 3-bit one-frame preceding reproduced image data De0 as the first corrected image data Df1 which gives the first candidate value and further outputs three corrected image data dt (De1+1, De0), dt (De1, De0+1) and dt (De1+1, De0+1) which are adjacent to the first corrected image data Df1 as the second corrected image data Df2, the third corrected image data Df3 and the fourth corrected image data Df4, respectively.

Next, the interpolating operation of the interpolation circuit 23 will be discussed in detail.

The interpolation circuit 23 generates the corrected image data (correction candidate present image data) Dj5 which is interpolated from the following equation (1) using the first to fourth corrected image data Df1 to Df4 and the first and second interpolation coefficients k1 and k0;

$$Dj5 = (1-k0)\times\{(1-k1)\times Df1 + k1\times Df2\} + k0\times\{(1-k1)\times Df3 + k1\times Df4\} \quad (1)$$

Figure 21:
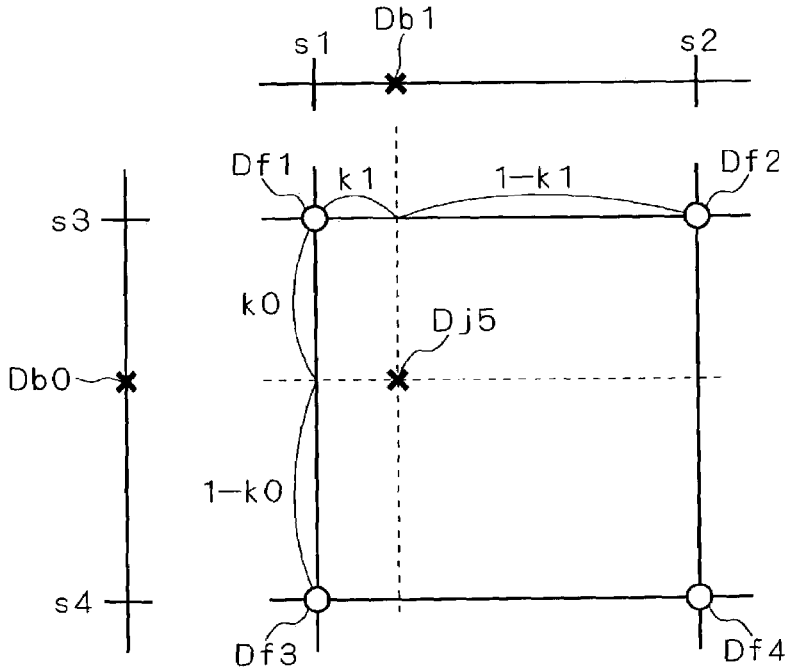
FIG. 21 is a view schematically showing an operation of an interpolation circuit.

FIG. 21 is a view schematically showing a method of calculating the corrected image data Dj5 which is interpolated expressed by Eq. (1). In FIG. 21, reference signs s1 and s2 represent threshold values used in converting the number of quantized bits of the present image data Di1 by the first data converter circuit 20 and sings s3 and s4 represent threshold values used in converting the number of quantized bits of the one-frame preceding reproduced image data Dp0 by the second data converter circuit 21. Moreover, s1 is a threshold value corresponding to the bit-number-converted present image data De1 and s2 is a threshold value corresponding to present image data (De1+1) which is larger than the bit-number-converted present image data De1 by 1. Further, s3 is a threshold value corresponding to the bit-number-converted one-frame preceding reproduced image data De0 and s4 is a threshold value corresponding to one-frame preceding reproduced image data (De0+1) which is larger than the bit-number-converted one-frame preceding reproduced image data De0 by 1.

In this case, the first interpolation coefficient k1 and the second interpolation coefficient k0 are determined from the following equations (2) and (3), respectively;

$$k1=(Db1-s1)/(s2-s1) \quad (2)$$

where $s1<Db1\leqq s2$ $$k0=(Db0-s3)/(s4-s3) \quad (3)$$

where $s3<Db0\leqq s4$

The correction candidate present image data Dj5 interpolated by the interpolating operation as expressed by Eq. (1) is outputted to the subtractor circuit 17. The following operation is the same as the operation discussed with reference to FIG. 18.

As discussed above, the image date correction circuit 10B determines the interpolated value Dj5 from the four corrected image data Df1, Df2, Df3 and Df4 corresponding to the bit-number-converted four data (De1, De0), (De1+1, De0), (De1, De0+1) and (De1+1, De0+1), by using the first and second interpolation coefficients k1 and k0 which are calculated in converting the number of bits of the present image data Di1 and the one-frame preceding reproduced image data Dp0, respectively. Therefore, it is possible to reduce the effect of quantization error caused by the operations of the first data converter circuit 20 and the second data converter circuit 21 on the correction candidate present image data Dj5 which is an interpolated value. In other words, in a case of no interpolation, an error is caused since data on a closest lattice point is used even if selection of data off the lattice points on the LUT is intended, but in the case of performing interpolation, the error is reduced since an arithmetic operation of data among the lattice points can be performed only if the data within the lattice are continuous.

The first data converter circuit 20 and the second data converter circuit 21 can reduce the number of bits of the inputted data through non-linear quantization other than linear quantization. For example, in converting the number of bits through non-linear quantization, it is possible to reduce the error of the correction candidate present image data Dj5 due to reduction in number of bits by setting quantization density relatively high in a region where the change of the corrected image data (the difference between the adjacent corrected image data) is large.

As discussed above, the number of bits of data after the data conversion by these data converter circuits 20 and 21 is not limited to 3 bits but may be any number of bits by which the correction candidate present image data Dj5 which is actually available can be obtained through interpolation by the interpolation circuit 23. Within the limitation, it is possible to select any number of bits as the number of bits of data after data conversion. Naturally, in accordance with the number of quantized bits, the number of corrected image data in the reduced LUT holding circuit 22 varies.

Further, the number m of bits of data De1 and the number q of bits of data De0 after data conversion by these data converter circuits 20 and 21 may be different from each other.

Either one of the first and second data conversion by the first and second data converter circuits 20 and 21 may not be performed. As such a variation, when the first data converter circuit 20 is removed from the circuit constitution of FIG. 19, for example, 8-bit data and 3-bit data are inputted to the reduced LUT holding circuit 22, and the reduced LUT holding circuit 22 has 257×9 or 256×9 corrected image data as the reduced LUT. In this case, since the first interpolation coefficient k1 is zero, the interpolated value Dj5 can be obtained by substituting k1=0 into Eq. (1). In this operation, the corrected image data which are extracted from the reduced LUT and used for interpolation are two, i.e., the first and third corrected image data Df1 and Df3. Conversely, in a case of not using the second data converter circuit 21, the reduced LUT holding circuit 22 has 9×257 or 9×256 corrected image data as the reduced LUT and the interpolated value Dj5 can be obtained by substituting k0=0 into Eq. (1). In this operation, the corrected image data which are extracted from the reduced LUT and used for interpolation are two, i.e., the first and second corrected image data Df1 and Df2.

Further, there may be a constitution of the interpolation circuit 23 where the correction candidate present image data Dj5 is determined by using an interpolating operation other than the non-linear quantization, e.g., an interpolating operation using high-order function.

The Second Variation of the Second Preferred Embodiment

The second variation is an improvement of the first variation of the second preferred embodiment.

Figure 22:
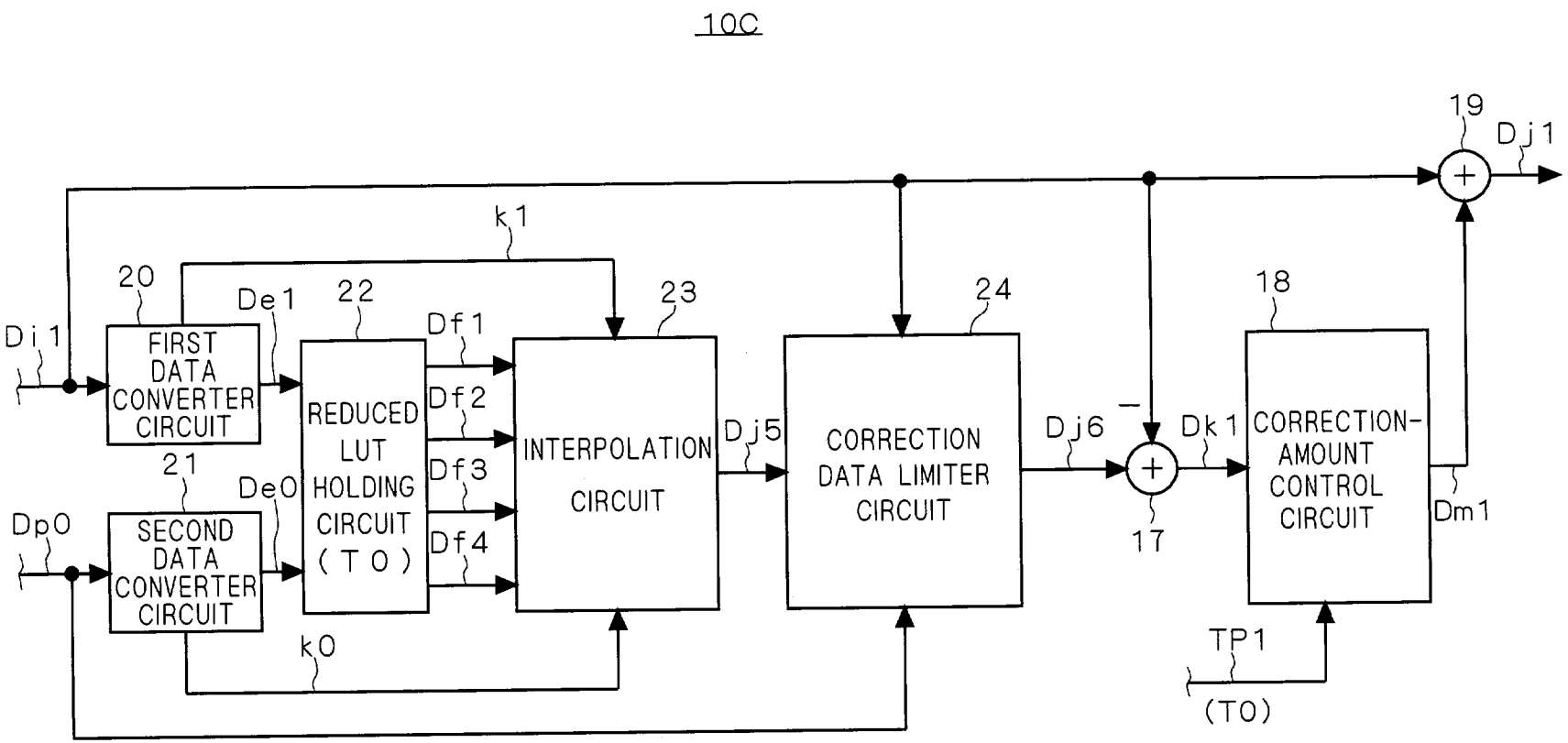
FIG. 22 is a block diagram showing an exemplary constitution of an image date correction circuit in accordance with a second variation of the second preferred embodiment.

FIG. 22 is a block diagram showing an exemplary constitution of an image date correction circuit 10C in accordance with the second variation of the second preferred embodiment, and only difference between the circuit of FIG. 22 and that of FIG. 19 lies in that a correction data limiter circuit 24 is additionally provided in the present constitution.

The correction data limiter circuit 24 (1) first detects whether the present image data Di1 and the one-frame preceding reproduced image data Dp0 are equal to each other or not on the basis of these data Di1 and Dp0, (2) outputs the correction candidate present image data Dj5 as correction candidate present image data Dj6 (no limitation of the correction data) (Dj6=Dj5) when these data Di1 and Dp0 are not equal to each other and (3) outputs the present image data Di1, instead of the correction candidate present image data Dj5 outputted from the interpolation circuit 23, as the correction candidate present image data Dj6 (performing limitation of the correction data) (Dj6=Dj1) when the present image data Di1 and the one-frame preceding reproduced image data Dp0 are equal to each other.

By inserting the correction data limiter circuit 24 having such a function as above between the interpolation circuit 23 and the subtractor circuit 17, the following advantage is produced. Specifically, when the present image data Di1 and the one-frame preceding reproduced image data Dp0 are equal to each other, in other words, when there is no change in the image data (luminance) of a pixel in the motion screen, it is possible to surely avoid the case where the correction error of the image data which is caused by the reduction in number of bits by the first data converter circuit 20 and the second data converter circuit 21 and interpolating operation by the interpolation circuit 23 is included in the correction candidate present image data to be inputted to the subtractor circuit 17.

Also in the case where the difference between the present image data Di1 and the one-frame preceding reproduced image data Dp0 is relatively small, the correction data limiter circuit 24 (A) may output the present image data Di1, instead of the correction candidate present image data Dj5 outputted from the interpolation circuit 23, as the final correction candidate present image data Dj6. Alternatively, the correction data limiter circuit 24 (B) may limit the correction candidate present image data Dj5 outputted from the interpolation circuit 23 so that the amount of correction should become small. More specifically, when the correction data limiter circuit 24 detects that the absolute value of the difference between the present image data Di1 and the one-frame preceding reproduced image data Dp0 is smaller than a predetermined value (Sh), the correction data limiter circuit 24 can limit the correction candidate present image data Dj5 outputted from the interpolation circuit 23 on the basis of the data processing defined by the following equations (4) and (5);

$$Dj6=Di1+m\times(Dj5-Di1) \quad (4)$$

$$m=f(Sh-|Di1-Dp0|) \quad (5)$$

where f(Sh−|Di1−Dp0|) is any function when (Sh−|Di1−Dp0|)

It is possible to correct the error due to interpolation by such a limiting operation as above. Specifically, when the present image data Di1 and the one-frame preceding reproduced image data Dp0 are equal to each other, the amounts of correction of data in lattice points (two points) on the diagonal in the LUT used in interpolation are both zero but the amounts of correction of data in two points on the inverse diagonal are not zero. Though the amounts of correction become errors through the interpolating operation, by the above limiting operation, it is possible to perform correction to reduce the errors. In particular, the errors due to the portions near the diagonal can be reduced.

The Third Preferred Embodiment

The third preferred embodiment proposes an exemplary constitution to achieve the second object. Specifically, the change in ambient temperature of the liquid crystal display panel is not considered in the third preferred embodiment, unlike in the first and second preferred embodiments. Therefore, in detailed discussion of the third preferred embodiment, there are a lot of duplication of the discussion in the first and second preferred embodiments. For this reason, in such duplicate portions, the discussion and corresponding figures of the first and second preferred embodiments are used as appropriate.

Prior to detailed discussion on the third preferred embodiment, since the idea of this preferred embodiment starts with the following problem recognition, herein, the problem of the prior-art invention disclosed in the above Japanese Patent No. 2616652 (the first prior art) will be mentioned again. Specifically, the prior-art invention disclosed in the document 1 relies on the idea that the liquid crystal driving voltage increases or decreases on the basis of only increase or decrease in luminance value. Therefore, when the luminance value of the present image becomes larger than the luminance value of the one-frame preceding image, a driving voltage higher than the liquid crystal driving voltage corresponding to the luminance value of the present image is uniformly applied to liquid crystal driving electrodes, regardless of the amount of increase. As a result, when the change in luminance value is very small, an overvoltage is applied to the liquid crystal and this causes deterioration in image quality. On the other hand, also when the luminance value of the present image becomes smaller than the luminance value of the one-frame preceding image, since a driving voltage lower than the liquid crystal driving voltage corresponding to the luminance value of the present image is uniformly applied to liquid crystal driving electrodes, regardless of the amount of decrease, the same deterioration in image quality may be caused. The present inventors think that a cause of raising such an essential problem lies in that the amount of increase or decrease in driving voltage is uniformly set on the basis of simple comparison of the luminance values. Then, based on this point, the present inventors create a subject matter of this preferred embodiment.

Figure 23:
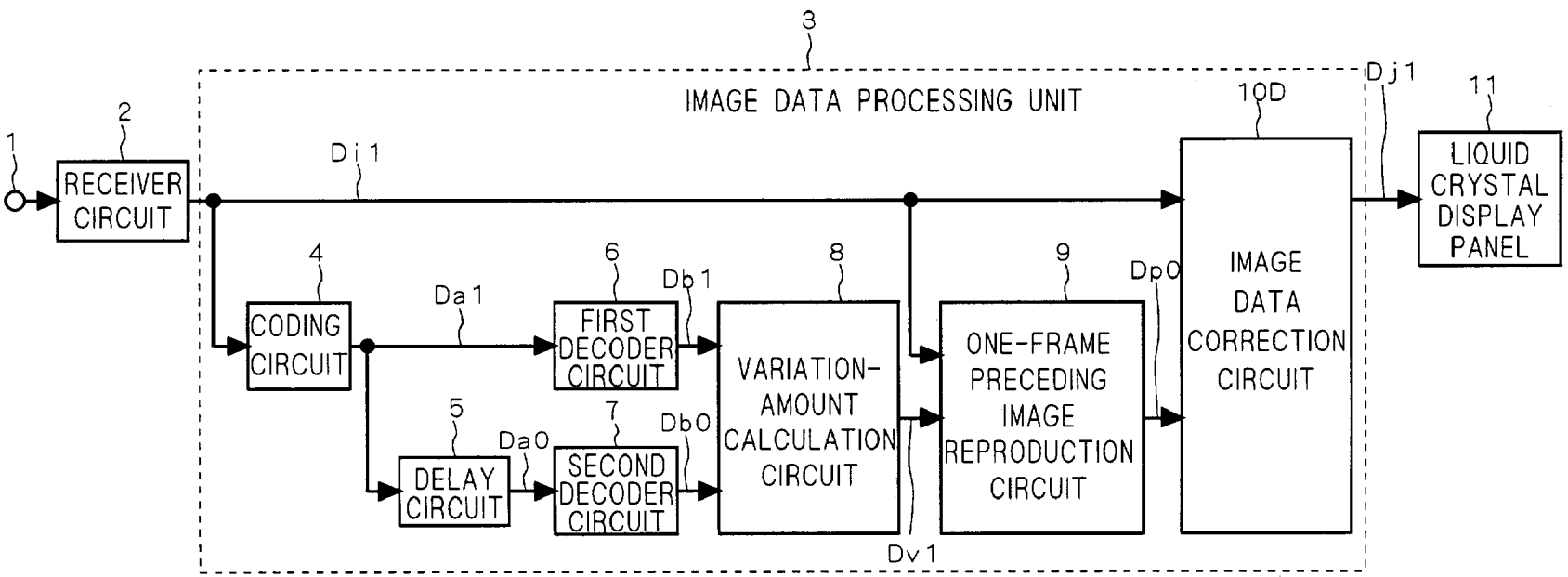
FIG. 23 is a block diagram showing an exemplary constitution of a liquid crystal display in accordance with a third preferred embodiment.

FIG. 23 is a block diagram showing an exemplary constitution of a liquid crystal display device in accordance with the third preferred embodiment. In FIG. 23, constituent elements represented by the same reference signs as those of FIG. 1 are identical to the corresponding elements in FIG. 1. Specifically, the device of FIG. 23 is different from that of FIG. 1 in (i) not-provision of the temperature control unit 12 and (ii) a constitution of an image date correction circuit 10D, and other constituent elements 1, 2, 4, 5, 6, 7, 8 and 9 of FIG. 23 have the same circuit constitution and function as those of the corresponding elements of FIG. 1. Therefore, in describing these elements 1, 2, 4, 5, 6, 7, 8 and 9 of FIG. 23, the description on the corresponding elements of FIG. 1 is basically used.

An outline of the constitution of FIG. 23 is as follows. First, the receiver circuit 2 receives image signals by its input terminal 1 and sequentially outputs the raster image data (present image data) Di1 corresponding to an inputted moving image (present image) of one frame. The image data processing unit 3 performs a predetermined processing on the present image data Di1 to generate the corrected present image data Dj1 which is a corrected signal of the present image data Di1. The image data processing unit 3 comprises the coding circuit 4, the delay circuit 5, the first decoder circuit 6, the second decoder circuit 7, the variation-amount calculation circuit 8, the one-frame preceding image reproduction circuit 9 and the image date correction circuit 10D.

The coding circuit 4 codes and compresses the present image data Di1 to generate and output the coded image data Da1 corresponding to the present image. Coding of the present image data Di1 can be performed by block truncation coding such as FBTC (Fixed Block Truncation coding) or GBTC (Generalized Block Truncation coding). Further, any still picture coding system, e.g., two-dimensional discrete cosine transform coding such as JPEG (Joint Photographic Experts Group), predictive coding such as JPEG-LS (Joint Photographic Experts Group-Lossless) or wavelet transform such as JPEG2000 can be used as the above coding. Each of these still picture coding methods is available even if it is an irreversible coding system in which the uncoded present image data Di1 and the decoded image date Db1 do not completely coincide with each other.

The delay circuit 5 delays the coded image data Da1 outputted from the coding circuit 4 by a period which corresponds to one frame and outputs the coded image data Da0 which corresponds to the image data preceding the present image data Di1 by one frame. The delay circuit 5 comprises a memory (not shown) for storing the coded image data Da1 during the one frame period and a memory control unit (not shown) for controlling the memory. Therefore, as the coding ratio (data compression ratio) of the present image data Di1 is made higher, it is possible to reduce the capacity of the memory of the delay circuit 5.

The first decoder circuit 6 decodes (expands) the coded image data Da1 to output the first decoded image data Db1 corresponding to the present image data Di1. At the same time, the second decoder circuit 7 decodes the coded image data Da0 to output the second decoded image data Db0 corresponding to the image data preceding the present image data Di1 by the one frame period.

The variation-amount calculation circuit 8 subtracts the first decoded image data Db1 from the second decoded image data Db0 on the basis of these decoded image date Db1 and Db0 to calculate and output the variation-amount data Dv1 indicating the amount of variation between the luminance value of the one-frame preceding image and the luminance value of the present image with respect to each pixel.

The one-frame preceding image reproduction circuit 9 adds the luminance value variation Dv1 to the present image data Di1 to reproduce the one-frame preceding image data Dp0.

The image date correction circuit 10D corrects the present image data Di1 on the basis of the present image data Di1 and the one-frame preceding reproduced image data Dp0 to output the corrected present image data Dj1. Specifically, the image date correction circuit 10D corrects the present image data Di1 so that the transmittance of the display pixel portion in the liquid crystal should become the transmittance corresponding to the luminance value of the present image within the one frame period only when the value of the present image data Di1, i.e., the luminance value of the present image is changed, as compared with the luminance value indicated by the one-frame preceding reproduced image data Dp0.

The liquid crystal display panel 11 determines the driving voltage on the basis of the corrected present image data Dj1 of a certain pixel and then applies the driving voltage to a driving electrode for a display pixel of the liquid crystal corresponding to the certain pixel to perform a display operation.

Herein, as a flowchart showing an operation of the image data processing unit 3 of FIG. 23, the flowchart of FIG. 2 is used. Among those steps of FIG. 2, only difference between the third preferred embodiment and the first preferred embodiment lies in Step St6.

In the present image data coding step (St1), the coding circuit 4 codes the present image data Di1 to output the coded image data Da1 corresponding to the present image. In the delay coded image data reading step (St2), the delay circuit 5 outputs the coded image data Da0 corresponding to the image preceding the present image by one frame and performs an operation of delaying the coded image data Da1 by a period corresponding to one frame. In the coded image data decoding step (St3), the first decoder circuit 6 and the second decoder circuit 7 decode the corresponding coded image data Da1 and Da0 and output the first decoded image data Db1 corresponding to the present image and the second decoded image data Db0 corresponding to the one-frame preceding image, respectively. In the variation-amount data calculating step (St4), the variation-amount calculation circuit 8 generates and outputs the variation-amount data Dv1 of the luminance value on the basis of these decoded image date Db1 and Db0. In the one-frame preceding image reproducing step (St5), the one-frame preceding image reproduction circuit 9 outputs the reproduced image data Dp0 corresponding to the one-frame preceding image on the basis of the variation-amount data Dv1 of the luminance value and the present image data Di1. In the present image data correcting step (St6) which is an essential part, the image date correction circuit 10D corrects the present image data Di1 on the basis of the present image data Di1 and the one-frame preceding reproduced image data Dp0 to output the corrected present image data Dj1. A series of operations from the step St1 to the step St6 are performed on the present image data Di1 of each pixel in one screen.

Figure 24:
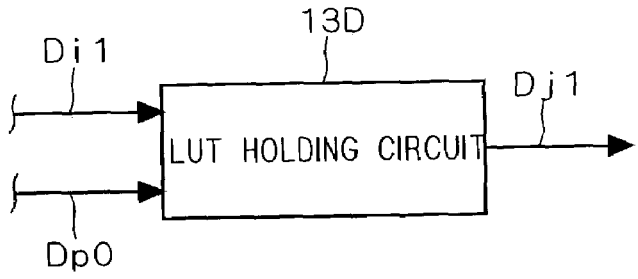
FIG. 24 is a block diagram showing an exemplary constitution of an image date correction circuit in accordance with the third preferred embodiment.

FIG. 24 is a block diagram showing an exemplary internal constitution of the image date correction circuit 10D of FIG. 23. The image date correction circuit 10D comprises a look-up table (LUT) holding circuit 13D. Based on the present image data Di1 and the one-frame preceding reproduced image data Dp0, the LUT holding circuit 13D extracts such correction data (LUT data) as to change the transmittance of the display pixel portion in the liquid crystal to the transmittance corresponding to the luminance value of the present image of the pixel within the one frame period out of the LUT, and the circuit 13D outputs the extracted LUT data as the corrected present image data Dj1 for correcting the present image data Di1.

Figure 25:
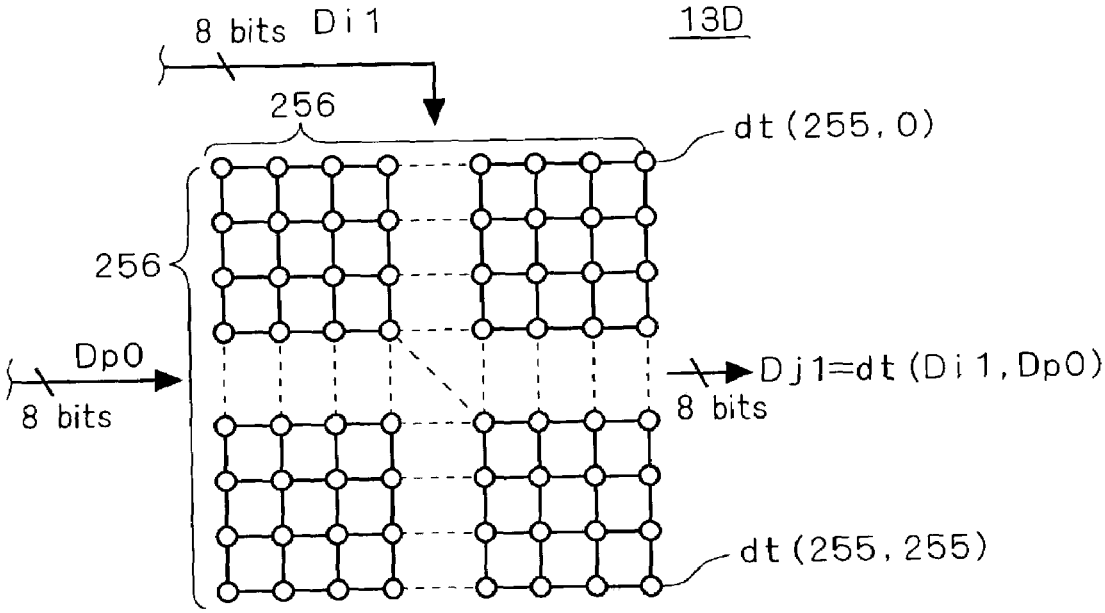
FIG. 25 is a view schematically showing the format of data held in an LUT holding circuit in accordance with the third preferred embodiment.

FIG. 25 is a view schematically showing a construction of look-up table in the LUT holding circuit 13D, which corresponds to FIG. 4 discussed in the first preferred embodiment. Herein, the present image data Di1 and the one-frame preceding reproduced image data Dp0 are each an 8-bit image data, taking a value within a range from 0 to 255 as the luminance value. The look-up table of FIG. 25 has 256×256 data which are two-dimensionally arranged and outputs the corrected present image data Dj1=dt (Di1, Dp0) corresponding to the values of the present image data Di1 and the one-frame preceding reproduced image data Dp0.

A method of determining the corrected present image data Dj1 will be discussed below. The method of determining the corrected present image data Dj1 in the third preferred embodiment is basically the same as discussed in the first preferred embodiment with reference to FIGS. 5, 7, 8 and 9. Therefore, the discussion on the method in the first preferred embodiment is basically used and FIGS. 5, 7 and 8 are also used in the following discussion. The method of determining the corrected present image data Dj1 in the third preferred embodiment will be discussed duplicately below.

Assuming that the luminance value of the present image is represented by 8 bits (0 to 255), when the present image data Di1=127, for example, the voltage V50 to achieve the transmittance of 50% is applied to the display pixel portion of the liquid crystal corresponding to the pixel. Similarly, when the present image data Di1=191, the voltage V75 to achieve the transmittance of 75% is applied. As shown in FIG. 5, when the voltages V50 and V75 on the basis of the present image data Di1 are applied to the corresponding display pixel portions of the liquid crystal, respectively, it takes a response time longer than the one frame period to change the transmittance of the display pixel portion in the liquid crystal to the predetermined transmittances, i.e., 50% and 75%. Therefore, when the luminance value of the present image is changed, as compared with the luminance value of the one-frame preceding image, the image data processing unit 3 generates and outputs such corrected present image data Dj1 as to change the transmittance of the display pixel portion in the liquid crystal to the transmittance corresponding to the luminance value of the present image within the one frame period, and by applying the driving voltage which is generated on the basis of this corrected present image data Dj1 to an electrode of the corresponding display pixel portion, the response speed of the liquid crystal can be improved.

In the case of the response speed shown in FIG. 5, when the voltage V75 is applied, the transmittance of the liquid crystal after the one frame period passes becomes 50%. Therefore, when a target transmittance is 50%, it is possible to change the transmittance of the liquid crystal to 50% within the one frame period by setting the driving voltage of the liquid crystal to be the voltage V75. In other words, when the luminance value of the present image data Di1 changes from 0 to 127, if it is intended that the luminance value of the present image data Di1 is corrected and the corrected present image data Dj1 having the luminance value of 191 should be outputted to the liquid crystal display panel 11, such a driving voltage as to give a desired transmittance to the corresponding display pixel portion in the liquid crystal within the one frame period is applied to the above display pixel portion.

Figure 26:
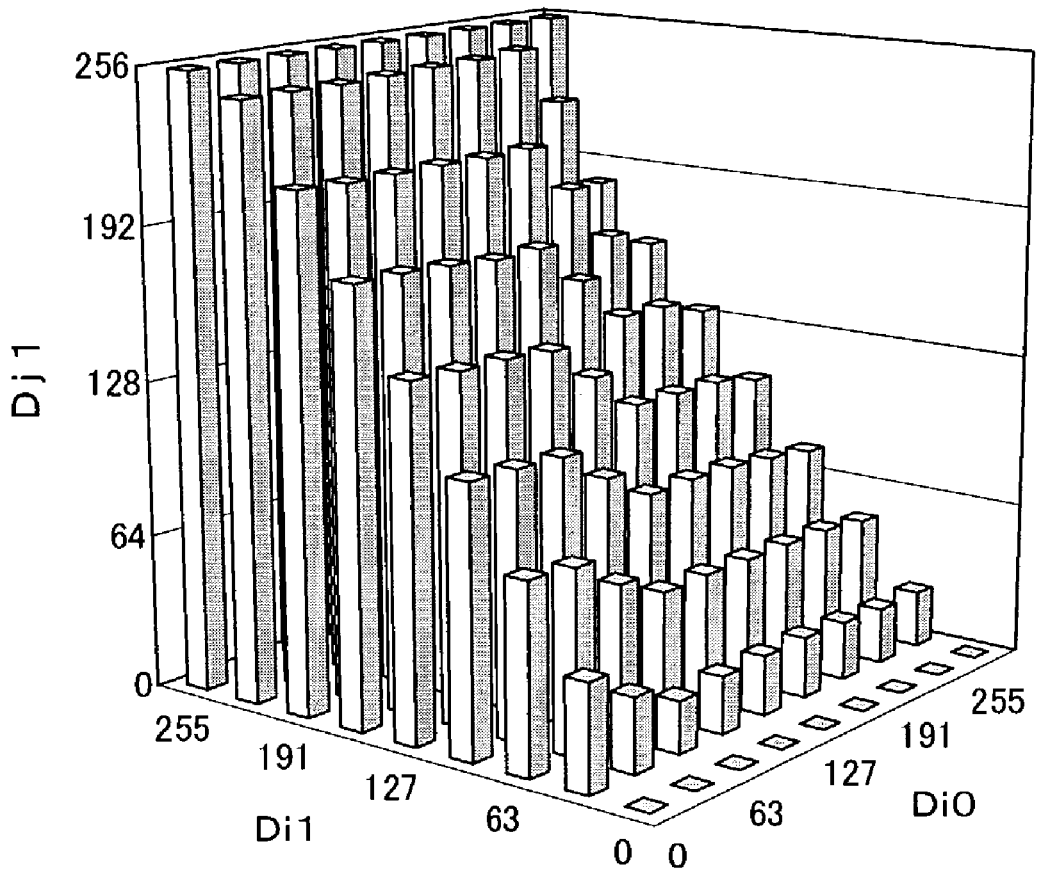
FIG. 26 is a view schematically showing an example of corrected present image data.

In FIG. 7, since there are 256×256 combinations of the luminance value of the present image and the luminance value of the one-frame preceding image, there are 256×256 response speeds. Further, in FIG. 8, there are 256×256 amounts of correction for the present image data Di1 correspondingly to the combinations of the luminance value of the present image and the luminance value of the one-frame preceding image. As shown in FIG. 7, the response speeds of the liquid crystal vary by the combination of the luminance value of the present image and the luminance value of the one-frame preceding image, it is impossible to generally obtain the amount of correction by a simple equation. For this reason, as the look-up table, the LUT holding circuit 13D of FIG. 24 stores the corrected present image data Dj1 obtained by adding 256×256 amounts of correction shown in FIG. 8 to the respective present image data Di1, as shown in FIG. 26. The values of the corrected present image data Dj1 are, naturally, so set as not to exceed a displayable range of transmittance for the liquid crystal display panel 11, in other words, as to fall within a range from 0 to 255 if the luminance value of the present image and the luminance value of the one-frame preceding image are each 8 bits. When the corrected present image data Dj1 is set off the range, it is impossible to use a circuit which is conventionally used in general as a segment electrode driving circuit for driving the liquid crystal panel.

As mentioned above, the response characteristics of the liquid crystal vary depending on various factors such as the material of the liquid crystal, the shape of the electrode or the temperature. Therefore, it is possible to control the response speed in accordance with the characteristics of the liquid crystal as circumstances demand by adopting a look-up table having the corrected present image data Dj1 which respond to these use conditions and then rewriting the corrected present image data Dj1 in the look-up table in accordance with change of these use conditions or switching to the corrected present image data Dj1 suitable for the use condition out of a plurality of different combinations in the look-up table which is prepared in advance and has enough capacity.

Further, as shown in FIG. 8, the amount of correction is determined in accordance with the response speed of the liquid crystal, and specifically so determined as to become large with respect to the combination of the luminance values where the response speed of the liquid crystal is low. In particular, the response speed in a tone change from intermediate intensity of luminance (gray) to high intensity of luminance (white) is low. Therefore, the response speed of the liquid crystal can be effectively improved by setting the value of the corrected present image data Dj1 corresponding to the combination of the one-frame preceding reproduced image data Dp0 representing the intermediate luminance and the present image data Di1 representing the high luminance to be larger than the value of the present image data Di1.

The corrected present image data Dj1 outputted from the look-up table shown in FIG. 25 is outputted to the liquid crystal display panel 11. A driver (not shown) in the liquid crystal display panel 11 generates the driving voltage on the basis of the corrected present image data Dj1 and applies the driving voltage to the corresponding segment electrode in the liquid crystal to achieve an optimum tone display.

FIGS. 14A, 14B and 14C are used herein as timing charts schematically showing an operation of the image data processing unit 3 (FIG. 23) of the third preferred embodiment, and the discussion in the first preferred embodiment on these figures is also used.

Thus, since the image data processing unit 3 of the third preferred embodiment once codes the present image data Di1 to compress the amount of data and then delays the coded data of the present image data, it is advantageously possible to reduce the memory capacity required to delay the present image data Di1 by the one frame period. Moreover, since the coding and decoding operations of the present image data Di1 of all the pixels in one screen are performed without skipping the image data, the third preferred embodiment can generate the corrected present image data Dj1 having appropriate values, not causing deterioration in image quality, and consequently produces an advantage of appropriately controlling the response speed of the liquid crystal.

Further, since the image date correction circuit 10D generates and outputs the corrected present image data Dj1 on the basis of the present image data Di1 and the one-frame preceding reproduced image data Dp0, the third preferred embodiment also produces the advantage of achieving the corrected present image data Dj1 which is not affected by the errors due to the coding and decoding operations, like in the first preferred embodiment. This point will be discussed below.

FIGS. 27A to 27F are views showing an effect of errors caused by the coding and decoding operations on the corrected present image data Dj1. Specifically, FIG. 27A is a view schematically showing the image data Di0 representing an actual image example in an (n−1)th frame preceding the present image by one frame, and FIG. 27D is a view schematically showing values of the present image data Di1 representing an image in an n-th frame which is the present image. As shown in FIGS. 27A and 27D, the present image data Di1 is not changed, as compared with the actual one-frame preceding image data Di0. FIGS. 27E and 27B are views schematically showing respective coded data of the present image data Di1 and the one-frame preceding image data Di0 shown in FIGS. 27D and 27A, Herein, FIGS. 27E and 27B each show coded data obtained by FBTC, where typical values (La, Lb) are represented as 8-bit data and 1-bit data is allocated to each pixel. FIGS. 27F and 27C show the decoded image date Db1 and Db0 which are obtained by decoding the coded data of FIGS. 27E and 27B, respectively. FIG. 27G shows values of the variation-amount data Dv1 for the luminance value generated on the basis of the decoded image date Db1 and Db0 of FIGS. 27F and 27C, and FIG. 27H shows values of the one-frame preceding reproduced image data Dp0. As shown in FIGS. 27D, 27F, 27A and 27C, even if there are errors in these decoded image date Db1 and Db0 which are caused by the coding and decoding operations as compared with the present image data Di1 and the one-frame preceding image data Di0, the variation-amount data Dv1 is calculated on the basis of these decoded image date Db1 and Db0 shown in FIGS. 27F and 27C and the value of the variation-amount data Dv1 is zero as shown in FIG. 27G. Therefore, as shown in FIG. 27H, the same data as the one-frame preceding image data Di0 shown in FIG. 27A is reproduced as the one-frame preceding reproduced image data Dp0 without being affected by the errors due to the coding and decoding operations, and the one-frame preceding reproduced image data Dp0 including no error is outputted to the image date correction circuit 10D.

Since the coding operation is not performed on the present image data Di1 which is one of the input signals of the image date correction circuit 10D, the image date correction circuit 10D can output the appropriate corrected present image data Dj1 to the liquid crystal display panel 11 on the basis of the present image data Di1 and the one-frame preceding reproduced image data Dp0 which is appropriately reproduced without any error.

Though the data to be inputted to the look-up table of FIG. 25 is represented by 8 bits in the above discussion, the data is not limited to this but the data to be inputted to the look-up table may take any number of bits only if the number of bits substantially allows generation of th correction data through the interpolating operation or the like. In this case, a circuit consisting of an LUT having n×n data of k bits (k<n, any number) and a circuit for performing an interpolating operation which is provided on the output side of the LUT (which is a processing circuit for converting the LUT data of k bits which is selected as the correction data into the corrected present image data Dj1 of n bits whose number of bits is the same as those of the input signals Di1 and Dp0 of the above LUT) is broadly regarded as the LUT holding circuit 13D.

The First Variation of the Third Preferred Embodiment

The first variation of the third preferred embodiment is similar to the first variation of the second preferred embodiment shown in FIG. 19, and the present variation is different from that of FIG. 19 in that the subtractor circuit 17, the correction-amount control circuit 18 and the adder circuit 19 shown in FIG. 19 are not provided and other constituent elements 20 to 23 are basically common to these variations. Accordingly, also in the present variation, the description on the constituent elements 20 to 23 in the first variation of the second preferred embodiment are basically used. In the following discussion, FIG. 23 showing the constitution of the third preferred embodiment is used since the essential point of the present variation lies in correction of the constitution of the image date correction circuit 10D shown in FIG. 23.

Figure 28:
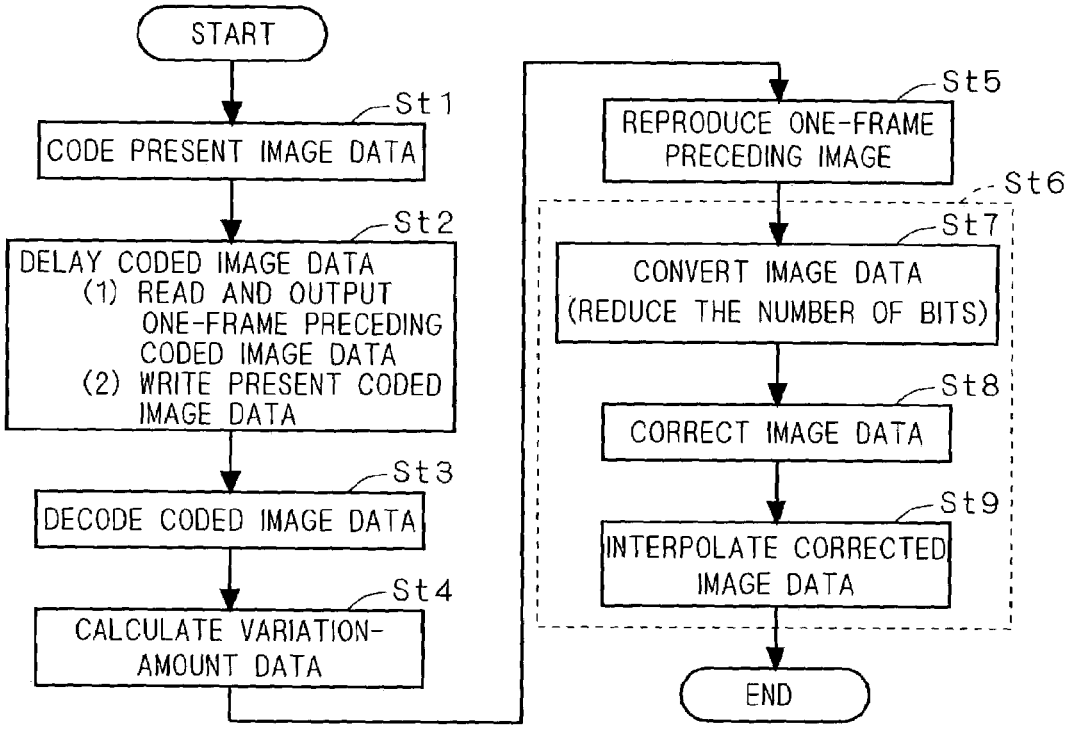
FIG. 28 is a flowchart showing an operation of an image data processing circuit in accordance with the a first variation of the third preferred embodiment.

FIG. 28 is a flowchart showing an operation of the image data processing unit 3 in accordance with the first variation of the third preferred embodiment. The operations in Steps St1 to St5 are the same as discussed in the third preferred embodiment, and discussion thereof is omitted herein. The present image data correcting step St6 of the present variation consists of an image data converting step St7, an image data correcting step St8 and a corrected image data interpolating step St9. The present image data correcting step St6 will be discussed in detail below, with reference to FIG. 29 discussed later, as appropriate.

Specifically, in the image data converting step St7 of FIG. 28, the number of quantized bits of the present image data Di1 is reduced (from n bits to m (m<n) bits) and the number of quantized bits of the one-frame preceding reproduced image data Dp0 is also reduced at the same time (from n bits to q (q<n) bits), to generate the present image data De1 after conversion in number of bits and the one-frame preceding reproduced image data De0 after conversion in number of bits. In the image data correcting step St8, next, on the basis of the present image data De1 and the one-frame preceding reproduced image data De0, the first corrected image data Df1 corresponding to the combination of the present image data De1 and the one-frame preceding reproduced image data De0 and the second to fourth corrected image data Df2, Df3 and Df4 at three lattice points adjacent to the combination are extracted, out of the look-up table in which the correction data corresponding to combinations of these data De1 and De0 are stored in advance. And then, the bit-number-converted present image data De1 is corrected with these corrected image data Df1 to Df4. In the corrected image data interpolating step St9, next, on the basis of the present image data Di1 and the one-frame preceding reproduced image data Dp0 before conversion in number of bits, an interpolating operation is performed on the first to fourth corrected image data Df1, Df2, Df3 and Df4, and interpolated image data Dh1 is outputted as the corrected present image data Dj1.

Figure 29:
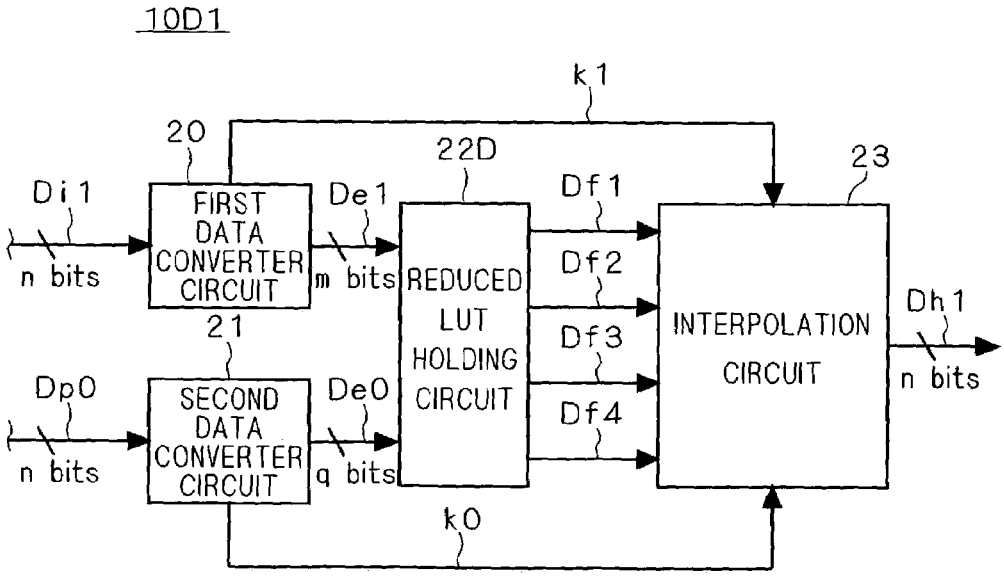
FIG. 29 is a block diagram showing an exemplary constitution of an image date correction circuit in accordance with the first variation of the third preferred embodiment.

An image date correction circuit 10D1 in the image data processing unit 3 of the present variation consists of four constituent elements shown in FIG. 29, instead of the LUT holding circuit 13D of FIG. 24. Specifically, the image date correction circuit 10D1 has the first data converter circuit 20, the second data converter circuit 21, a reduced LUT holding circuit 22D which substantially serves as the image date correction circuit and the interpolation circuit 23.

In FIG. 29, the first data converter circuit 20 and the second data converter circuit 21 reduce the number of quantized bits of the present image data Di1 and the one-frame preceding reproduced image data Dp1, e.g., from 8 bits to 3 bits, to output the bit-number-converted present image data De1 and the bit-number-converted one-frame preceding reproduced image data De0, respectively. At the same time, the first data converter circuit 20 and the second data converter circuit 21 calculate the first and second interpolation coefficients k0 and k1 in bit-number conversion which is performed on the basis of the present image data Di1 and the one-frame preceding reproduced image data Dp0, respectively. The reduced LUT holding circuit 22D corrects the bit-number-converted present image data De1 on the basis of the bit-number-converted present image data De1 and the bit-number-converted one-frame preceding reproduced image data De0 so that the transmittance of the display pixel portion in the liquid crystal corresponding to the pixel should become the transmittance corresponding to the luminance value of the present image within the one frame period, to output four corrected image data Df1 to Df4. The interpolation circuit 23 interpolates the corrected image data Df1 to Df4 by using the first and second interpolation coefficients k0 and k1 which are the results of conversion in number of bits, to output the interpolated image data Dh1 of n bits (e.g., 8 bits).

The interpolated image data Dh1 is inputted to a driver (not shown) in the liquid crystal display panel 11 of FIG. 23 as the corrected present image data Dj1, and the driver determines a voltage for driving a segment electrode corresponding to the pixel on the basis of the corrected image data Dh1 and applies the driving voltage to the corresponding segment electrode. The liquid crystal display panel 11 thereby performs a tone display operation.

Figure 30:
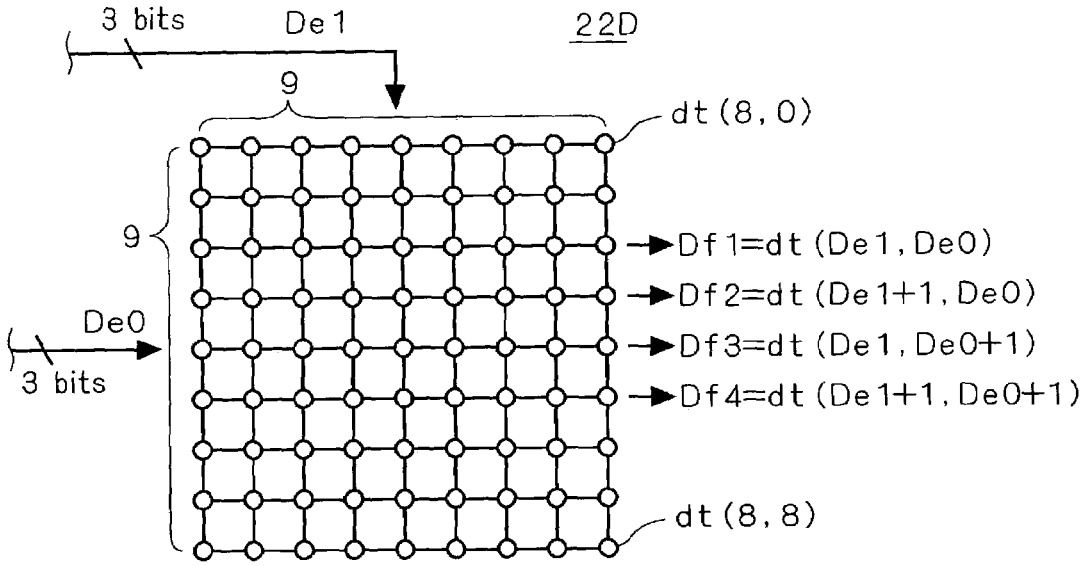
FIG. 30 is a view schematically showing the format of data held in a reduced LUT holding circuit in accordance with the first variation of the third preferred embodiment.

FIG. 30 is a view schematically showing a construction of a look-up table in the reduced LUT holding circuit 22D of FIG. 29. In this example, the bit-number-converted present image data De1 and the bit-number-converted one-frame preceding reproduced image data De0 are each 3-bit data, taking a value in a range from 0 to 7. As shown in FIG. 30, the look-up table has 9×9 data which are two-dimensionally arranged and outputs the corrected image data dt (De1, De0) corresponding to the values of the present image data De1 and the one-frame preceding reproduced image data De0 both of which are converted in bit number to 3 bits as the corrected image data Df1. Further, the look-up table outputs three corrected image data dt (De1+1, De0), dt (De1, De0+

1) and dt (De1+1, De0+1) which are adjacent to the corrected image data Df1 as the corrected image data Df2, Df3 and Df4, respectively.

The interpolation circuit 23 performs an interpolating operation expressed by the earlier-mentioned Eq. (1) (herein, Dj5 in the left side of Eq. (1) is substituted by Dh1) by using the first and second interpolation coefficients k1 an k0 and the first to fourth corrected image data Df1 to Df4, to calculate the interpolated image data Dh1 which is interpolated.

Figure 31:
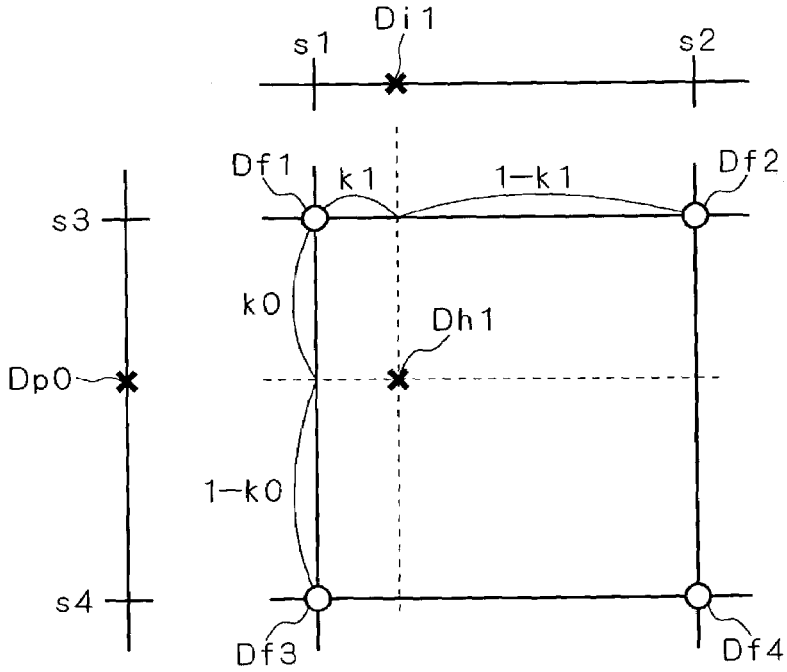
FIG. 31 is a view schematically showing an operation of an interpolation circuit in accordance with the first variation of the third preferred embodiment.

FIG. 31 is a view schematically showing a method of calculating the interpolated image data Dh1 expressed by Eq. (1), which corresponds to FIG. 21. In FIG. 31, reference signs s1 and s2 represent threshold values used in converting the number of quantized bits of the present image data Di1 by the first data converter circuit 20 and sings s3 and s4 represent threshold values used in converting the number of quantized bits of the one-frame preceding reproduced image data Dp0 by the second data converter circuit 21. Moreover, s1 is a threshold value corresponding to the bit-number-converted present image data De1 and s2 is a threshold value corresponding to present image data (De1+1) which is larger than the bit-number-converted present image data De1 by 1. Further, s3 is a threshold value corresponding to the bit-number-converted one-frame preceding reproduced image data De0 and s4 is a threshold value corresponding to one-frame preceding reproduced image data (De0+1) which is larger than the bit-number-converted one-frame preceding reproduced image data De0 by 1.

In this case, the first interpolation coefficient k1 and the second interpolation coefficient k0 are determined from the following equations (6) and (7), respectively;

$$k1=(Di1-s1)/(s2-s1) \tag{6}$$

where $s1<Di1\leqq s2$ $$k0=(Dp0-s3)/(s4-s3) \tag{7}$$

where $s3<Dp0\leqq s4$

As discussed above, the interpolated image data Dh1 is obtained by interpolating operation of the four corrected image data Df1, Df2, Df3 and Df4 corresponding to the bit-number-converted four data (De1, De0), (De1+1, De0), (De1, De0+1) and (De1+1, De0+1), by using the first and second interpolation coefficients k1 and k0 which are calculated in converting the number of bits of the present image data Di1 and the one-frame preceding reproduced image data Dp0, respectively. Through this interpolating operation, it is possible to simplify the construction of the look-up table and reduce the effect of quantization errors in the first data converter circuit 20 and the second data converter circuit 21 on the interpolated image data Dh1.

The first data converter circuit 20 and the second data converter circuit 21 can reduce the number of bits of the inputted data also through non-linear quantization other than linear quantization. For example, in converting the number of bits through non-linear quantization, the quantization density is set in accordance with a change of the corrected image data (difference between the adjacent corrected image data). Specifically, it is possible to more reduce the error of the interpolated image data Dh1 due to reduction in number of bits by setting the quantization density relatively high in a region where the change of the corrected image data is large.

Further, the number of bits of data after the data conversion by the first and second data converter circuits 20 and 21 is not limited to 3 bits but may be any number of bits by which the interpolated image data Dh1 which is actually available can be obtained through interpolation by the interpolation circuit 23. Naturally, in accordance with the number of quantized bits, the number of data inside the loop-up table in the reduced LUT holding circuit 22D also varies.

Furthermore, the numbers m and q of bits of respective data after the bit-number conversion by the first and second data converter circuits 20 and 21 may be different from each other, and it is possible not to perform either one bit-number conversion. In the case where either one bit-number conversion is not performed, the first data converter circuit 20 or the second data converter circuit 21 reduces the number n of quantized bits of the present image data Di1 or the one-frame preceding reproduced image data Dp1 and outputs either the bit-number-converted present image data De1 or the bit-number-converted one-frame preceding reproduced image data De0. Next, by accessing the look-up table, the bit-number-converted present image data De1 is corrected on the basis of the bit-number-converted present image data De1 and the one-frame preceding reproduced image data Dp1 which is not converted in number of bits or the present image data Di1 is corrected on the basis of the present image data Di1 which is not converted in number of bits and the bit-number-converted one-frame preceding reproduced image data De0, to output the corrected image data and the adjacent corrected image data. After that, the interpolation circuit 23 interpolates these corrected image data on the basis of the present image data Di1 and the one-frame preceding reproduced image data Dp0 by using the interpolation coefficients k1 and k0 which are the results of conversion in number of bits, to generate and output the interpolated image data Dh1. When both the first and second data converter circuits 20 and 21 perform bit-number conversions, the corrected image data consists of four data Df1 to Df4, but when either one of the first and second data converter circuits 20 and 21 performs a bit-number conversion, the corrected image data consists of two data (see Eq. (1)). When either one of the first and second data converter circuits 20 and 21 performs a bit-number conversion, either one of the interpolation coefficients k1 and k0, i.e., the interpolation coefficient corresponding to one of the present image data Di1 and the one-frame preceding reproduced image data Dp1 which is not bit-number converted takes a value of zero. Therefore, from Eq. (1), when k1=0, the reduced LUT has at least $2^n\times(2^q+1)$ data and on the other hand, when k0=0, the reduced LUT has at least $(2^m+1)\times 2^n$ data.

Further, there may be a constitution of the interpolation circuit 23 where the interpolated image data Dh1 is calculated by using an interpolating operation other than the linear interpolation, e.g., an interpolating operation using a high-order function.

The Second Variation of the Third Preferred Embodiment

The second variation of the third preferred embodiment is similar to the second variation of the second preferred embodiment shown in FIG. 22, and the present variation is different from that of FIG. 22 in that the subtractor circuit 17, the correction-amount control circuit 18 and the adder circuit 19 shown in FIG. 22 are not provided and other constituent elements 20 to 24 are basically common to these variations. Accordingly, also in the present variation, the description on the constituent elements 20 to 24 in the second variation of the second preferred embodiment are basically used. In the following discussion, FIG. 23 showing the constitution of the third preferred embodiment is used since the essential point of the present variation lies in correction of the constitution of the image date correction circuit 10D shown in FIG. 23.

Figure 32:
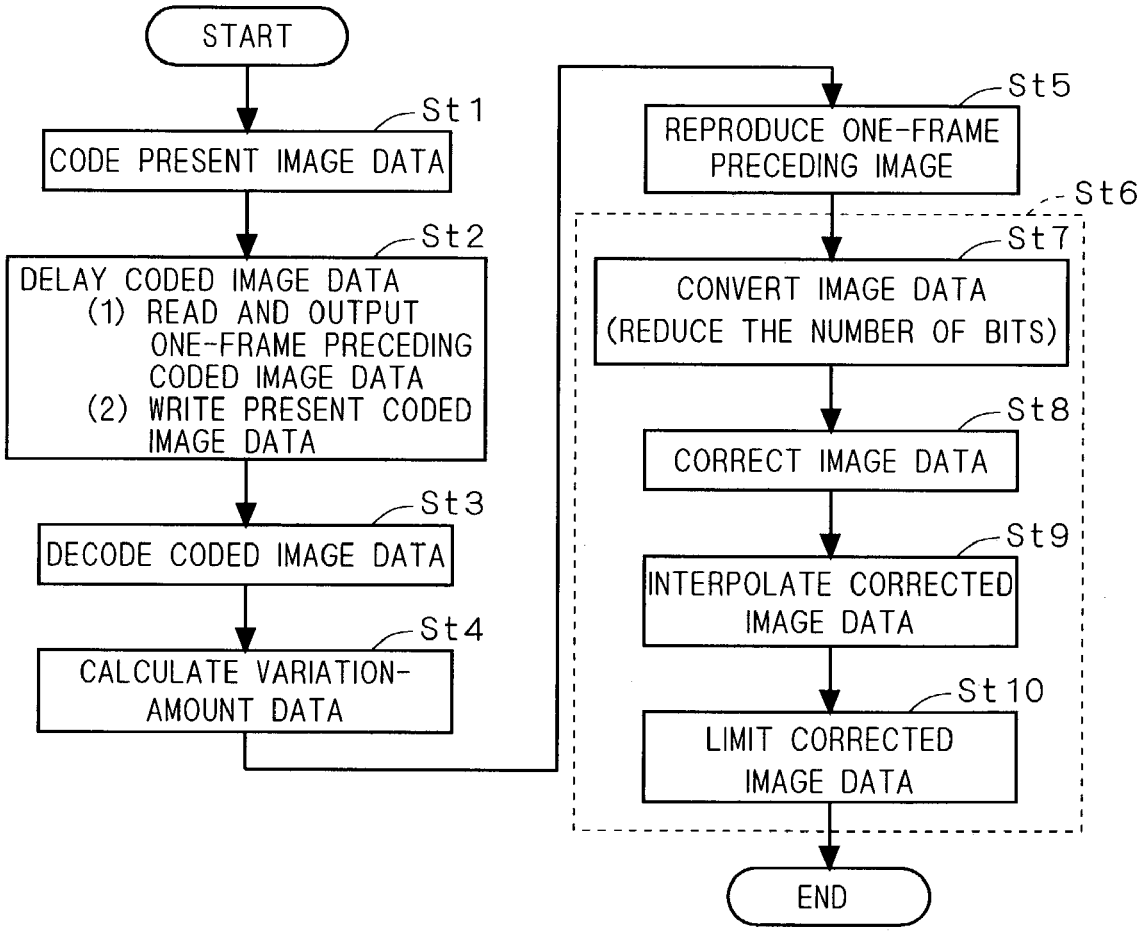
FIG. 32 is a flowchart showing an operation in an image data processing circuit in accordance with the a second variation of the third preferred embodiment.

FIG. 32 is a flowchart showing an operation of the image data processing unit 3 in accordance with the second variation of the third preferred embodiment. In FIG. 32, the operations in Steps St1 to St5 and Steps St7 to St9 are the same as discussed in the third preferred embodiment and the first variation thereof, and discussion thereof is omitted herein. In a corrected image data limiting step St10 which is an essential part of the present variation, on the basis of the present image data Di1 and the one-frame preceding reproduced image data Dp0, the interpolated image data generated in the corrected image data interpolating step (St9) is limited so that the present image data Di1 should not be corrected or its amount of correction should be small, to output limited image data Dg1 which is thereby obtained, in the following predetermined case. The limited image data Dg1 is inputted to the liquid crystal display panel 11 of FIG. 23 as the corrected present image data Dj1, and the liquid crystal display panel 11 applies a voltage determined on the basis of the limited image data Dg1 to a driving electrode for display pixel corresponding to the pixel, to perform the tone display operation.

Figure 33:
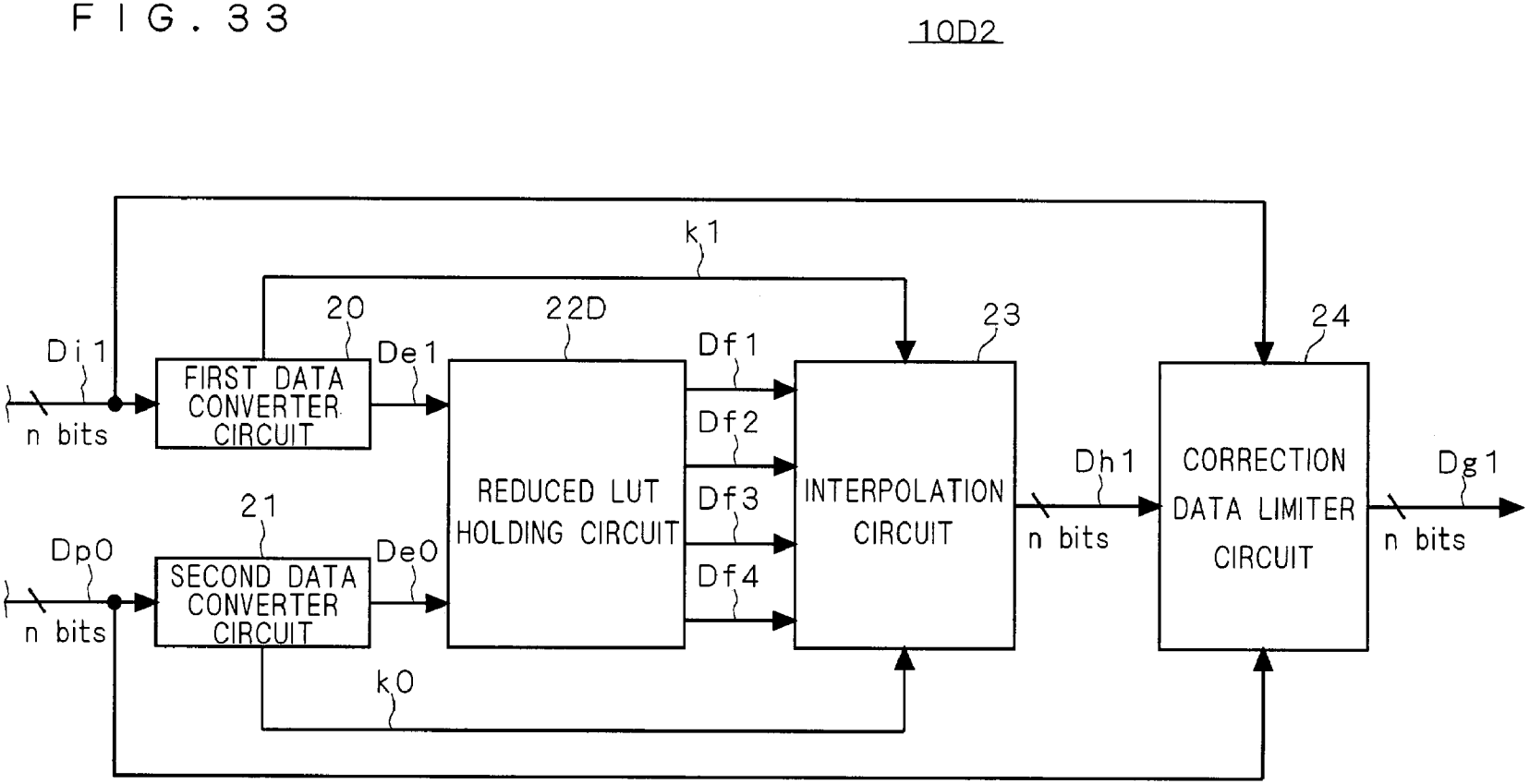
FIG. 33 is a block diagram showing an exemplary constitution of an image date correction circuit in accordance with the second variation of the third preferred embodiment.

An image date correction circuit 10D2 of the present variation, as shown in FIG. 33, has the correction data limiter circuit 24 additionally to the constituent elements shown in FIG. 29 (the first data converter circuit 20, the second data converter circuit 21, the reduced LUT holding circuit 22D and the interpolation circuit 23).

The correction data limiter circuit 24 makes a judgment, on the basis of the present image data Di1 and the one-frame preceding reproduced image data Dp0, on whether th present image data Di1 and the one-frame preceding reproduced image data Dp0 are equal to each other or not and limits the interpolated image data Dh1 when these data Di1 and Dp0 are equal to each other. Specifically, the correction data limiter circuit 24 outputs the present image data Di1 itself, instead of the interpolated image data Dh1, as the corrected present image data Dj1. Through this operation, when the present image data Di1 and the one-frame preceding reproduced image data Dp0 are equal to each other (no change in the image), it is possible to eliminate correction error due to reduction in number of bits by the first and second data converter circuits 20 and 21 and interpolation by the interpolation circuit 23.

Also when the difference between the present image data Di1 and the one-frame preceding reproduced image data Dp0 is relatively small, the correction data limiter circuit 24 may output the present image data Di1 itself, instead of the interpolated image data Dh1 outputted from the interpolation circuit 23, as the limited image data Dg1 or may limit the interpolated image data Dh1 so that the amount of correction should be small. More specifically, when the correction data limiter circuit 24 judges that the absolute value of the difference between the present image data Di1 and the one-frame preceding reproduced image data Dp0 is smaller than a predetermined value Sh, the correction data limiter circuit 24 performs an operation expressed by the following equations (8) and (9) to limit the interpolated image data Dh1 to an appropriate value;

$$Dg1=Di1+m\times(Dh1-Di1) \tag{8}$$

$$m=f(Sh-|Di1-Dp0|) \tag{9}$$

where f(Sh−|Di1−Dp0|) is any function of (Sh−|Di1−Dp0|)

This function may be a linear function or high-order function and can be determined as appropriate so that the display image should not be unnatural when the luminance value changes near a boundary of the predetermined value Sh. The predetermined value Sh depends on the number of bits reduced by the first and second data converter circuits 20 and 21, the interpolation method executed by the interpolation circuit 23 or the like, but can be determined to be an optimum value as appropriate in advance so that the display image should not be unnatural.

Thus, on the basis of the present image data Di1 and the one-frame preceding reproduced image data Dp0, by not performing the correction of the present image data Di1 or outputting the limited image data Dg1 which is obtained by limiting the interpolated image data generated in the corrected image data interpolating step St9 so that the amount of correction should be small, it is possible to eliminate the correction error of the image data due to reduction in number of bits by the first and second data converter circuits 20 and 21 and interpolation by the interpolation circuit 23 and reduce deterioration of the display image due to unnecessary correction when the difference between the one-frame preceding image and the present image is scarcely present or very small.

The Fourth Preferred Embodiment

It is an object of the fourth preferred embodiment to more appropriately control the response speed of the liquid crystal by appropriately setting a compressive coding parameter in an image data processing device for a liquid crystal display device which compressively codes and decodes the present image and then performs an image processing. With reference to figures, an example of the fourth preferred embodiment will be discussed below. First, a constitution of the image data processing unit for the liquid crystal display device of the fourth preferred embodiment will be discussed, and then a compressive coding operation using FBTC which is an essential part of the fourth preferred embodiment will be discussed.

Figure 34:
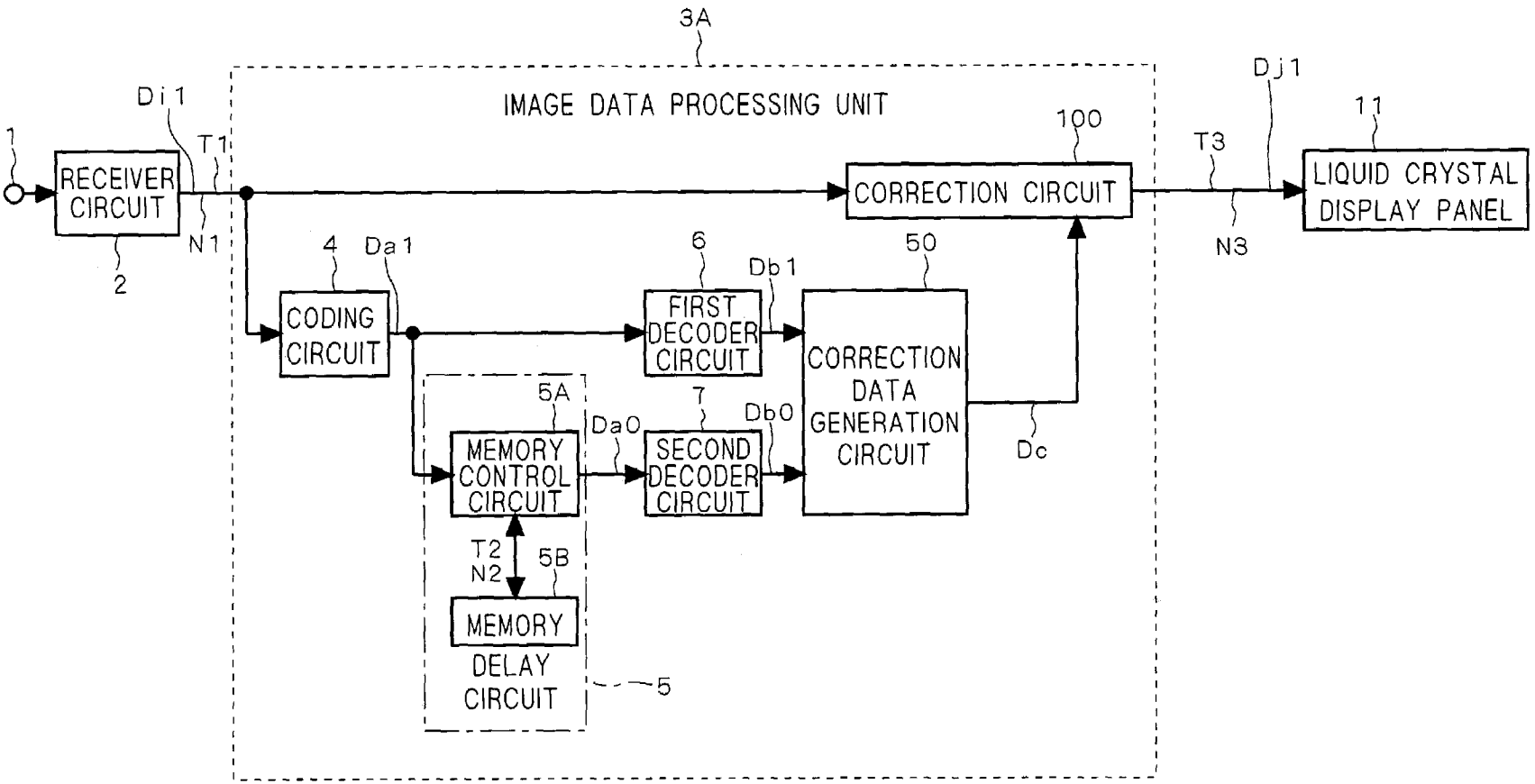
FIG. 34 is a block diagram showing an exemplary constitution of a liquid crystal display device in accordance with a fourth preferred embodiment.

FIG. 34 is a block diagram showing an exemplary constitution of a liquid crystal display device in accordance with the fourth preferred embodiment. In comparison between the liquid crystal display device of FIG. 34 and that of FIG. 1, the constituent elements 1, 2, 4, 5, 6, 7 and 11 are common to these liquid crystal display devices. Accordingly, also in this preferred embodiment, the discussion on the elements 1, 2, 4, 5, 6, 7 and 11 in the first preferred embodiment is basically used. The difference between these liquid crystal display devices lies in that the liquid crystal display device of this preferred embodiment has constituent elements 50 and 100. Specifically, the liquid crystal display device of the fourth preferred embodiment consists of the input terminal 1, the receiver circuit 2, a image data processing unit 3A and the liquid crystal display panel 11, and the image data processing unit 3A which is an essential part of this preferred embodiment has the coding circuit 4, the delay circuit 5 including a memory control circuit 5A and a memory 5B, the first decoder circuit 6, the second decoder circuit 7, a correction data generation circuit 50 and a correction circuit 100.

The receiver circuit 2 outputs a raster moving image signal received by the input terminal 1 to the image data processing unit 3A as the present image data Di1 of digital format at the number of transmission bits N1 per unit time (e.g., one clock). In this case, a time required for the image data processing unit 3A to receive the present image data Di1 of one frame is defined as a receiving time T1. The image data processing unit 3A corrects a tone of the present image data Di1, to increase a tone change speed of a display image in the liquid crystal display panel 11. At this time, the image data processing unit 3A outputs the corrected present image data Dj1 to the liquid crystal display panel 11 at the number of transmission bits N3 per unit time. Herein, a time required for the image data processing unit 3A to output all the present image data Dj1 of one frame is defined as an output time T3. In particular, the image data processing unit 3A has an advantage of canceling out errors caused by the compressive coding operation through the decoding operations by the first and second decoder circuits 6 and 7, to reduce the errors.

The memory control circuit 5A included in the delay circuit 5 of the image data processing unit 3A has (i) a first temporary storage region for temporarily storing compressively-coded image data Da1 to be written into the memory 5B and (ii) a second temporary storage region for temporarily storing compressively-coded image data corresponding to an image preceding the present image by one frame which is read out from the memory 5B.

Herein, the number of bits of data transmitted between the memory control circuit 5A and the memory 5B per unit time is represented by N2. Accordingly, the number of transmission data bits N2 is the sum of the amount of data that the memory control circuit 5A outputs to the memory 5B per unit time and the amount of data that the memory control circuit 5A reads out from the memory 5B per unit time.

Further, a time required for the memory control circuit 5A to output all the compressively-coded image data Da1 of one frame to the memory 5B and a time required for the memory control circuit 5A to read all the compressively-coded image data of one frame which are delayed by a period corresponding to one frame out from the memory 5B are equal to each other, and this time is defined as T2.

Alternatively, there may be a construction where the coding circuit 4 has a temporary storage region for temporarily storing the compressively-coded image data to be written into the memory 5B and the second decoder circuit 7 has a temporary storage region for temporarily storing one-frame preceding compressively-coded image data outputted from the memory control circuit 5A. In this case, however, the sum of the amount of data that the coding circuit 4 outputs to the memory 5B through the memory control circuit 5A and the amount of data that the second decoder circuit 7 reads out from the memory 5B through the memory control circuit 5A, is the number of transmission data bits N2. Moreover, in this case, a time required for the coding circuit 4 to output all the compressively-coded image data Da1 of one frame to the memory 5B through the memory control circuit 5A and a time required for the second decoder circuit 7 to read all the compressively-coded image data of one frame which are delayed by a period corresponding to one frame out from the memory 5B through the memory control circuit 5A are equal to each other, and this time is the above time T2.

Figure 35:
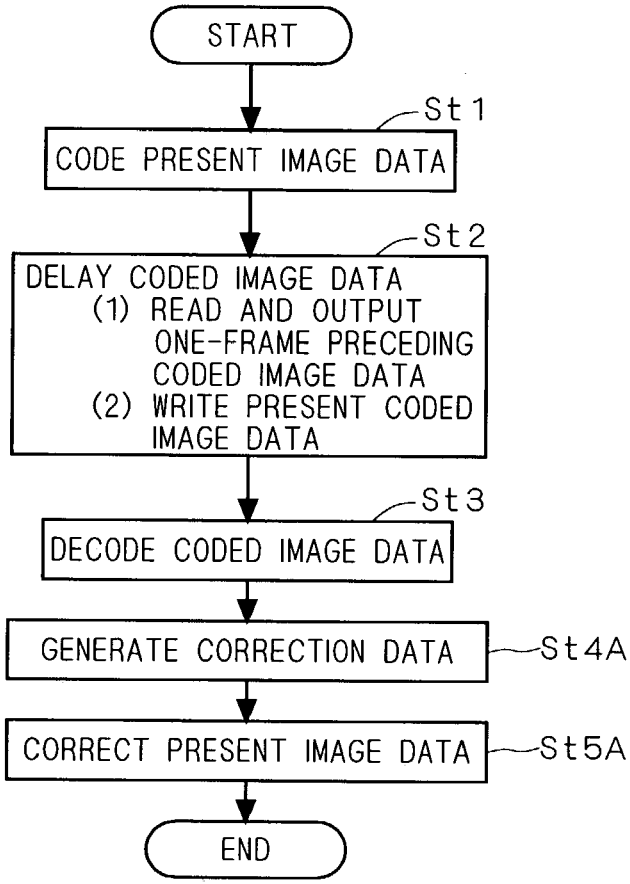
FIG. 35 is a flowchart showing an operation of an image data processing circuit in accordance with the fourth preferred embodiment.

FIG. 35 is a flowchart showing an operation of the image data processing unit 3A of FIG. 34, which is a process view corresponding to FIG. 2. In comparison between FIGS. 35 and 2, as is clear, Steps St1 to St3 are common to the fourth and first preferred embodiments and Steps St4A and St5A are steps different from the corresponding steps in the first preferred embodiment.

Specifically, the present image data coding step St1 is a step, using the operation of the coding circuit 4, to compressively code the present image data Di1 and output the compressively-coded image data Da1 whose data capacity is compressed. Next, the coded image data delaying step St2 is a step, using the operations of the memory control circuit 5A and the memory 5B, to (i) read the compressively-coded image data Da0 obtained by compressively coding an image of a pixel preceding the present image of the pixel by the one frame period and output the compressively-coded image data Da0 to the second decoder circuit 7, and (ii) write the received compressively-coded image data Da1 of the present image into the memory 5B for delaying the compressively-coded image data Da1 by a period corresponding to one frame. The coded image data decoding step St3 is a step to decode these compressively-coded image data Da1 and Da0 and output the decoded image date Db1 and Db0 which are obtained by decoding.

The correction data generating step St4A is a step, using the correction data generation circuit 50, to generate correction data Dc to be used for correcting the present image data Di1 on the basis of the first and second decoded image date Db1 and Db0.

Further, the present image data correcting step St5A is a step, using the correction circuit 100, to correct the present image data Di1 on the basis of the correction data Dc and output the corrected present image data Dj1 to the liquid crystal display panel 11.

The operations in Steps St1 to St5 are performed on the present image data Di1 frame by frame. The image data processing unit 3A will be described in detail below.

The coding circuit 4 codes the present image data Di1 to compress the data capacity thereof and then transmits the compressively-coded image data Da1 to the memory control circuit 5A and the first decoder circuit 6. Herein, this coding operation of the present image data Di1 in the coding circuit 4 is performed by using, e.g., two-dimensional discrete cosine transform coding such as JPEG, block truncation coding such as FBTC and GBTC, predictive coding such as FPEG-LS or wavelet transform such as JPEG2000. In short, the coding operation is performed by using any still picture coding system. As the coding method for still picture, both a reversible coding system in which uncoded image data and decoded image data completely coincide with each other and an irreversible coding system in which these image data do not completely coincide can be used. Further, both a variable length coding system in which the amount of codes vary by image data and a fixed length coding system in which the amount of codes is constant can be used.

The memory control circuit 5A, in response to reception of the compressively-coded image data Da1 transmitted from the coding circuit 4, (i) reads the compressively-coded image data Da0 corresponding to the one-frame preceding image of the pixel from the corresponding address in the memory 5B (this compressively-coded image data corresponds to compressively-coded image data delayed behind the present image by a period corresponding to one frame) and transmits the read compressively-coded image data Da0 to the second decoder circuit 7, and (ii) outputs the compressively-coded image data Da1 of the present image to the memory 5B to store this data Da1 at a predetermined address of the memory 5B. At this time, the number of bits of data transmitted between the memory control circuit 5A and the memory 5B per unit time is N2. Therefore, the number of transmission data bits N2 is the sum of the capacity of data outputted from the memory control circuit 5A per unit time and the capacity of data read out from the memory 5B per unit time. For example, when the unit time is the one frame period, the amount of data written into the memory 5B from the memory control circuit 5A per unit time and the amount of data read out from the memory 5B to the memory control circuit 5A per unit time are equal to each other. Since an actual device is constructed so that write of data and read of data are performed at the same time or independently from each other, however, these amounts of data are not necessarily equal to each other within a local time (e.g., within one clock).

A time required to output all the compressively-coded image data Da1 of one frame from the memory control circuit 5A to the memory 5B and a time required to read all the compressively-coded image data Da0 of one frame out from the memory 5B to the memory control circuit 5A are equal to each other and these times are each T2.

The memory 5B has a function of performing write and read operations at the same time or a function of performing write and read operations independently from each other.

The first decoder circuit 6 decodes the compressively-coded image data Da1 and transmits the first decoded image data Db1 to the correction data generation circuit 50. At the same time, the second decoder circuit 7 decodes the compressively-coded image data Da0 transmitted from the memory control circuit 5A and transmits the second decoded image data Db0 obtained as the result of this decoding to the correction data generation circuit 50. The first decoded image data Db1 corresponds to the present image data Di1 and the second decoded image data Db0 corresponds to the image data preceding the present image data Di1 by one frame.

The correction data generation circuit 50 compares the first number of tones indicated by the first decoded image data Db1 with the second number of tones indicated by the second decoded image data Db0 which is one-frame preceding data by the corresponding pixel (positioned on the same coordinate) to generate the correction data Dc corresponding to a change in number of tones of each pixel and outputs the correction data Dc to the correction circuit 100. The correction data Dc is a signal to correct the present image data Di1 pixel by pixel. Specifically, the correction data Dc is (i) a signal to give a first amount of correction for increasing the number of tones (the number of tones of the present image data) with respect to a pixel whose number of tones is larger than that of the one-frame preceding image (a pixel which becomes brighter) (when the first number of tones>the second number of tones), and on the other hand, (ii) a signal to give a second amount of correction for decreasing the number of tones with respect to a pixel whose number of tones is smaller than that of the one-frame preceding image (a pixel which becomes darker) (when the first number of tones<the second number of tones). When there is no change in number of tones (brightness) between the present image and the one-frame preceding image with respect to a certain pixel in one frame, the correction data Dc is a signal having a level commanding not to increase nor decrease the number of tones of the present image data of the pixel, and as a result, correction in number of tones of the pixel is not performed.

As a specific example, the correction data generation circuit 50 is formed of a look-up table (LUT) which stores the correction data indicating the amount of correction in correcting the number of tones of the present image data Di1.

Figure 36:
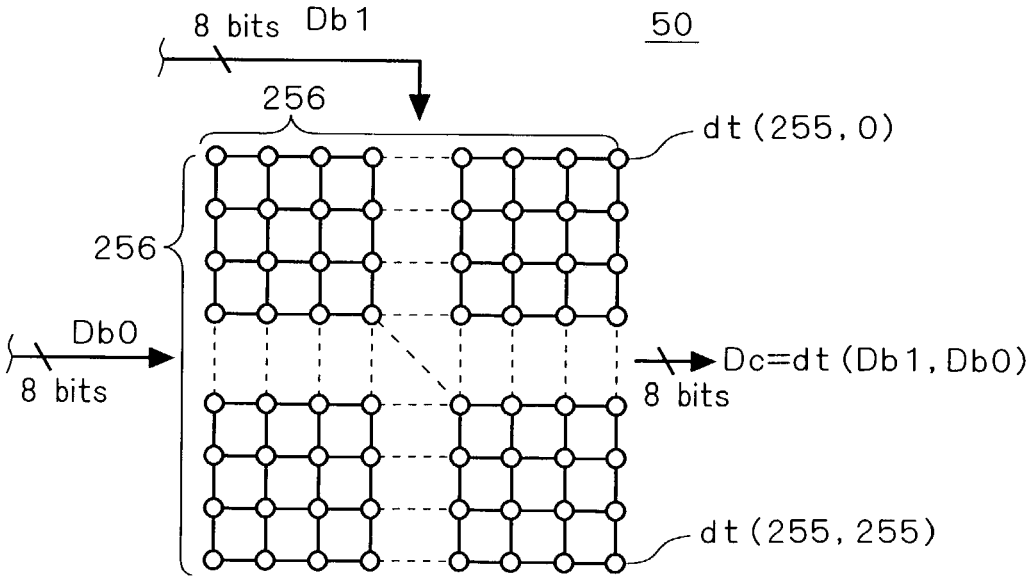
FIG. 36 is a view showing an LUT in a correction data generation circuit in accordance with the fourth preferred embodiment.

FIG. 36 is a view showing input/output data of the correction data generation circuit 50, and specifically, look-up table data in a case where the first and second decoded image date Db1 and Db0 are each image data of 8 bits (256 tones). In an example of FIG. 36, the correction data generation circuit 50 is formed as a look-up table of two-dimensional arrangement, having 256×256 correction data corresponding to the tones (0 to 255) of the pixel data in the first and second decoded image date Db1 and Db0. Therefore, the correction data generation circuit 50 outputs correction data Dc=dt (Db1, Db0) on the basis of combination of the first and second decoded image date Db1 and Db0.

Each correction data dt (Db1, Db0) stored in the correction data generation circuit 50 indicates the amount of correction to so correct the number of tones of the present image data Di1 pixel by pixel as to increase the number of tones of the pixel among the pixel data indicated by the present image data Di1 whose number of tones is larger than that of the one-frame preceding image and as to decrease the number of tones of the pixel whose number of tones is smaller than that of the one-frame preceding image. Therefore, with respect to the pixel whose tone is not changed between the image of the present frame and the one-frame preceding image, the correction data dt (Db1, Db0) is zero.

The correction data generation circuit 50 outputs the correction data Dc for each pixel to the correction circuit 100 as shown in FIG. 34. The correction circuit 100 consequently corrects the number of tones of the present invention Di1 pixel by pixel on the basis of the present image data Di1 and the correction data Dc and outputs the corrected present image data Dj1 to the liquid crystal display panel 11. At this time, the corrected present image data Dj1 is determined so that the transmittance of the corresponding display pixel in the liquid crystal which is achieved by the liquid crystal application voltage generated by the liquid crystal display panel 11 on the basis of the corrected present image data Dj1 should reach the first transmittance corresponding to the first number of tones of the present image data Di1 of the pixel after the one frame period passes. The driver (not shown) in the liquid crystal display panel 11 determines a voltage to drive the corresponding segment electrode on the basis of the corrected present image data Dj1, and applying the driving voltage, the liquid crystal display panel 11 performs a display operation giving the first number of tones.

When the time T2 required to transmit the compressively-coded image data between the memory control circuit 5A and the memory 5B exceeds a delay time of one frame, the time T2 lags behind the time T1 required for the image data processing unit 3A to receive all the present image data Di1 of one frame and this causes a need for timing control by any other method. Therefore, the time T2 must be determined to fall within the delay time period of one frame.

The data capacity required to display one pixel in a liquid crystal display is, generally, the sum of 8 bits for displaying red (hereinafter, referred to as "R"), 8 bits for displaying green (hereinafter, referred to as "G") and 8 bits for displaying blue (hereinafter, referred to as "B"), i.e., 24 bits. Further, the width of a bus required to transmit the data between the memory control circuit 5A and the memory 5B is generally set to be $2^n$ bits in most cases and for example, the width of the bus has a size of any one of 8 bits, 16 bits and 32 bits. The width of the bus, however, is not limited to these values.

Herein, a case where the second capacity of the compressively-coded image data Da1 is equal to the first capacity of the present image data Di1 will be discussed. In this case, the amount of data outputted from the memory control circuit 5A to the memory 5B is 24 bits within a time period while the present image data Di1 for one pixel is received and on the other hand, the amount of data read out from the memory 5B to the memory control circuit 5A is also 24 bits, and the sum of the amount of data transmitted between the memory control circuit 5A and the memory 5B is 48 bits.

Since the memory 5B has a function of performing write and read operations at the same time or independently from each other, if the width of the bus which connects the memory control circuit 5A and the memory 5B does not have capacity of 48 bits or more, the time T2 required to transmit data between the memory control circuit 5A and the memory 5B is larger than the delay time period of one frame. The width of the bus which connects the memory control circuit 5A and the memory 5B is, however, 32 bits at the maximum. Therefore, it is impossible to control the time T2 within the delay time period of one frame unless the sum of the amount of data outputted from the memory control circuit 5A to the memory 5B and the amount of data read out from the memory 5B to the memory control circuit 5A (i.e., data of 48 bits) within the time period while the present image data Di1 for one pixel is received is controlled not to exceed 32 bits.

Then, the coding circuit 4 has to perform compressive coding of the present image data Di1 so that the data capacity of the compressively-coded image data Da1 (second capacity) should not be over $32/48=2/3$ of the data capacity of the present image data Di1 (first capacity).

Further, when the data capacity of the compressively-coded image data Da1 is compressed to not over ⅔ of that of the present image data Di1, for example, to ½, the amount of data outputted from the memory control circuit 5A to the memory 5B and the amount of data read out from the memory 5B to the memory control circuit 5A within the time period while the present image data Di1 for one pixel is received are each 24 bits, and there remains an unused region of 8 (32−24) bits. Using the capacity of 8 bits, it is possible to output information other than the image data from the memory control circuit 5A to the memory 5B and read the information out from the memory 5B.

When data is read or written between the memory control circuit 5A and the memory 5B in a unit of 32 bits, the write and read operations between the memory control circuit 5A and the memory 5B are not performed for ⅓ of the one frame period in the one frame period. Using this period, it is possible to output information other than the image data from the memory control circuit 5A to the memory 5B and read the information out from the memory 5B.

Discussion will be made below on a case where the compressive coding operation of the present image data Di1 is performed so that the second capacity of the compressively-coded image data Da1 should not be over ½ of the first capacity of the present image data Di1 when the width of the bus which connects the memory control circuit 5A and the memory 5B is 32 bits.

FIGS. 37A to 37C and 38A to 38C are views showing an outline of the compressive coding operation in a case where the coding circuit 4 uses, e.g., FBTC. Among these figures, FIG. 37A is a view showing part of the present image data Di1, FIG. 37B is a view showing one block among the present image data Di1 of FIG. 37A and FIG. 37C is a view showing the data capacity of the data of the one block of FIG. 37B after the compressive coding operation using FBTC. FIG. 38A is a view showing the present image data of each pixel, FIG. 38B is a view showing a state after compressively coding the data of FIG. 38A and FIG. 38C is a view showing the data of each pixel after decoding the data of FIG. 38B.

The FBTC (Fixed Block Truncation coding) is a kind of block truncation coding, which is an irreversible coding system in which uncoded image data and decoded image data do not completely coincide with each other and a fixed length coding system in which the amount of codes is constant.

In the coding method using FBTC, first, an image is divided into a plurality of blocks each having a size of the horizontal number of pixels×the vertical number of pixels. Next, in each block, on the basis of an average value and a range value of image data included in the block, the image data is quantized into number level and compressed, to obtain coded data. The coded data includes the average value, the range value and a quantized value of each pixel. As a decoding method, on the basis of the average value and the range value, a typical value corresponding to the quantized value in each level is calculated to decode the image data.

Further, in the FBTC, the data capacity after compressive coding is determined, as shown in FIGS. 37A, 37B and 37C, depending on (1) a horizontal block size BH, (2) a vertical block size BV, (3) the number of bits bpa allocated to an average value La, (4) the number of bits bpd allocated to a dynamic range value Ld and (5) data capacity allocated to each pixel which is determined by quantization level QL.

A four-level compressive coding will be discussed as a specific example of the FBTC. In the four-level compression, the quantization level QL is four. First, as shown in FIG. 37A, the present image data is divided into a plurality of blocks. A size of each block is equal to a product of the number of pixels BH in a horizontal direction and the number of pixels BV in a vertical direction. FIG. 37B shows a state of the present image data which is thus divided into blocks.

Next, the following operation is performed block by block. First, out of the pixel signals in each block, a pixel signal of a maximum value and a pixel signal of a minimum value in the block are obtained. Next, a section from the minimum value to the maximum value is equally divided into four, and the minimum value, ((the minimum value)×3+(the maximum value))/4, (the minimum value+the maximum value)/2, ((the minimum value)+(the maximum value)×3)/4 and the maximum value are obtained. Further, an average value Q1 of the pixel signals in the section from the minimum value to ((the minimum value)×3+(the maximum value))/4 and an average value Q4 of the pixel signals in the section from ((the minimum value)+(the maximum value)×3)/4 to the maximum value are obtained. Then, from the average values Q1 and Q4, the range value Ld=Q4−Q1 and the average value La=(Q1+Q4)/2 are obtained. Finally, quantization threshold values La−Ld/3, La, La+Ld/3 are obtained, and each pixel signal is thereby quantized into four values.

In the case of four-level compression (QL=4), the data capacity allocated to each pixel is 2 bits. Therefore, the data capacity after compression by the four-level compressing method is bpa+bpd+((QL/2)×(BH×BV)).

The typical values in the case of decoding the compressed data are La−Ld/2, La−Ld/6, La+Ld/6 and La+Ld/2.

Assuming that BH=4 and BV=4, for example, a case where each pixel has data shown in FIG. 38A will be discussed. In FIG. 38A, the maximum value is 240, the minimum value is 10, ((the minimum value)×3+(the maximum value))/4 is 67, (the minimum value+the maximum value)/2 is 125, and ((the minimum value)+(the maximum value)×3)/4 is 182. The average value Q1 is 40, the average value Q4 is 210, the range value Ld is Q4−Q1=170, and the average value La is (Q1+Q4)/2=125. Finally, The quantization threshold values are La−Ld/3=69, La=125, and La+Ld/3=181. FIG. 38B is a view showing a state after compressive coding in this case. The data after compressive coding indicates 00 with respect to both a pixel whose image data indicates 10 and a pixel whose image data indicates 50, the data after compressive coding indicates 01 with respect to a pixel whose image data indicates 100, the data after compressive coding indicates 10 with respect to a pixel whose image data indicates 150, and the data after compressive coding indicates 11 with respect to a pixel whose image data indicates 200 or 240. When decoding is performed on data in the state after compressive coding shown in FIG. 38B, a state of FIG. 38C is obtained. In this case, the typical values are La−Ld/2=40, La−Ld/6=99, La+Ld/6=151 and La+Ld/2=210.

This four four-level compression is an example of FBTC, a binary compression and three-level compression are also performed by basically the same operation as in the four-level compression. Further, as a specific coding method, methods other than the above may be used.

Figure 39A:
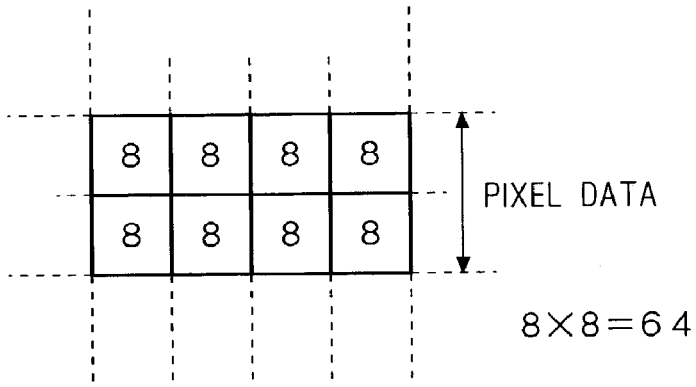
FIGS. 39A and 39B are views showing the compressive coding operation in accordance with the fourth preferred embodiment.
Figure 39A:
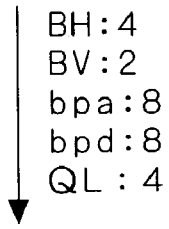
Figure 39B:
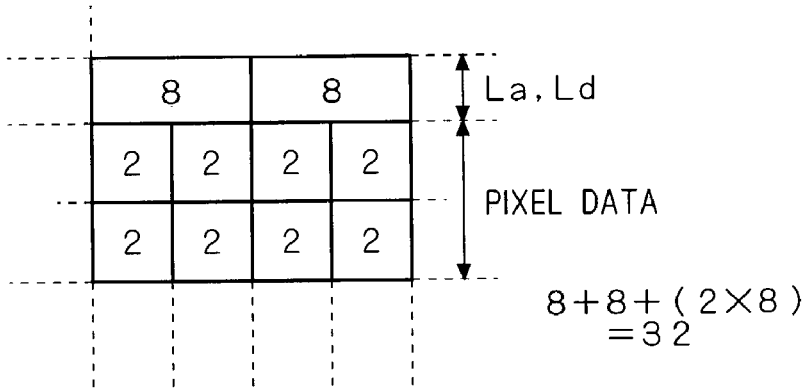

FIGS. 39A and 39B are views showing an example of generation of the compressively-coded image data using FBTC parameters. Further, FIGS. 39A and 39B show a case of processing data used to display a single color, e.g., R (red) (hereinafter, referred to as "R data", similarly data used to display G and, B are referred to as "G dada" and "B data", respectively). As a matter of course, with respect to the G data and the B data, the same processing is performed. Herein, discussing an operation on only R data, the data capacity allocated to each pixel is 8 bits.

FIG. 39A is a view showing the data capacity in one block of the present image data Di1 by the number of bits. FIG. 39B is a view showing the data capacity in one block of the compressively-coded image data Da1 by the number of bits. As the FBTC parameters, BH=4, BV=2, bpa=8, bpd=8 and QL=4 are set.

In this case, the data capacity of one block of the present image data Di1 is 8×(4×2)=64 bits. On the other hand, the data capacity of one block of the compressively-coded image data Da1 is 8+8+(2×(4×2))=32 bits. Specifically, when the above parameters are used, the amount of the compressively-coded image data Da1 becomes ½ of the amount of the present image data Di1. Therefore, the amount of data outputted from the memory control circuit 5A to the memory 5B and the amount of data read out from the memory 5B to the memory control circuit 5A are each ½ of the amount of the present image data Di1, and the number of data bits N2 shown in FIG. 34 can be made equal to the number of data bits N1. Therefore, since it is possible to make the time T2 equal to the time T1 without increasing the data transmission speed between the memory control circuit 5A and the memory 5B, the image data processing unit 3A can be constructed so that the memory control circuit 5A should output the compressively-coded image data Da0 to the memory 5B and should read the compressively-coded image data Da0 delayed by a period corresponding to one frame out from the memory 5B during the time period T1.

Though the case where the FBTC is performed by the coding circuit 4 using the FBTC parameters shown in FIGS. 39A and 39B has been discussed above as an example, the parameter values are not limited to the above. When BH=2, BV=2, bpa=6, bpd=6 and QL=2, for example, the data capacity of the compressively-coded image data Da1 is 6+6+(1×(2×2))=16 bits and this is ½ of the data capacity of one block of the present image data Di1 which is 8×(2×2)=32 bits. In short, it is important that the data capacity of the compressively-coded image data Da1 should be set not over ½ of the data capacity of the present image data Di1, and only if this is achieved, any combination of the FBTC parameters may be used. As a matter of course, methods other than the FBTC is used for compressive coding.

As discussed above, the compressive coding parameters used in the coding circuit 4 are set on the basis of the first capacity of the inputted image data (present image data Di1) and the second capacity of the compressively-coded image data Da1 for the inputted image data.

Effects of the Fourth Preferred Embodiment

In the fourth preferred embodiment, since the data capacity of the compressively-coded image data Da1 in the coding circuit 4 is controlled to be ½ of the data capacity of the present image data Di1, the time T2 required for data transmission between the memory control circuit 5A and the memory 5B does not lag behind the time T1 required for the image data processing unit 3A to receive the present image data Di1 of one frame and input the data therein and the number of bits N2 of data transmitted between the memory control circuit 5A and the memory 5B can be set to be equal to the number of transmission bits N1 of the inputted data.

Moreover, since the data capacity of the compressively-coded image data Da1 in the coding circuit 4 is set to be ½ of the data capacity of the present image data Di1, it is possible to reduce the memory capacity of the memory 5B required to delay the present image data Di1 by the one frame period and further reduce the circuit scale since it is not necessary to increase the data transmission speed between the memory control circuit 5A and the memory 5B.

Further, since the data capacity is compressed by compressive coding without skipping the present image data Di1, it is advantageously possible to increase the accuracy of the correction data Dc and thereby always perform an optimal correction.

Furthermore, since the decoded image date Db1 and Db0 are used to generate the correction data Dc, the uncoded and undecoded present image data Di1 is corrected on the basis of the generated correction data Dc and a display is performed on the basis of the corrected present image data Dj1, advantageously, the display image has no effect of the errors due to the coding and decoding operations.

The First Variation of the Fourth Preferred Embodiment

In the fourth preferred embodiment, the case where the data capacity of the compressively-coded image data Da1 in the coding circuit 4 is controlled to be not over ½ of the data capacity of the present image data Di1 is disclosed. In contrast to this, the first variation of the fourth preferred embodiment achieves the compressively-coded image data Da1 having the second capacity which is not over ⅓ of the first capacity of the present image data Di1 by controlling the compressive coding parameters. Therefore, in the following discussion of the present variation, the circuit block diagram of FIG. 34 is used.

In the fourth preferred embodiment, the width of the bus which connects the memory control circuit 5A and the memory 5B is 32 bits. On the other hand, when the data capacity of the compressively-coded image data Da1 is set to ⅓ of the data capacity of the present image data Di1, the sum of the amount of data outputted from the memory control circuit 5A to the memory 5B and the amount of data read out from the memory 5B to the memory control circuit 5A within the time period while the present image data Di1 for one pixel is received is 48×(⅓)=16 bits, and a bus having a width of 16 bits can be used as the bus for connecting the memory control circuit 5A and the memory 5B. Naturally, a bus having a width of 32 bits can be also used.

Figure 40A:
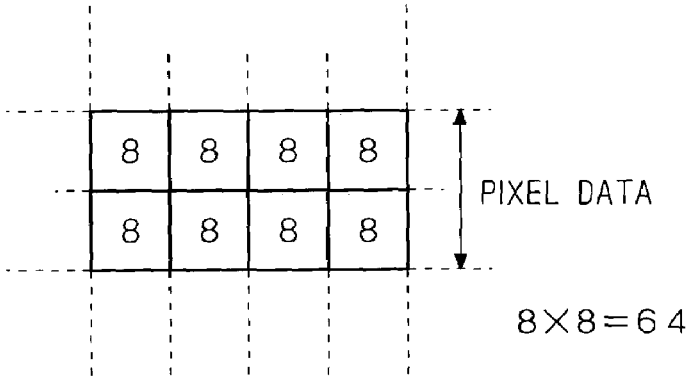
FIGS. 40A and 40B are views showing a compressive coding operation in accordance with a first variation of the fourth preferred embodiment.
Figure 40A:
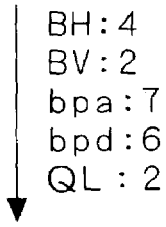
Figure 40B:
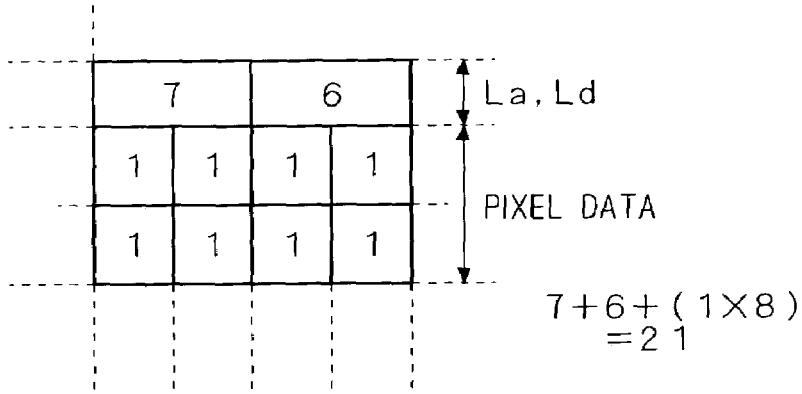

FIGS. 40A and 40B are views showing an setting example of the FBTC parameters where BH=4, BV=2, La=7, Ld=6 and QL=2. In the present variation, like in the fourth preferred embodiment, the case where only a single color, e.g., R data is processed will be discussed, where the data capacity allocated to each pixel is 8 bits. FIG. 40A is a view showing the data capacity of the respective present image data Di1 in one block by the number of bits. FIG. 40B is a view showing the data capacity of the respective compressively-coded image data Da1 in one block by the number of bits.

In this case, the data capacity in one block of the present image data Di1 is 8×(4×2)=64 bits. On the other hand, the data capacity in one block of the compressively-coded image data Da1 is 7+6+(1×(4×2))=21 bits.

Therefore, when the above parameters are used, the data capacity of the compressively-coded image data Da1 is made not over ⅓ of the data capacity of the present image data Di1. In other words, when the above parameters are used, the amount of the compressively-coded image data Da1 is made not over ⅓ of the amount of the present image data Di1. Accordingly, the amount of data outputted from the memory control circuit 5A to the memory 5B and the amount of data read out from the memory 5B to the memory control circuit 5A are each ⅓ of the amount of data of the present image data Di1, and the number of data bits N2 shown in FIG. 34 can be made (N1/3)×2. Therefore, it is possible to make the time T2 equal to the time T1 without increasing the data transmission speed between the memory control circuit 5A and the memory 5B. As a result, the memory control circuit 5A outputs the compressively-coded image data Da0 to the memory 5B and reads the compressively-coded image data Da0 delayed by a period corresponding to one frame out from the memory 5B while the time T1 passes.

Though the case where the FBTC is performed by the coding circuit 4 using the FBTC parameters shown in FIGS. 40A and 40B has been discussed above as an example, it is natural that the parameter values of the present variation are not limited to the above one example. When BH=4, BV=4, bpa=8, bpd=8 and QL=3, for example, the data capacity of the compressively-coded image data Da1 is 8+8+((16/5)×8+2)=42 bits and this is not over ⅓ of the data capacity in one block of the present image data Di1 which is 8×(4×4)=128 bits (where the fractional portion in 16/5 is dropped). In short, only if the data capacity of the compressively-coded image data Da1 is set not over ⅓ of the data capacity of the present image data Di1, any combination of the FBTC parameters may be used. As a matter of course, methods other than the FBTC is used as the compressive coding.

Effects of the First Variation of the Fourth Preferred Embodiment

As discussed above, in the present variation, since the data capacity of the compressively-coded image data Da1 in the coding circuit 4 is controlled to be not over ⅓ of the data capacity of the present image data Di1, the time T2 required for data transmission between the memory control circuit 5A and the memory 5B does not lag behind the time T1 required for the image data processing unit 3A to receive all the present image data Di1 of one frame and input the data therein. Therefore, the number of bits N2 of data transmitted between the memory control circuit 5A and the memory 5B can be set to ⅔ of the number of transmission bits N1 of the inputted data.

Moreover, since the data capacity of the compressively-coded image data Da1 in the coding circuit 4 is set to be not over ⅓ of the data capacity of the present image data Di1, it is possible to reduce the memory capacity of the memory 5B required to delay the present image data Di1 by the one frame period and further reduce the circuit scale since it is not necessary to increase the data transmission speed between the memory control circuit 5A and the memory 5B.

Further, when the inputted image is represented by the image data needing 24 bits per pixel, since the sum of the amount of data outputted from the memory control circuit 5A to the memory 5B and the amount of data read out from the memory 5B to the memory control circuit 5A within the time period while the present image data Di1 for one pixel is received is 48×(⅓)=16 bits, a bus having a width of 16 bits can be used as the bus for connecting the memory control circuit 5A and the memory 5B.

The Second Variation of the Fourth Preferred Embodiment

In the second variation of the fourth preferred embodiment, a case where the image data to be compressively coded and then decoded includes (1) data corresponding to a luminance signal and (2) data corresponding to two color difference signals will be discussed. In the fourth preferred embodiment and the first variation thereof, the case where the image data consisting of R data, G data and B data is compressively coded and decoded has been discussed. On the other hand, in the case where the image data to be compressively coded and then decoded includes the data corresponding to the luminance signal and the two color difference signals, by setting different values to (i) a first compressive coding parameter used for processing data Dm1*y* (hereinafter, referred to as "luminance data") corresponding to the luminance signal (Y) and (ii) a second compressive coding parameter used for processing data Dm1*c* (hereinafter, referred to as "color difference data") corresponding to two color difference signals (R−Y, B−Y), it is possible to make the compression ratio for the luminance data and that for the color difference data different from each other.

Since the human vision is more sensitive to luminance than hue (color), the compression ratio of the luminance data Dm1*y* which is more important to the vision is made low in order to avoid loss of data. On the other hand, the compression ratio of the two color difference data Dm1*c* which are less important to the vision is made high. In short, (a first compression ratio for the luminance data Dm1*y*)<(a second compression ratio for the color difference data Dm1*c*). Such a control allows reduction in memory capacity of the memory 5B.

Figure 41:
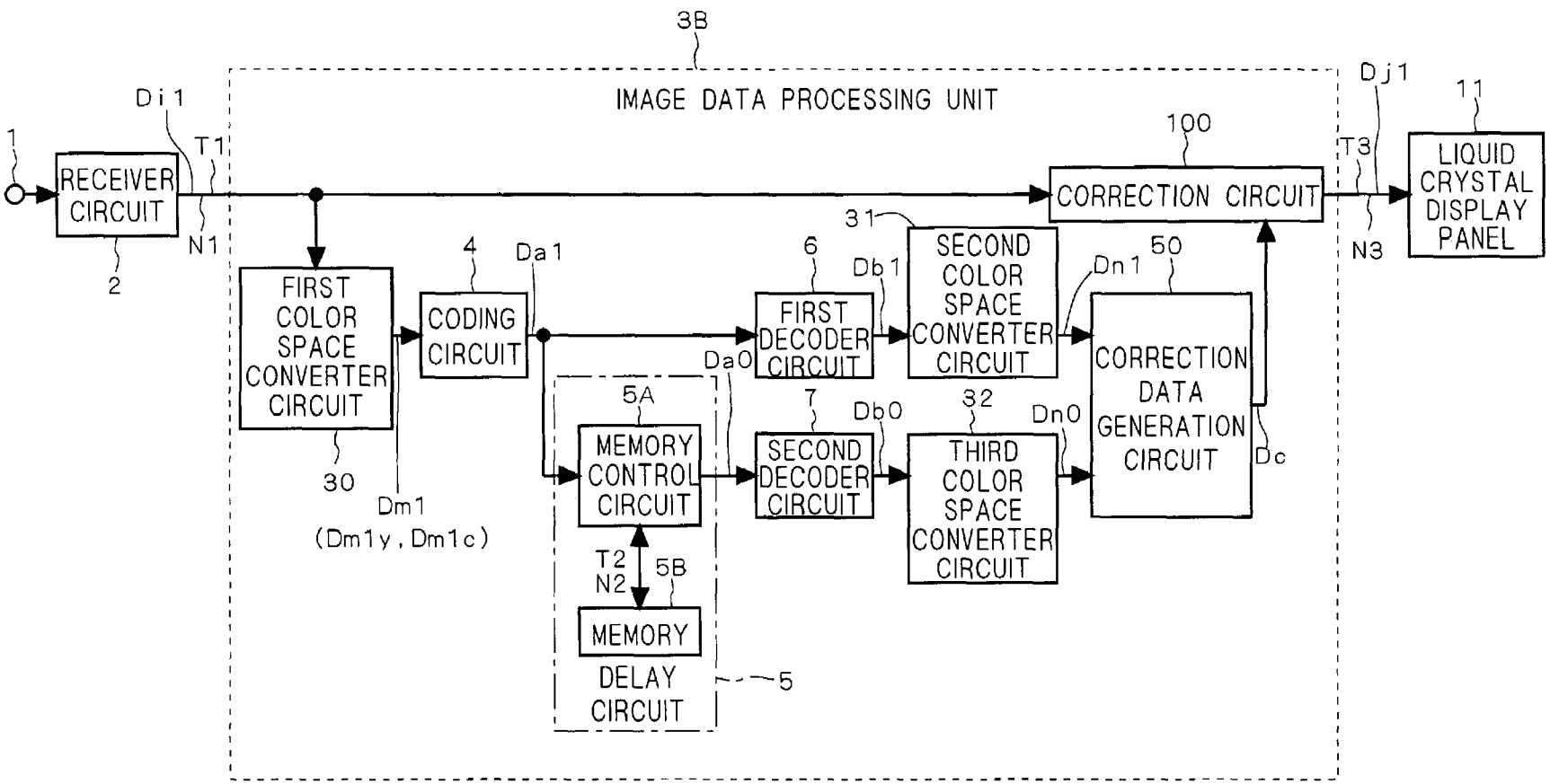
FIG. 41 is a block diagram showing an exemplary constitution of a liquid crystal display device in accordance with a second variation of the fourth preferred embodiment.

FIG. 41 is a block diagram showing an exemplary constitution of a liquid crystal display device in accordance with the second variation of the fourth preferred embodiment. The liquid crystal display device of the present variation has a characteristic feature that a first color space converter circuit 30 converts the present image data Di1 consisting of (first) three-primary-color data, R, G and B, into the luminance data Dm1*y* and the two color difference data Dm1*c* and then the coding circuit 4 having the first compressive coding parameter and the second compressive coding parameter which are equal to or different from each other performs first and second compressive coding operations on the luminance data Dm1*y* and the color difference data Dm1*c*, and in this point, the liquid crystal display device of FIG. 41 is different from that of the fourth preferred embodiment shown in FIG. 34. As viewed from the present image data Di1, the first color space converter circuit 30 and the coding circuit 4 of FIG. 41 broadly constitute a coding circuit for the present image data Di1.

The first color space converter circuit 30 converts the present image data Di1 consisting of the first three-primary-color data, R data, G data and B data, into the luminance data Dm1*y* and the two color difference data Dm1*c* and transmits converted first image data Dm1 (the luminance data Dm1*y* and the color difference data Dm1*c*) to the coding circuit 4.

The coding circuit 4 compressively codes the first image data Dm1 and transmits the compressively-coded image data Da1 to the memory control circuit 5A and the first decoder circuit 6. Specifically, the compressive coding parameter consists of (i) the first compressive coding parameter determined on the basis of the data capacity of the luminance data Dm1*y* and the data capacity of coded luminance data which is obtained by coding the luminance data Dm1*y* and (ii) the second compressive coding parameter determined on the basis of the data capacity of the color difference data Dm1*c* and the data capacity of coded color difference data which is obtained by coding the color difference data Dm1*c*. The coding circuit 4 generates the coded luminance data and the coded color difference data by coding the luminance data Dm1*y* and the color difference data Dm1*c* on the basis of the first compressive coding parameter and the second compressive coding parameter, respectively, and outputs the coded luminance data and the coded color difference data as the coded image data Da1 from its output end.

The first decoded image data Db1 and the second decoded image data Db0 which are decoded by the first decoder circuit 6 and the second decoder circuit 7 are transmitted to a second color space converter circuit 31 and a third color space converter circuit 32, respectively.

The second color space converter circuit 31 and the third color space converter circuit 32 convert the first decoded image data Db1 and the second decoded image data Db0 each made of the luminance data and the two color difference data to second three-primary-color data and third three-primary-color data, respectively, each consisting of R data, G data and B data. The second three-primary-color data Dn1 and the third three-primary-color data Dn0 each consisting of R data, G data and B data which are converted by the second color space converter circuit 31 and the third color space converter circuit 32, respectively, are transmitted to the correction data generation circuit 50. Therefore, as viewed from the correction data generation circuit 50, the first decoder circuit 6 and the second color space converter circuit 31 broadly constitute a first decoder circuit for correction data generation circuit and the second decoder circuit 7 and the third color space converter circuit 32 broadly constitute a second decoder circuit for correction data generation circuit. The operation following that of the correction data generation circuit 50 is the same as discussed in the fourth preferred embodiment.

In the present variation, (i) like in the fourth preferred embodiment, the compressive coding parameter (the first and second compressive coding parameters) in the coding circuit 4 can be determined so that the data capacity of the compressively-coded image data Da1 should be not over ½ of the data capacity of the present image data Di1. Alternatively, (ii) like in the first variation of the fourth preferred embodiment, the compressive coding parameter (the first and second compressive coding parameters) in the coding circuit 4 may be determined so that the data capacity of the compressively-coded image data Da1 should be not over ⅓ of the data capacity of the present image data Di1. Further, (iii) the first compressive coding parameter for the luminance data Dm1*y* and the second compressive coding parameter for the two color difference data Dm1*c* may be different from each other. Furthermore, (iv) naturally, methods other than the FBTC may be used as the compressive coding operation.

A processing of the two color difference data will be discussed below.

Figures 42A, 42B:
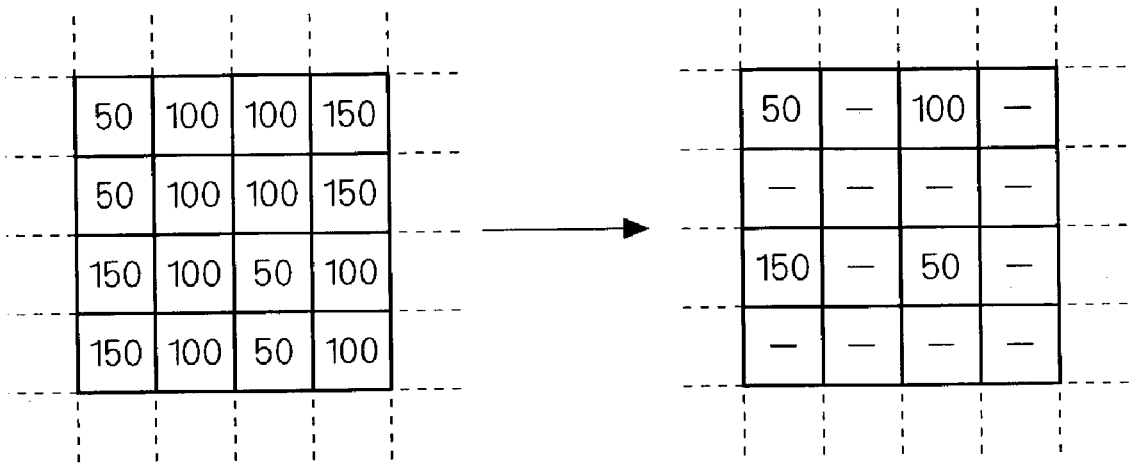
FIGS. 42A and 42B are views showing a skipping operation in accordance with the second variation of the fourth preferred embodiment.
Figure 47:
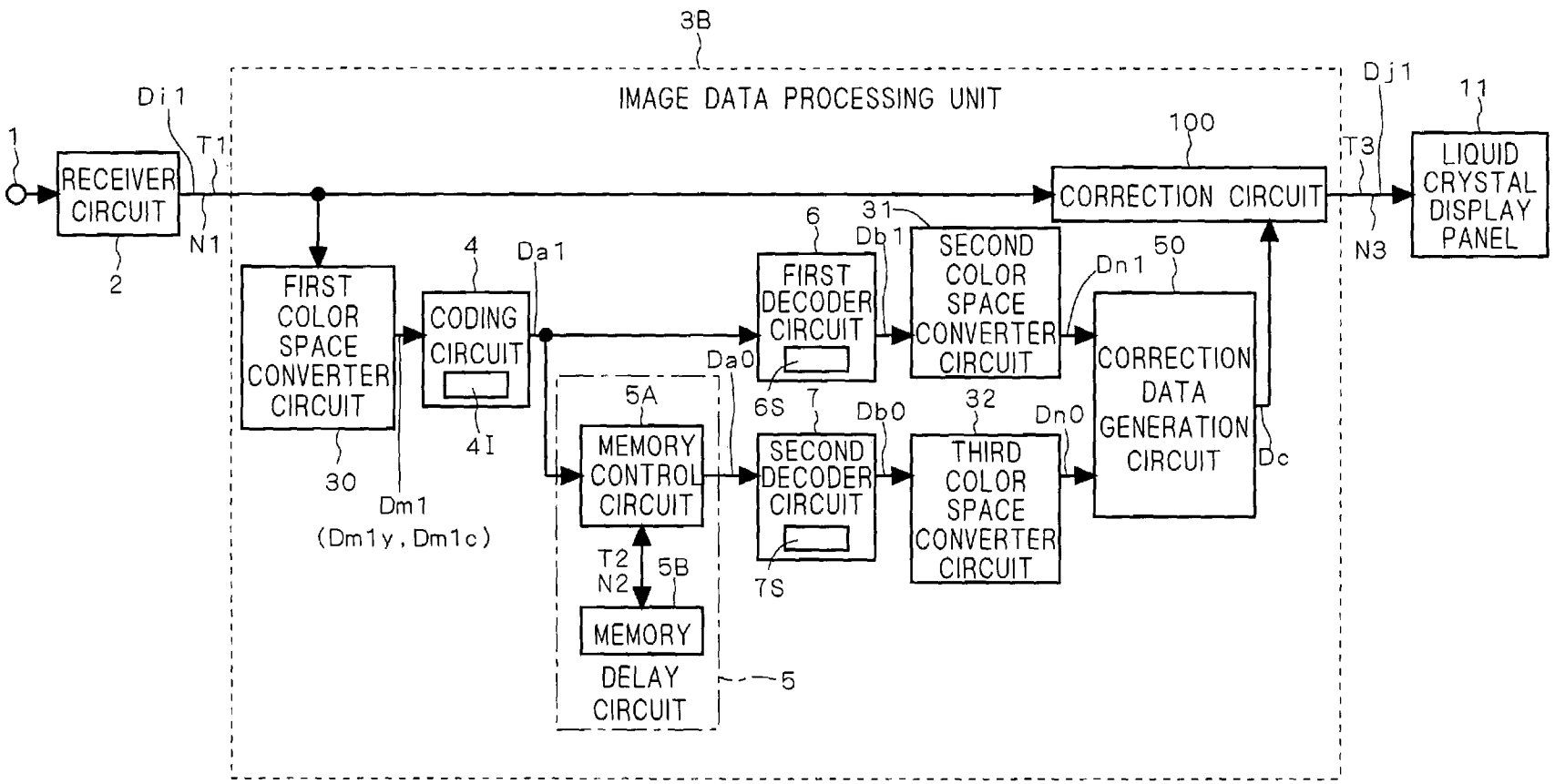
FIG. 47 is a block diagram showing a liquid crystal display device having a color difference data skipping unit and an interpolation circuit.

As mentioned above, the color difference data is less important to the vision than the luminance data. Therefore, after converting the present image data Di1 into the luminance data Dm1*y* and the two color difference data Dm1*c* in the first color space converter circuit 30, in order to reduce the data capacity of the compressively-coded image data Da1, skipping of the color difference data Dm1*c* may be performed before the compressive coding operation in the coding circuit 4. Specifically, the coding circuit 4 comprises a color difference data skipping unit 41 (see FIG. 47) for skipping only the color difference data Dm1*c* in a stage before the second coding operation for the color difference data Dm1*c*. FIGS. 42A and 42B are views showing a skipping operation.

Also in the prior-art invention disclosed in Japanese Patent No. 3041951, the skipping operation is performed. The characteristic feature of the present variation, however, lies in that the skipping operation is performed only on the color difference data and no skipping operation is performed on the luminance data which is more important, and in this point, the present variation is basically different, in an idea on which the invention is based, from the prior-art invention disclosed in Japanese Patent No. 3041951 in which the skipping operation is performed on the luminance data.

FIG. 42A is a view showing part of one of the color difference data Dm1*c* and FIG. 42B is a view showing data after the skipping operation on the color difference data Dm1*c* of FIG. 42A, and the numbers in FIGS. 42A and 42B represent values of the color difference data of the pixels. As shown in FIGS. 42A and 42B, in the skipping operation by the coding circuit 4, when one pixel is skipped every two pixels in a horizontal direction and one pixel is skipped every two pixels in a vertical direction with respect to the color difference data, the data capacity of the compressively-coded image data Da1 which is obtained as the result of skipping becomes ¼ of that before the skipping.

The skipped color difference data Dm1*c* shown in FIG. 42B is compressively coded and the compressively-coded image data is outputted to the first decoder circuit 6 and the memory control circuit 5A. When the skipping operation is performed, in order to obtain the color difference data of the skipped pixel, interpolation is performed on the first decoded image data Db1 and the second decoded image data Db0. Specifically, the first decoder circuit 6 and the second decoder circuit 7 comprise interpolation circuits 6S and 7S, respectively, (see FIG. 47) for performing interpolation to obtain the color difference data of the pixels skipped by the coding circuit 4.

FIGS. 43A to 43E are views showing an exemplary skipping operation. In the present variation, the data capacity of the luminance data allocated to each pixel is 8 bits and the data capacity of each of the two color difference data which is allocated to each pixel is 8 bits. FIG. 43A is a view showing the data capacity of the luminance data Dm1*y* in four blocks represented by the number of bits, and FIG. 43B is a view showing the data capacity of compressively-coded image data Da1*y* in one block represented by the number of bits. FIG. 43C is a view showing the data capacity of one of the color difference data Dm1*c* in four blocks represented by the number of bits, FIG. 43D is a view showing the data capacity of color difference data Dm1*c* after skipping operation of the data shown in FIG. 43C represented by the number of bits, and FIG. 43E is a view showing the data capacity of compressively-coded image data Da1*c* in one block represented by the number of bits. Since there are two color difference data, actually, the skipping operation from FIG. 43C to FIG. 43D and the compressive coding operation from FIG. 43D to FIG. 43E are performed on each of the two color difference data.

In this case, the FBTC parameters for the luminance data are set as BH=4, BV=4, La=8, Ld=8 and QL=4, and the FBTC parameters for the two color difference data are set as BH=4, BV=4, La=8, Ld=8 and QL=2.

When the compressive coding operation is performed on the luminance data on the basis of the above parameters, the state of FIG. 43B is obtained from the state of FIG. 43A. Specifically, the data capacity of the luminance data is reduced from 8×(8×8)=512 bits to (8+8+(2×(4×4)))×4=192 bits. In short, the data capacity of the luminance data Dm1*y*, 512 bits, is compressed to the data capacity of the compressively-coded image data Da1*y*, 192 bits.

The operation of skipping one pixel every two pixels in a horizontal direction and one pixel every two pixels in a vertical direction is performed on the color difference data before the compressive coding operation. Therefore, the state of FIG. 43D is obtained from the state of FIG. 43C. Through this skipping operation, the data capacity of one of the two color difference data is reduced from 8×(8×8)=512 bits to 8×(4×4)=128 bits.

Then, the compressive coding operation is performed on the color difference data on the basis of the above compressive coding parameters. Therefore, the state of FIG. 43E is obtained from the state of FIG. 43D. Through this compressive coding operation, the data capacity of one of the color difference data is reduced from 8×(4×4)=128 bits to (8+8+(1×(4×4)))=32 bits. Therefore, the whole data capacity of the two color difference data, 512×2=1024 bits is compressed to all the whole data capacity of the compressively-coded image data Da1*c*, 32×2=64 bits.

Thus, the data capacity of 1536 bits which is the sum of the data capacity of the luminance data Dm1*y*, 512 bits, and the data capacity of the color difference data Dm1*c*, 1024 bits, is compressively coded to the data capacity of the compressively-coded image data Da1, (192+64)=256 bits. In other words, the data capacity of the compressively-coded image data Da1 is $^{256}/_{1536}$ $^{1}/_{6}$ of the data capacity of the image data Dm1.

Figures 44A, 44B:
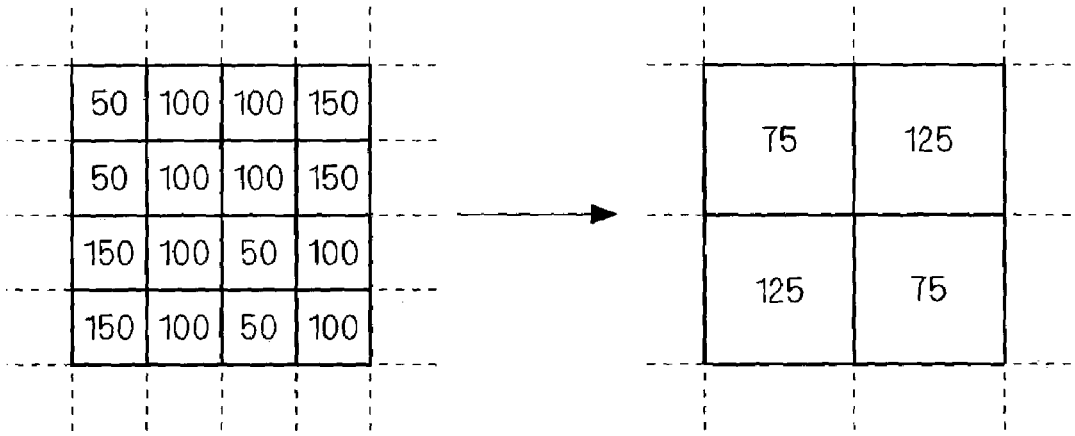
FIGS. 44A and 44B are views showing a smoothing operation in accordance with the second variation of the fourth preferred embodiment.
Figure 48:
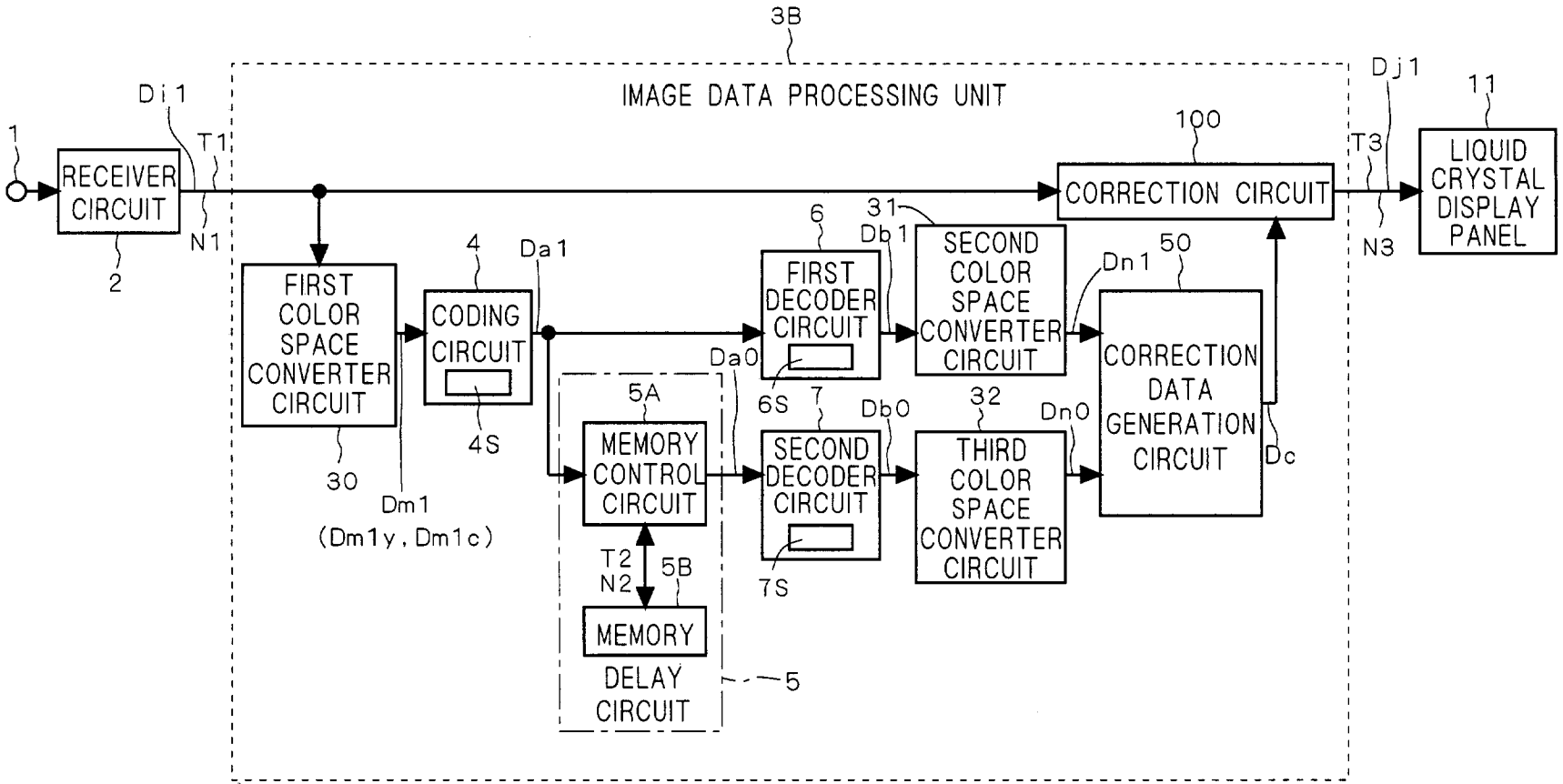
FIG. 48 is a block diagram showing a liquid crystal display device having a color difference data smoothing unit and an interpolation circuit.

Further, a smoothing operation may be performed on only the color difference data before the second coding operation. FIGS. 44A and 44B are views showing a case where a smoothing unit 4S (see FIG. 48) in the coding circuit 4 performs such a smoothing operation. FIG. 44A is a view showing part of one of the two color difference data Dm1*c*, and FIG. 44B is a view showing data after the smoothing operation of the color difference data Dm1*c* of FIG. 44A. Also in this case, the numbers in FIGS. 44A and 44B represent values of the color difference data of the pixels.

As shown in FIGS. 44A and 44B, the smoothing operation of the color difference data is performed in a block consisting of two pixels in a horizontal direction and two pixels in a vertical direction, totally four pixels. When the smoothing operation is performed, the data capacity of the compressively-coded image data Da1*c* which is thus obtained is ¼ of the data capacity before the smoothing operation.

After that, the color difference data Dm1*c* of FIG. 44B which is smoothed is compressively coded, and the obtained data are outputted to the first decoder circuit 6 and the memory control circuit 5A. The compressive coding operation is the same as discussed in conjunction with the skipping operation.

Also in the case of performing the above smoothing operation, it is necessary to perform interpolation of the first decoded image data Db1 and the second decoded image data Db0 outputted from the first decoder circuit 6 and the second decoder circuit 7, respectively, in order to obtain the color difference data of the pixels which are smoothed. Therefore, the first decoder circuit 6 and the second decoder circuit 7 have interpolation circuits 6S and 7S, respectively, (see FIG. 48) for performing this interpolation.

Though the case where the FBTC is performed by the coding circuit 4 using the FBTC parameters shown in FIGS. 43A and 43B is discussed as an example herein, the present variation is not limited to these parameter values. In other words, any combination of the FBTC parameters may be used. As a matter of course, methods other than the FBTC is used as the compressive coding.

Effects of the Second Variation of the Fourth Preferred Embodiment

As discussed above, since the skipping operation or the smoothing operation is performed only on the color difference data while avoiding loss of information in the luminance data in the present variation, it is possible to remarkably reduce the memory capacity of the memory 5B required to delay the present image data Di1 by the one frame period and further reduce the circuit scale since it is not necessary to increase the data transmission speed between the memory control circuit 5A and the memory 5B.

Additionally, since the data capacity of the compressively-coded image data Da1 is remarkably compressed by the coding circuit 4 as compared with the data capacity of the present image data Di1, the time T2 required for data transmission between the memory control circuit 5A and the memory 5B does not lag behind the time T1 required for the image data processing unit 3A to receive all the present image data Di1 of one frame and input the data therein and the number of bits N2 of data transmitted between the memory control circuit 5A and the memory 5B can be set smaller than the number of transmission bits N1 of the inputted data.

Further, when the inputted image is represented by the image data needing 24 bits per pixel, since the sum of the amount of data outputted from the memory control circuit 5A to the memory 5B and the amount of data read out from the memory 5B to the memory control circuit 5A within the time period while the present image data Di1 for one pixel is received is 48×(⅙)=8 bits, a bus having a width of 8 bits can be used as the bus for connecting the memory control circuit 5A and the memory 5B.

The Third Variation of the Fourth Preferred Embodiment

The technical ideas shown in the fourth preferred embodiment and the first to third variations thereof may be applied to the first preferred embodiment, the second preferred embodiment and its variations and the third preferred embodiment and its variations.

Figure 45:
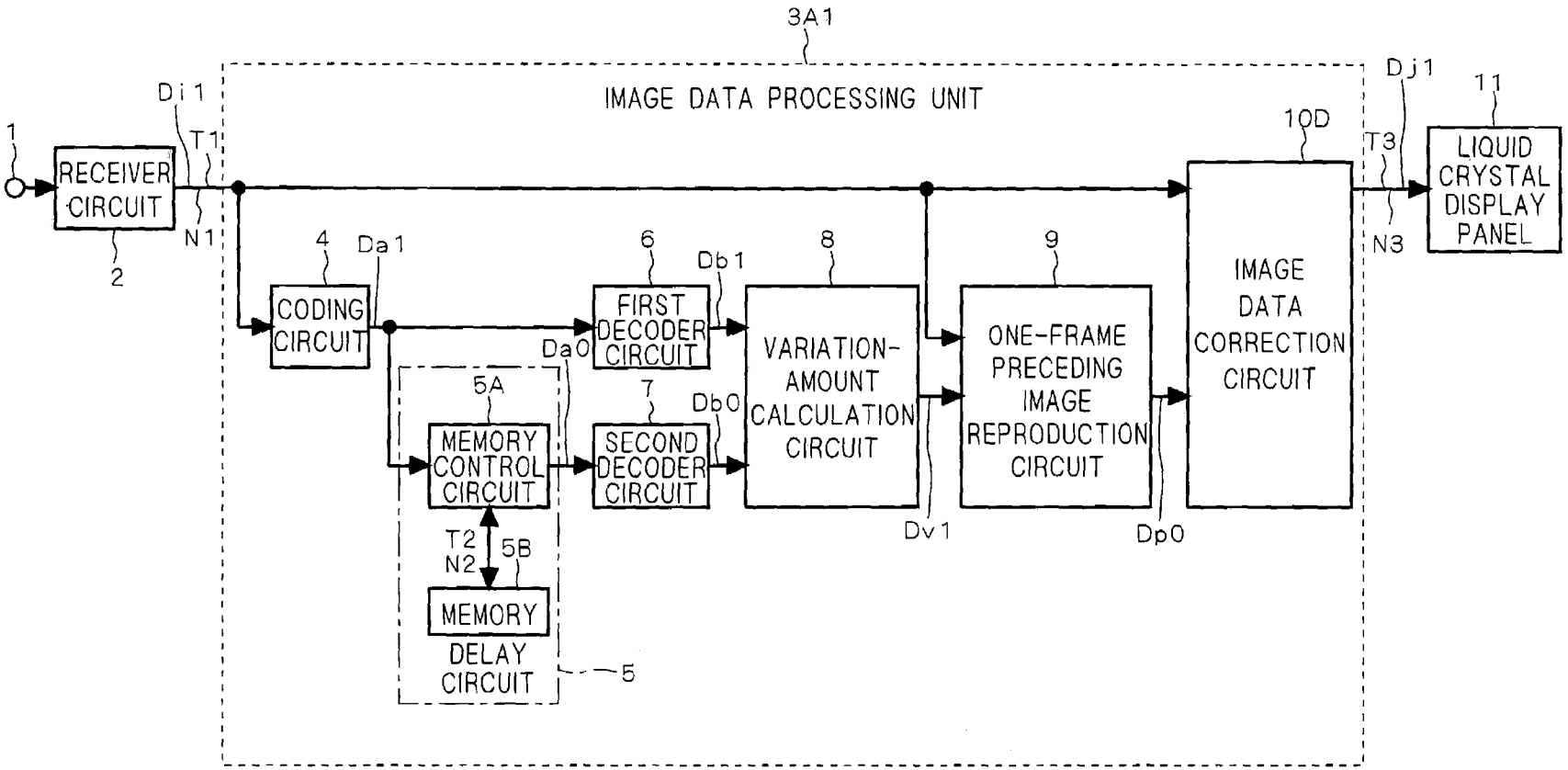
FIG. 45 is a block diagram showing an exemplary constitution of a liquid crystal display device in accordance with a third variation of the fourth preferred embodiment.

As such an example, a device in which the characteristic feature of the fourth preferred embodiment illustrated in FIG. 34 is applied to the third preferred embodiment illustrated in FIG. 23 is shown in the block diagram of FIG. 45. In this case, the above-discussed effects of the fourth preferred embodiment can be produced additionally to the effects of the third preferred embodiment.

Additional Note

For example, the image data processing device or the image data processing unit shown in FIG. 1 or the like figures may be constructed as an integrated circuit and further may be constructed as one function of a microcomputer unit which allows software processing. In a latter case, the constituent circuits in the image data processing unit of FIG. 1 or the like figures, are achieved as function units which perform the function of the corresponding circuits.

While the invention has been shown and described in detail, the foregoing description is in all aspects illustrative and not restrictive. It is therefore understood that numerous modifications and variations can be devised without departing from the scope of the invention.

What is claimed is:

1. An image data processing circuit for correcting an image data representing a gray-scale level of an image to be displayed by a liquid crystal element, wherein a voltage applied to said liquid crystal element is determined based on said image data, said image data processing circuit comprising:

a coding circuit for outputting a coded-image data which is produced by coding said image data of a present frame;

a first decoding circuit for decoding said coded-image data, thereby producing a first decoded-image data corresponding to said present frame;

a delay circuit for delaying the coded-image data by one frame period;

a second decoding circuit for decoding said coded-image data which is delayed by one frame period, thereby producing a second decoded-image data corresponding to a previous frame;

a detecting circuit for detecting a deference between said first decoded-image data and said second decoded-image data;

an image reproducing circuit for producing a previous-frame-image data on the basis of the image data of said present frame and the difference between said first decoded-image data and said second decoded-image data; and a data correcting circuit for correcting said image data of said present frame in accordance with the difference of said gray-scale level between said present frame and said previous frame obtained from said previous-frame-image data and said image data of said present frame.

2. An image data processing circuit according to claim 1, wherein said data correcting circuit includes a look-up-table which outputs a corrected image data according to said previous-frame-image data and said image data of said present frame.

3. An image data processing circuit according to claim 2, wherein said data correcting circuit further includes a data converting circuit which reduces the bit number of said previous-frame-image data and/or said image data of said present frame, and said correcting circuit outputs said corrected image data according to the output of said data converting circuit.

4. An image data processing circuit according to claim 3, further comprising a circuit for limiting said corrected image data in accordance with a difference between said image data of said present frame and said previous-frame-image data.

5. An image data processing circuit according to claim 1, wherein said image data is corrected in accordance with a temperature of said liquid crystal element.

6. An image data processing circuit according to claim 5, wherein said correcting circuit includes a plurality of look-up-tables, each of which contains different value of said corrected image data, and one of the look-up-tables outputs said corrected image data according to said temperature of said liquid crystal element.

7. An image data processing circuit for correcting an image data representing a gray-scale level of an image to be displayed by a liquid crystal element, wherein a voltage applied to said liquid crystal display device is determined by said image data, said image data processing circuit comprising:

a coding circuit for outputting a coded-image data which is produced by coding said image data of a present frame;

a first decoding circuit for decoding said coded-image data, thereby producing a first decoded-image data corresponding to said present frame;

a memory control circuit which writes said coded-image data into a memory and reads said coded-image data out from the memory after one frame period;

a second decoding circuit for decoding said coded-image data read out from the memory, thereby producing a second decoded-image data corresponding to a previous frame; and a data correcting circuit for correcting said image data of said present frame in accordance with the difference of said gray-scale level between said present frame and said previous frame obtained from said first-decoded image data and said second-decoded image data, wherein a data amount of said coded-image data is determined so that said memory controlling circuit is able to perform writing and reading of said coded-image data within the one frame period.

8. A image data processing circuit according to claim 1, wherein said image data is corrected so that a transmissivity of said liquid crystal reaches a level corresponding to said gray-scale level represented by said image data within one frame period.

9. An image data processing method for correcting an image data representing a gray-scale level of an image to be displayed by a liquid crystal element, wherein a voltage applied to the liquid crystal element is determined based on the image data, the image data processing method comprising:

outputting a coded-image data which is produced by coding said image data of a present frame;

decoding said coded-image data, thereby producing a first decoded-image data corresponding to said present frame;

delaying said coded-image data by one frame period;

decoding said coded-image data delayed by one frame period, thereby producing a second decoded-image data corresponding to a previous frame;

detecting a deference between said first decoded image data and said second decoded-image data;

producing a previous-frame-image data on the basis of said image data of said present frame and the difference between said first decoded image data and said second decoded-image data; and correcting said image data of said present frame in accordance with the difference of said gray-scale level between said present frame and said previous frame obtained from said previous-frame-image data and said image data of said present frame.

10. An image data processing method according to claim 9, wherein said image data is corrected by referring to a look-up-table which holds a corrected image data.

11. An image data processing method according to claim 10, further comprising:

reducing the bit number of said previous-frame-image data and/or said image data of said present frame, wherein the look-up-table outputs said corrected image data according to said previous-frame-image data and/or said image data of said present frame with reduced bit number.

12. An image data processing method according to claim 11, further comprising limiting said corrected image data in accordance with a difference between said image data of said present frame and said previous-frame-image data.

13. An image data processing method according to claim 9, wherein said image data is corrected in accordance with a temperature of the liquid crystal element.

14. An image data processing method according to claim 13, wherein said image data is corrected by referring to a plurality of look-up-tables, each of which contains different value of said corrected image data, and one of the look-up-tables outputs said corrected image data according to a temperature of said liquid crystal element.

15. An image data processing method for correcting an image data representing a gray-scale level of an image to be displayed by a liquid crystal element, wherein a voltage applied to the liquid crystal element is determined based on said image data, said image data processing method comprising:

outputting a coded-image data which is produced by coding said image data of a present frame;

decoding said coded-image data, thereby producing a first decoded-image data corresponding to said present frame;

delaying said coded-image data by writing the coded-image data into a memory and reading out said coded-image data from the memory after one frame period;

decoding said coded-image data read out from the memory, thereby producing a second decoded-image data corresponding to a previous frame; and correcting said image data of said present frame in accordance with the difference of said gray-scale level between said present frame and said previous frame obtained from said first-decoded image data and said second-decoded image data, wherein a data amount of said coded-image data is determined so that said memory controlling circuit is able to perform writing and reading of said coded-image data within the one frame period.

16. An image data processing methods according to claim 9, wherein said image data is corrected so that a transmissivity of said liquid crystal reaches a level corresponding to said gray-scale level represented by said image data within one frame period.

* * * * *